US007002582B2

(12) United States Patent
Koyama et al.

(10) Patent No.: US 7,002,582 B2
(45) Date of Patent: Feb. 21, 2006

(54) CHARACTER DISPLAY APPARATUS, CHARACTER DISPLAY METHOD, CHARACTER DISPLAY PROGRAM, AND RECORDING MEDIUM THEREFOR

(75) Inventors: Noriyuki Koyama, Kyoto (JP); Satoshi Okada, Kyoto (JP); Yoshimi Asai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 105 days.

(21) Appl. No.: 10/175,005

(22) Filed: Jun. 20, 2002

(65) Prior Publication Data

US 2003/0011603 A1 Jan. 16, 2003

(30) Foreign Application Priority Data

Jun. 20, 2001 (JP) ..... 2001-187412

(51) Int. Cl.
*G09G 5/28* (2006.01)

(52) U.S. Cl. ..... 345/470; 345/467

(58) Field of Classification Search ..... 345/470, 345/467

See application file for complete search history.

(56) References Cited

U.S. PATENT DOCUMENTS 6,078,306 A * 6/2000 Lewis ..... 345/685
6,542,161 B1 * 4/2003 Koyama et al. ..... 345/589

FOREIGN PATENT DOCUMENTS

| | | | |
|---|---|---|---|
| CN | 1264864 | | 8/2000 |
| EP | 001026659 | A2 * | 8/2000 |
| JP | 07-096594 | A | 4/1995 |
| JP | 07-195652 | A | 8/1995 |
| JP | 07-234867 | A | 9/1995 |
| JP | 2001-100725 | A | 4/2001 |

* cited by examiner

*Primary Examiner*—Richard Hjerpe
*Assistant Examiner*—Michelle K. Lay
(74) *Attorney, Agent, or Firm*—Birch, Stewart, Kolasch & Birch, LLP

(57) ABSTRACT

Character display apparatus includes a display device and a control section. The control section controls the display device such that: a color element level of at least one first sub-pixel, which corresponds to a basic portion of a first character, is set to a predetermined color element level; and a color element level of a first vicinal sub-pixel located in the vicinity of the at least one first sub-pixel is set to a color element level different from the predetermined color element level, whereby the first character is displayed on a display plane, the basic portion of the first character is included in a first frame having a predetermined size, the at least one first sub-pixel is included in a first region on the display plane which corresponds to the first frame, and at least one of the at least one first vicinal sub-pixel is out of the first region.

15 Claims, 47 Drawing Sheets

*FIG. 3*

Brightness table 392

| | | Brightness level | | |
|---|---|---|---|---|
| | | R | G | B |
| Color element level | 7 | 0 | 0 | 0 |
| | 6 | 36 | 36 | 36 |
| | 5 | 73 | 73 | 73 |
| | 4 | 109 | 109 | 109 |
| | 3 | 146 | 146 | 146 |
| | 2 | 182 | 182 | 182 |
| | 1 | 219 | 219 | 219 |
| | 0 | 255 | 255 | 255 |

*FIG. 4*

Correction table 390

| | | Correction pattern |
|---|---|---|
| Color element level | Sub-pixel 1 | 5 |
| | Sub-pixel 2 | 2 |
| | Sub-pixel 3 | 1 |

FIG. 30

| Brightness level | Color element level |
|---|---|
| 0 | 7 |
| 36 | 6 |
| 73 | 5 |
| 109 | 4 |
| 146 | 3 |
| 182 | 2 |
| 219 | 1 |
| 255 | 0 |

3001

FIG. 32

| Target sub-pixel | Adjacent sub-pixels |
|---|---|
| 7 | 1, 2, 5 |
| 5 | 0, 1, 2 |
| 2 | 0, 0, 1 |
| 1 | 0, 0, 0 |
| 0 | 0, 0, 0 |

3201

FIG. 33

| | | |
|---|---|---|
| 0 | 0 | 0 |
| 0 | 0 | 0 |
| 0 | 0 | 0 |
| 0 | 0 | 0 |
| 0 | 0 | 0 |
| 0 | 0 | 0 |
| 0 | 0 | 0 |
| 0 | 0 | 1 |
| 0 | 1 | 2 |
| 0 | 0 | 0 |

2803

FIG. 34

| | | |
|---|---|---|
| 255 | 255 | 255 |
| 255 | 255 | 255 |
| 255 | 255 | 255 |
| 255 | 255 | 255 |
| 255 | 255 | 255 |
| 255 | 255 | 255 |
| 255 | 255 | 255 |
| 255 | 255 | 219 |
| 255 | 219 | 182 |
| 255 | 255 | 255 |

2803

CHARACTER DISPLAY APPARATUS, CHARACTER DISPLAY METHOD, CHARACTER DISPLAY PROGRAM, AND RECORDING MEDIUM THEREFOR

BACKGROUND OF THE INVENTION

1. Field of the Invention

The present invention relates to a character display apparatus, a character display method, and a character display program capable of displaying a character with a high quality using a color display device, and a recording medium for use with such apparatus, method, and program.

2. Description of the Related Art

Japanese Laid-Open Publication No. 2001-100725 describes a known, conventional technique of displaying a character using a color display device. According to this technique, the intensity of a color element (e.g., brightness level) of a sub-pixel corresponding to a basic portion of a character is set to a predetermined value, while the intensity of a color element of a sub-pixel located adjacent to the sub-pixel corresponding to the basic portion of the character is set to a value different from the predetermined value. The number of sub-pixels whose color element intensities are set to values different from the predetermined value, and the color element intensities of these sub-pixels, are determined based on a correction pattern.

FIG. 43 shows an example where the intensities of sub-pixels corresponding to a basic portion of a character "/ (slash)" is set to a predetermined value according to the conventional technique described in Japanese Laid-Open Publication No. 2001-100725. In FIG. 43, each hatched box represents a sub-pixel corresponding to the basic portion of the character "/". Where the color element intensity of a sub-pixel is represented by brightness levels 0–255, the color element intensity of a sub-pixel corresponding to the basic portion of the character "/" is set to, for example, "brightness level 0" (predetermined value). In FIG. 43, each open box represents a sub-pixel corresponding to the background of the character "/". The color element intensity of a sub-pixel corresponding to the background of the character "/" is set to brightness level 255, for example.

FIG. 44 shows an example where the color element intensities of sub-pixels located adjacent to sub-pixels corresponding to the basic portion of the character "/" are set to values different from the predetermined value according to the above conventional technique. In the example illustrated in FIG. 44, the color element intensities of three sub-pixels located adjacent to each of the left and right sides of a certain sub-pixel which corresponds to the basic portion of the character "/" are set, based on a preset correction pattern, to "brightness level 73", "brightness level 182" and "brightness level 219" in this order from the sub-pixel closest to the basic portion of the character to the farthest one from the basic portion of the character. Hereinafter, in this specification, setting the color element intensity of a sub-pixel located adjacent to a certain sub-pixel corresponding to a basic portion of a character based on a correction pattern is referred to as "placing a correction pattern".

The reasons why a correction pattern is placed are to suppress color noise in a character (i.e., to make the character look black to a human eye), and to adjust the width of lines included in the character to a desired width.

Thus, according to the conventional technique, a correction pattern is placed adjacent to a sub-pixel corresponding to a basic portion of a character, whereby the character is displayed with a high quality.

A basic portion of a character is included in a frame having a certain size. A sub-pixel corresponding to the basic portion of the character is included within a region on a display plane of a display device which corresponds to the frame.

FIG. 45 shows a relationship between sub-pixels corresponding to a basic portion of a character "A" and a region corresponding to a frame. In FIG. 45, each hatched box represents a sub-pixel corresponding to the basic portion of the character "A". A region 1021 represents a region on a display plane which corresponds to a frame of the character "A".

FIG. 46 shows an example where the color element intensities of sub-pixels located adjacent to sub-pixels corresponding to the basic portion of the character "A" are set to values different from the predetermined value according to the above conventional technique. In the example illustrated in FIG. 46, three adjoining sub-pixels have to be secured for placing a correction pattern. However, within the region 1021 corresponding to the frame of the character "A", there are only two sub-pixels (sub-pixels 1034 and 1035) located adjacent to the right side of a sub-pixel 1031. Similarly, within the region 1021, there is only one sub-pixel (sub-pixel 1036) located adjacent to the right side of a sub-pixel 1032. Therefore, a correction pattern cannot be placed at the right sides of the sub-pixels 1031 and 1032 so as to all fit within the region 1021.

Conventionally, a character is displayed on a display device such that the character is placed within a region on a display plane of the display device which corresponds to a frame of the character. If a correction pattern at a portion of the region 1021 (i.e., portion 1033) cannot be placed entirely within the region 1021, as shown in FIG. 46, color noise occurs in such a portion and therearound, and/or the width of a line of the character at that portion cannot be seen as having a desired width. As a result, the character cannot be displayed on the display device with a high quality.

FIG. 47 shows an example where the color element intensities of sub-pixels located adjacent to sub-pixels corresponding to a basic portion of a character "H" are set to values different from the predetermined value according to the above conventional technique. In the example illustrated in FIG. 47, in a portion of the right vertical line of the character "H" (portion 1041), a correction pattern cannot be placed within the region 1021 which corresponds to a frame of the character "H". As a result, color noise occurs in the portion 1041, and the width of a line of the character at the portion 1041 cannot be seen as having a desired width. In this example, the right vertical line of the character "H" looks thinner than the left vertical line of the character "H". As a result, the character "H" cannot be displayed on the display device with a high quality.

SUMMARY OF THE INVENTION

According to one aspect of the present invention, a character display apparatus includes: a display device including a display plane having a plurality of pixels; and a control section for controlling the display device, wherein each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, each of the plurality of sub-pixels has one of the plurality of color element levels, the control section controls the display device such that: a color element level of at least one first sub-pixel, which corresponds to a basic portion of a first character, is set to a predetermined color element level; and a color element level of a first vicinal sub-pixel located in the vicinity of the at least one first sub-pixel is set to a color element level which is different from the predetermined color element level, whereby the first character is displayed on the display plane, the basic portion of the first character is included in a first frame having a predetermined size, the at least one first sub-pixel is included in a first region on the display plane which corresponds to the first frame, and at least one of the at least one first vicinal sub-pixel is out of the first region.

In one embodiment of the present invention, the control section controls the display device such that a second character is displayed on the display plane at a position adjacent to the first character, a basic portion of the second character is included in a second frame having a predetermined size; at least one second sub-pixel corresponding to the second character is included in a second region on the display plane which corresponds to the second frame; and the at least one of the at least one first vicinal sub-pixel is included in the second region.

In another embodiment of the present invention, the first character and the second character have identical display attributes.

In still another embodiment of the present invention, each of the basic portions of all the characters displayed on the display device is included in a frame having a predetermined size, and the at least one of the at least one first vicinal sub-pixel is not included in either of the regions on the display plane which respectively correspond to the frames.

In still another embodiment of the present invention, the control section sets a color element level of the at least one of the at least one first vicinal sub-pixel based on a color element level which is determined according to a distance from the at least one first sub-pixel and a color element level which is determined according to a distance from the at least one second sub-pixel.

In still another embodiment of the present invention, the control section sets the intensity of a color element of at least one predetermined sub-pixel included in the first region to a predetermined value regardless of a type of the first character.

In still another embodiment of the present invention, the control section sets again the color element level of the at least one of the at least one first vicinal sub-pixel when the control section controls the display device so as to write a third character over the first character displayed on the display plane.

According to another aspect of the present invention, a character display apparatus includes: a display device including a display plane having a plurality of pixels; and a control section for controlling the display device, wherein each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, each of the plurality of sub-pixels has one of the plurality of color element levels, the control section controls the display device such that: a color element level of at least one first sub-pixel, which corresponds to a basic portion of a first character, and a color element level of at least one second sub-pixel, which corresponds to a basic portion of a second character, are set to a predetermined color element level; and a color element level of a sub-pixel located in the vicinity of the at least one first sub-pixel and a color element level of a sub-pixel located in the vicinity of the at least one second sub-pixel are set to a color element level which is different from the predetermined color element level, based on a color element level which is determined according to a distance from the at least one first sub-pixel and a color element level which is determined according to a distance from the at least one second sub-pixel, whereby the first and second characters are displayed on the display plane.

According to still another aspect of the present invention, there is provided a character display method for displaying a character on a display plane having a plurality of pixels, wherein each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, each of the plurality of sub-pixels has one of the plurality of color element levels, the method comprises steps of: (a) setting a color element level of at least one first sub-pixel, which corresponds to a basic portion of a first character, to a predetermined color element level; and (b) setting a color element level of at least one first vicinal sub-pixel located in the vicinity of the at least one first sub-pixel to a color element level which is different from the predetermined color element level, wherein the basic portion of the first character is included in a first frame having a predetermined size, the at least one first sub-pixel is included in a first region on the display plane which corresponds to the first frame, and at least one of the at least one first vicinal sub-pixel is out of the first region.

According to still another aspect of the present invention, there is provided a character display method for displaying a character on a display plane having a plurality of pixels, wherein each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, each of the plurality of sub-pixels has one of the plurality of color element levels, the method comprises steps of: (a) setting a color element level of at least one first sub-pixel, which corresponds to a basic portion of a first character, a color element level of at least one second sub-pixel, which corresponds to a basic portion of a second character, to a predetermined color element level; and (b) setting a color element level of a sub-pixel located in the vicinity of the at least one first sub-pixel and a color element level of a sub-pixel located in the vicinity of the at least one second sub-pixel to a color element level which is different from the predetermined color element level, based on a color element level which is determined according to a distance from the at least one first sub-pixel and a color element level which is determined according to a distance from the at least one second sub-pixel.

According to still another aspect of the present invention, there is provided a program for allowing an information display apparatus to execute character display processing, the information display apparatus including a display device which is provided with a display plane having a plurality of pixels, wherein each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, and each of the plurality of sub-pixels has one of the plurality of color element levels, the character display processing comprises steps of: (a) setting a color element level of at least one first sub-pixel, which corresponds to a basic portion of a first character, to a predetermined color element level; and (b) setting a color element level of at least one first vicinal sub-pixel located in the vicinity of the at least one first sub-pixel to a color element level which is different from the predetermined color element level, wherein the basic portion of the first character is included in a first frame having a predetermined size, the at least one first sub-pixel is included in a first region on the display plane which corresponds to the first frame, and at least one of the at least one first vicinal sub-pixel is out of the first region.

According to still another aspect of the present invention, there is provided a program for allowing an information display apparatus to execute character display processing, the information display apparatus including a display device which is provided with a display plane having a plurality of pixels, wherein each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, and each of the plurality of sub-pixels has one of the plurality of color element levels, the method comprises steps of: (a) setting a color element level of at least one first sub-pixel, which corresponds to a basic portion of a first character, a color element level of at least one second sub-pixel, which corresponds to a basic portion of a second character, to a predetermined color element level; and (b) setting a color element level of a sub-pixel located in the vicinity of the at least one first sub-pixel and a color element level of a sub-pixel located in the vicinity of the at least one second sub-pixel to a color element level which is different from the predetermined color element level, based on a color element level which is determined according to a distance from the at least one first sub-pixel and a color element level which is determined according to a distance from the at least one second sub-pixel.

According to still another aspect of the present invention, there is provided a recording medium which can be read by an information display apparatus, the information display apparatus including a display device which is provided with a display plane having a plurality of pixels, wherein the recording medium stores a program which allows the information display apparatus to execute character display processing, each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, and each of the plurality of sub-pixels has one of the plurality of color element levels, the character display processing comprises steps of: (a) setting a color element level of at least one first sub-pixel, which corresponds to a basic portion of a first character, to a predetermined color element level; and (b) setting a color element level of at least one first vicinal sub-pixel located in the vicinity of the at least one first sub-pixel to a color element level which is different from the predetermined color element level, wherein the basic portion of the first character is included in a first frame having a predetermined size, the at least one first sub-pixel is included in a first region on the display plane which corresponds to the first frame, and at least one of the at least one first vicinal sub-pixel is out of the first region.

According to still another aspect of the present invention, there is provided a recording medium which can be read by an information display apparatus, the information display apparatus including a display device which is provided with a display plane having a plurality of pixels, wherein the recording medium stores a program which allows the information display apparatus to execute character display processing, each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, and each of the plurality of sub-pixels has one of the plurality of color element levels, the method comprises steps of: (a) setting a color element level of at least one first sub-pixel, which corresponds to a basic portion of a first character, a color element level of at least one second sub-pixel, which corresponds to a basic portion of a second character, to a predetermined color element level: and (b) setting a color element level of a sub-pixel located in the vicinity of the at least one first sub-pixel and a color element level of a sub-pixel located in the vicinity of the at least one second sub-pixel to a color element level which is different from the predetermined color element level, based on a color element level which is determined according to a distance from the at least one first sub-pixel and a color element level which is determined according to a distance from the at least one second sub-pixel.

Thus, the invention described herein makes possible the advantages of: (1) providing a character display apparatus, a character display method, and a character display program capable of displaying a character with a high quality even when a correction pattern cannot be placed so as to be entirely within a region corresponding to a frame; and (2) providing a recording medium for use with such apparatus, method, and program.

These and other advantages of the present invention will become apparent to those skilled in the art upon reading and understanding the following detailed description with reference to the accompanying figures.

BRIEF DESCRIPTION OF THE DRAWINGS

FIG. 3 shows a brightness table 392 which is an example of a brightness table 42*c* stored in an auxiliary storage apparatus 40.

FIG. 4 shows a correction table 390 as an example of a correction table 42*b* stored in the auxiliary storage apparatus 40.

FIG. 30 shows an example of a table 3001 which defines correspondence between brightness levels and color element levels.

FIG. 32 shows a table 3201 which defines the correspondence between the color element level of a target sub-pixel and the color element levels of sub-pixels adjacent to the target sub-pixel.

FIG. 33 shows the color element levels of sub-pixels at the first to third sub-pixel positions from the right-side border of a region on the display plane 400 to be overwritten (sub-pixels included in the region 2801 shown in FIG. 28), which are set using the table 3201 shown in FIG. 32.

FIG. 34 shows the brightness levels of sub-pixels included in the region 2803, which are obtained after the color element levels of the sub-pixels shown in FIG. 33 are converted to brightness levels.

DESCRIPTION OF THE PREFERRED EMBODIMENTS

Hereinafter, embodiments of the present invention will be described with reference to the drawings.

(Embodiment 1)

Figure 1:
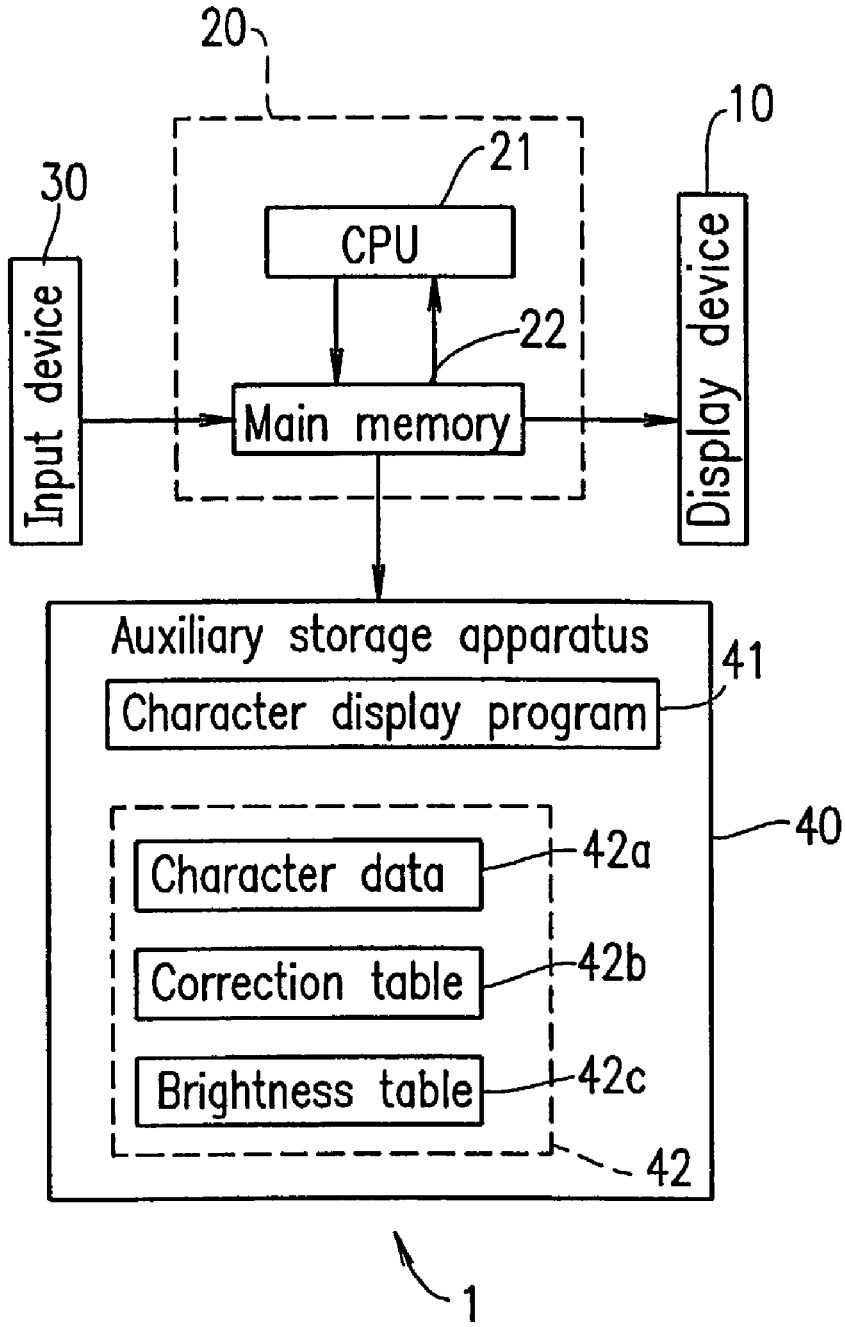
FIG. 1 is a block diagram showing a structure of a character display apparatus 1 according to embodiment 1 of the present invention.

FIG. 1 illustrates a structure of a character display apparatus 1 according to embodiment 1 of the present invention. The character display apparatus 1 may be, for example, a personal computer. Such a personal computer may be of any type such as a desk top type or lap top type computer. Alternatively, the character display apparatus 1 may be a word processor.

Moreover, the character display apparatus 1 may alternatively be any other electronic apparatus or information apparatus incorporating a color display device. For example, the character display apparatus 1 may be an electronic apparatus incorporating a color liquid crystal display device, a portable information terminal which is a portable information tool, a portable phone, such as a PHS (Personal Handyphone System) phone, etc., a general-purpose communication apparatus such as a telephone/FAX, or the like.

The character display apparatus 1 includes a display device 10 capable of performing a color display, and a control section 20 for independently controlling a plurality of color elements respectively corresponding to a plurality of sub-pixels included in the display device 10. The control section 20 is connected to the display device 10, an input device 30 and an auxiliary storage apparatus 40.

The input device 30 is used to input to the control section 20 character in formation representing a character to be displayed on the display device 10. For example, the character information may include a character code for identifying the character and a character size indicating the size of the character to be displayed. The input device 30 may be any type of input device through which the character code and the character size can be input. For example, a keyboard, a mouse or a pen-type input device may suitably be used as the input device 30. When the character display apparatus 1 is a portable phone, the numeric key pads of the phone, which are provided for designating a phone number to call, maybe used for inputting a character code and character size. Further, in the case where the size of a character to be displayed on the display device 10 is limited to one size, an input of the character size is not necessary. In the case where the character display apparatus 1 has means for connecting to a communication line, including the Internet, a message included in an electronic mail which is received through the communication line may be displayed on the display device 10. In this case, the means for connecting to the communication line functions as the input device 30.

The auxiliary storage apparatus 40 stores a character display program 41 and data 42 which is required to execute the character display program 41. The data 42 includes character data 42*a* which defines the shape of a character. For example, the character data 42*a* includes a bit map (basic portion data) which defines a basic portion of the character on a sub-pixel by sub-pixel basis. The basic portion of a character is a portion which corresponds to the core structure of the character.

The auxiliary storage apparatus 40 may be any type of storage apparatus capable of storing the character display program 41 and the data 42. Any type of recording medium may be used in the auxiliary storage apparatus 40 for storing the character display program 41 and the data 42. For example, a hard disk, CD-ROM, MO, MD, DVD, IC card, optical card, or the like, may suitably be used as a recording medium.

The present invention is not limited to applications where the character display program 41 and the data 42 are stored on a recording medium in the auxiliary storage apparatus 40. For example, the character display program 41 and the data 42 may alternatively be stored in a main memory 22 or in a ROM (not shown). For example, such a ROM may be a mask ROM, EPROM, EEPROM, flash ROM, or the like. In such a ROM-based system, it is possible to readily realize various types of processing simply by switching ROMs. For example, the ROM-based system may suitably be used in the case where the character display apparatus 1 is a portable terminal apparatus or a portable phone.

The recording medium for storing the character display program 41 and the data 42 maybe those which carry a program and/or data in a fixed manner such as the disk or card type storage apparatus or a semiconductor memory, as well as those which carry a program and/or data in a flexible manner such as a communication medium used for transferring a program and/or data in a communication network. When the character display apparatus 1 is provided with means for connecting to a communication line, including the Internet, at least a portion of the character display program 41 and the data 42 may be downloaded from the communication line. In such a case, a loader program required for the download may be either pre-stored in a ROM (not shown) or installed from the auxiliary storage apparatus 40 into the control section 20. An overwrite program 43 (FIG. 26) and a character display program 41*a* (FIG. 37), which will be described later, may be handled in a manner similar to that for the character display program 41.

The control section 20 includes a CPU 21 and the main memory 22.

The CPU 21 controls and monitors the entire character display apparatus 1, and also executes the character display program 41 stored in the auxiliary storage apparatus 40.

The main memory 22 temporarily stores data which has been input through the input device 30, data to be displayed on the display device 10, or data which is required to execute the character display program 41. The main memory 22 is accessed by the CPU 21 at a high speed.

The CPU 21 generates a character pattern by executing the character display program 41 based on various data stored in the main memory 22. The generated character pattern is once stored in the main memory 22 and then output to the display device 10. The timing at which the character pattern is output to the display device 10 is controlled by the CPU 21.

The entire control section 20 controls the display device 10 to set the color element intensities of sub-pixels included in a display plane of the display device 10 so that a character is displayed on the display plane.

Figure 2:
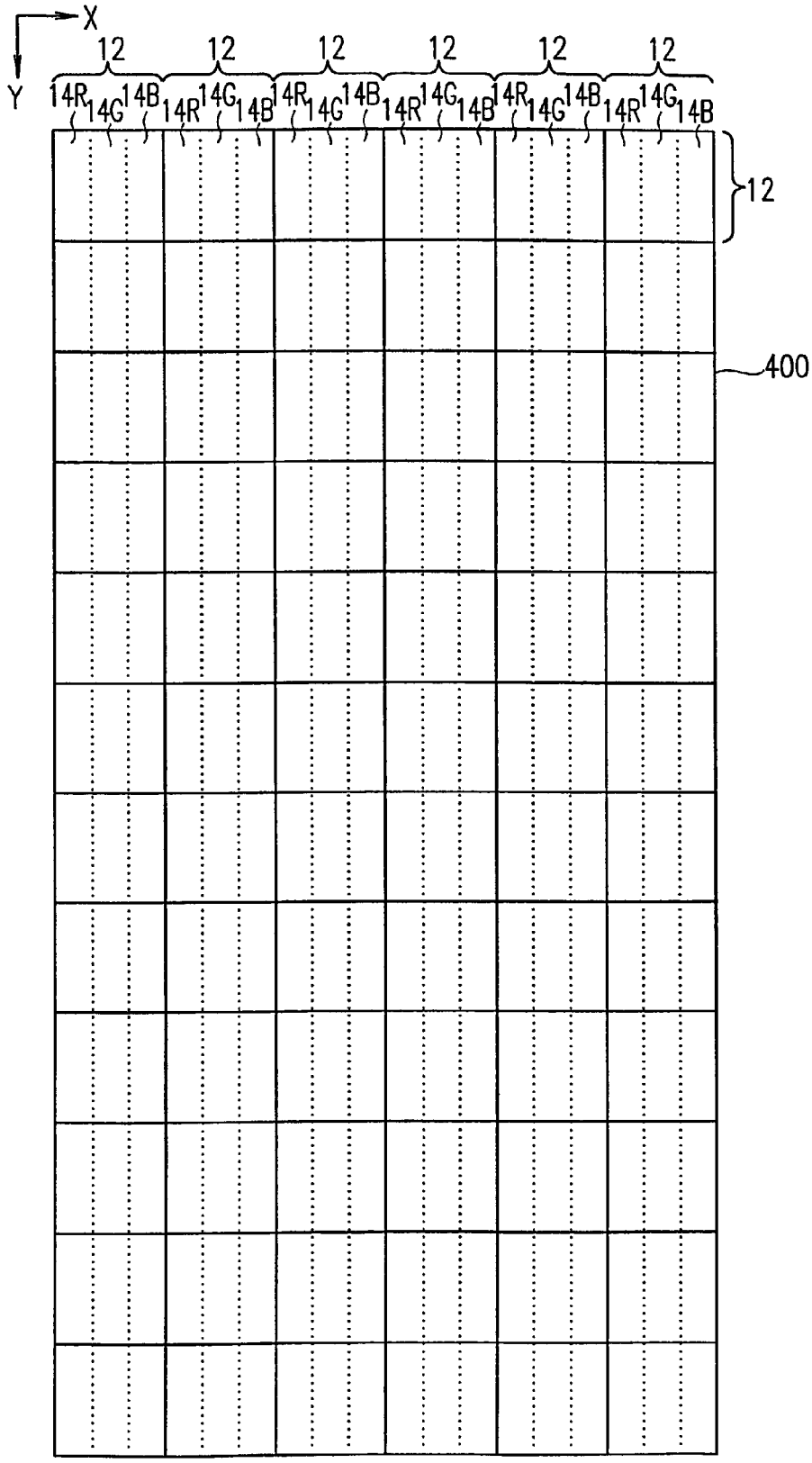
FIG. 2 illustrates an example of a display plane 400 of a display device 10.

FIG. 2 schematically illustrates a display plane 400 of the display device 10. The display device 10 includes a plurality of pixels 12 which are arranged along the X and Y directions. Each of the pixels 12 includes a plurality of sub-pixels which are arranged along the X direction. In the example illustrated in FIG. 2, each pixel 12 includes three sub-pixels 14R, 14G and 14B.

The sub-pixel 14R is pre-assigned to a color element R so as to output color R(red). The sub-pixel 14G is pre-assigned to a color element G so as to output color G (green). The sub-pixel 14B is pre-assigned to a color element B so as to output color B (blue).

The intensity of a color element (e.g., brightness) of each of the sub-pixels 14R, 14G and 14B is represented by a value ranging from 0 to 255 (0x00 to 0xff),for example. Herein, "0x" indicates a hexadecimal representation. When each of the sub-pixels 14R, 14G and 14B may independently take a value ranging from 0 to 255, it is possible to display about 16,700,000 (=256×256×256) different colors.

The display device 10 is, for example, a color liquid crystal display device. The color liquid crystal display device may be a transmission type liquid crystal display device, which is widely used in personal computers, or the like, as well as a reflection type or rear projection type liquid crystal display device. However, the display device 10 is not limited to those color liquid crystal display devices. The display device 10 may be any color display apparatus including a plurality of pixels which are arranged along the X and Y directions (so-called "X-Y matrix display apparatus").

Moreover, the number of sub-pixels included in each pixel 12 is not limited to three. The pixel 12 may include one or more sub-pixels arranged in a predetermined direction. For example, when N color elements are used to represent a color, each pixel 12 may include N sub-pixels.

The order of arrangement of the sub-pixels 14R, 14G and 14B is not limited to that illustrated in FIG. 2. For example, the sub-pixels may be arranged in the order of B, G, and R along the X direction.

Moreover, the direction of arrangement of the sub-pixels 14R, 14G and 14B is not limited to that illustrated in FIG. 2 (X direction). The sub-pixels 14R, 14G and 14B may be arranged along the Y direction.

Furthermore, the group of color elements for use with the present invention is not limited to R (red), G (green), B (blue). Alternatively, the color elements may be C (cyan), Y (yellow), M (magenta), for example.

FIG. 3 shows a brightness table 392 which is an example of the brightness table 42*c* stored in the auxiliary storage apparatus 40.

The brightness table 392 is previously stored in the auxiliary storage apparatus 40, whereby the color element level of sub-pixels can be readily converted into a brightness level. In the brightness table 392, the eight color element levels (color element level 7 through color element level 0) are assigned over the range of brightness levels of 0 to 255 at substantially regular intervals.

The control section 20 of the character display apparatus 1 (FIG. 1) sets the color element level of a sub-pixel corresponding to a basic portion of a character to "7". On the other hand, the control section 20 sets the color element level of a sub-pixel located adjacent to a sub-pixel corresponding to the basic portion of the character to any of "1" through "6" based on a correction table 42*b*, and the color element level of a sub-pixel corresponding to the background of the character to "0".

The brightness table 392 is used when the display attribute of a character is a "normal display" (background is displayed in white, whereas a character is displayed in black). In the case of displaying a character having a display attribute of a "reversal display" (background is displayed in black, whereas a character is displayed in white), a brightness table for reversal display, which is obtained by simply modifying a brightness table for the "normal display" such that the defined order of brightness levels corresponding to color element levels "0" to "7" is inverted for each of the color elements R, G, and B. In this specification, the "display attribute" refers to a combination of a color of a background of a character and a color of the character. A character having any display attribute can be displayed by appropriately setting a brightness table.

In the example illustrated in FIG. 3, the color element level of a sub-pixel is represented through eight levels (level 7 through level 0), but the number of color element levels of a sub-pixel is not limited thereto.

The correspondence between the color element levels and the brightness levels is not limited to such a relation where a plurality of color element levels of a character (color element level 7 through color element level 0) are assigned over the range of brightness levels of 0 to 255 at substantially regular intervals. Correspondence between the color element levels and the brightness levels may be different among the respective color elements R, G, and B. For example, a correspondence between the color element levels and the brightness levels may be appropriately set for each of the color elements R, G, and B in consideration of characteristics of a display device.

FIG. 4 shows a correction table 390 as an example of the correction table 42*b* stored in the auxiliary storage apparatus 40. The correction table 390 defines a correction pattern. The correction pattern defined by the correction table 390 indicates that the color element levels of sub-pixels located adjacent to the left or right side (X or −X direction) of a sub-pixel corresponding to the basic portion of the character are set to "5", "2" and "1" in this order from the sub-pixel closest to the basic portion of the character to the farthest one from the basic portion of the character. Such a correction pattern is expressed in a list representation, "(5, 2, 1)", for illustration. The length of this list (in this example, "3") is referred to as the length of the correction pattern. The "sub-pixel located adjacent to (or in the vicinity of) a sub-pixel corresponding to a basic portion" is a sub-pixel which is located at a position distant from the basic portion sub-pixel along the X direction or −X direction, and whose distance value measured by the number of sub-pixels from the basic portion sub-pixel is equal to or smaller than the length of the correction pattern. The correction table 42*b* is not limited to the correction table 390 shown in FIG. 4. The length of the correction pattern is not limited to "3".

Thus, the correction pattern is used to set the color element level of at least one sub-pixel which is arranged in the vicinity of a sub-pixel corresponding to the basic portion of the character. The color element level of a sub-pixel is determined according to a distance between the sub-pixel and a sub-pixel corresponding to the basic portion of the character. For example, the color element level of a sub-pixel located adjacent to a sub-pixel corresponding to the basic portion of the character is set so as to decrease at a constant rate proportional with an increase of the distance from the basic portion sub-pixel.

Figure 5:
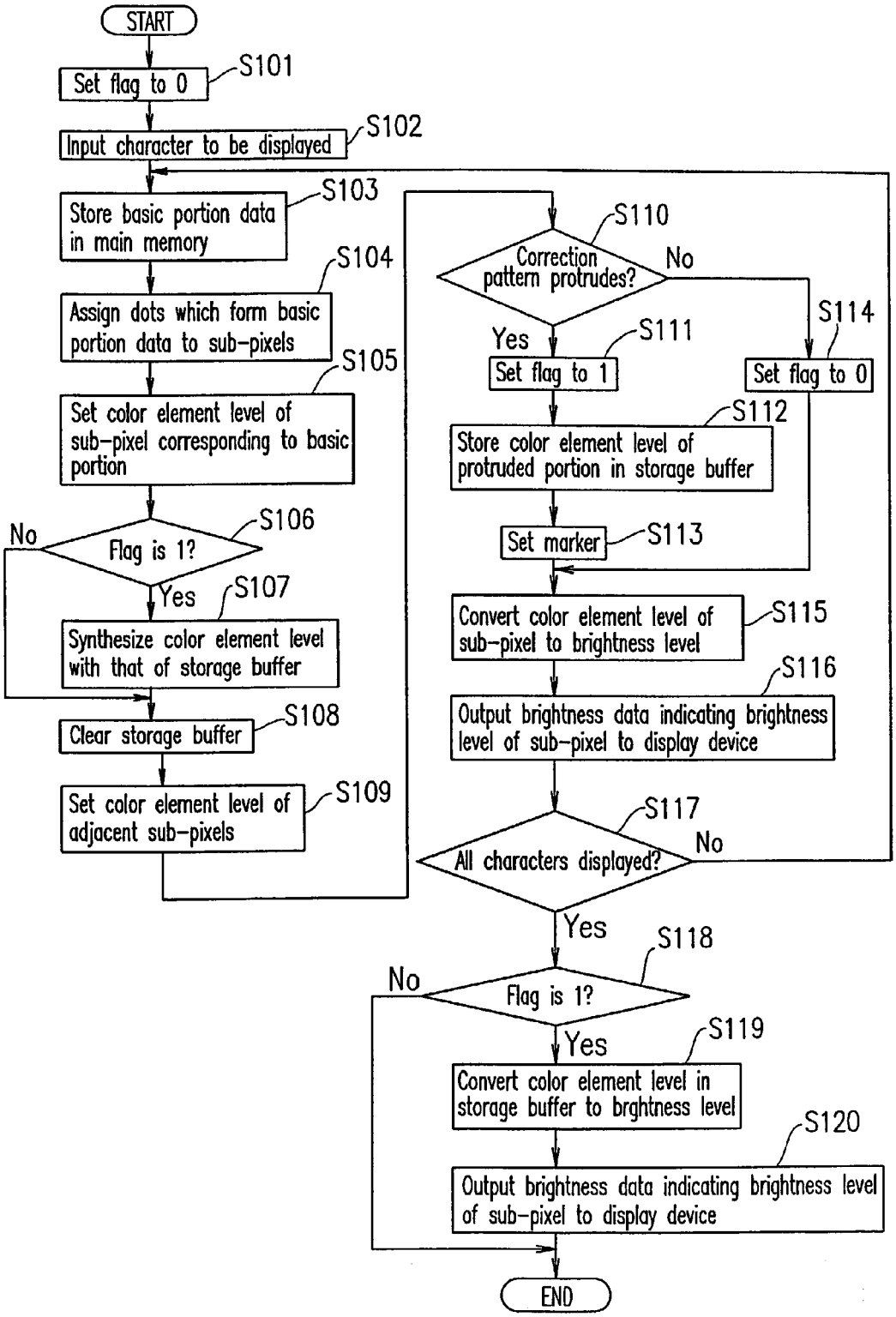
FIG. 5 is a flow chart which illustrates an execution of a character display process by a character display program 41.

FIG. 5 is a flowchart which illustrates an execution of a character display process by a character display program 41. The CPU 21 of the control section 20 executes the character display program 41, so that a character can be displayed with a high quality even when a correction pattern cannot be placed within a region on a display plane of the display device which corresponds to a frame of the character (i.e., even when a correction pattern protrudes from a region on a display plane of the display device which corresponds to a frame of the character).

In this specification, the descriptions of the present invention below will be made based on the following preconditions ① through ③ unless explicitly stated. It should be noted that such preconditions are made just for simplicity of explanation and are not intended to limit the present invention. Even in a case where preconditions ① through ③ are not satisfied, the effects of the present invention are still applicable in view of the principles of the present invention as readily appreciated by those skilled in the art:

①: In the case where a plurality of characters are displayed on the display device 10, the characters are sequentially arranged from the left side to the right side (in the X direction).

②: The plurality of characters are displayed on the display plane 400 such that regions on the display plane 400 which correspond to frames of respective characters are in contact with each other.

③: A portion of the correction pattern protrudes from the right side of the frame of a character.

Furthermore, in the descriptions below of this specification, the correction table 390 shown in FIG. 4 is used as the correction table 42*b* (FIG. 1) for explanation, and the brightness table 392 shown in FIG. 3 is used as the brightness table 42*c* for explanation, unless explicitly stated.

Hereinafter, steps of the character display process of the present invention are described.

Step S101: A flag is set to 0. This flag indicates whether a correction pattern can be placed within a region on the display plane 400 of the display device which corresponds to a frame of a character.

Step S102: At least one character to be displayed on the display plane 400 of the display device is input. This input operation is achieved by inputting a character code and a character size through the input device 30.

Step S103: Basic portion data for one character which corresponds to the input character code and character size is acquired and stored in the main memory 22. The basic portion data is a bit map which defines a basic portion of the character on a sub-pixel by sub-pixel basis. That is, each dot which forms the basic portion data corresponds to one sub-pixel.

In the case where the character size input at Step S102 prescribes that the number of pixels along each of the X and Y directions is 10, the number of sub-pixels along the X direction is 30, and the number of sub-pixels along the Y direction is 10. Since each of the dots which form the basic portion data corresponds to one sub-pixel, the basic portion data obtained at Step S102 has a size of 30 dots (X direction)×10 dots (Y direction). An area having this size is referred to as a "frame" of a character. The basic portion of the character is included within the frame.

The basic portion data is included in the character data 42*a*. The basic portion data is acquired by reading from the auxiliary storage apparatus 40.

Step S104: The dots which form the basic portion data are assigned to the sub-pixels of the display device 10. Each of the dots which form the basic portion data is assigned to one sub-pixel of the display device 10. This assignment process is performed in consideration of the position on the display device 10 at which a character is displayed. For example, in the case where a character is displayed at an upper left corner of the display device 10, a dot at an upper left corner of the basic portion data is assigned to a sub-pixel at an upper left corner of the display device 10. A frame which demarcates the basic portion data is assigned to a region on the display plane 400.

Step S105: The color element level of a sub-pixel corresponding to the basic portion of the character is set to a predetermined color element level. The predetermined color element level is, for example, color element level "7". The sub-pixel corresponding to the basic portion of the character is included within a region corresponding to the frame of the character.

Step S106: It is determined whether or not the value of the flag is "1". If a result of the determination at Step S106 is "Yes", the process proceeds to Step S107. If a result of the determination at Step S106 is "No", the process proceeds to Step S108.

Step S107: The color element level of a sub-pixel included in a region corresponding to the frame is synthesized with the color element level stored in a storage buffer. This synthesis operation will be described later with reference to FIG. 12. Based on a result of the synthesis operation, the color element level of the sub-pixel included within the region corresponding to the frame is set.

Step S108: The contents stored in the storage buffer is cleared.

Step S109: The color element level located adjacent to the sub-pixel corresponding to the basic portion of the character is set. That is, a correction pattern is placed. This processing is performed according to the correction table 42*b* included in the data 42.

Among the sub-pixels included in the region corresponding to the frame of the character, a sub-pixel whose color element level is not set at either of Step S105, Step S107, or Step S109 is considered as a sub-pixel corresponding to the background of the character. The color element level of such a sub-pixel is set to "0", for example.

Step S110: It is determined whether or not the correction pattern protrudes from the region corresponding to the frame in the process of Step S109. If a result of the determination at Step S110 is "Yes", the process proceeds to Step S111. If a result of the determination at Step S110 is "No", the process proceeds to Step S114.

Step S111: The value of the flag is set to 1.

Step S112: The color element level of a portion of the correction pattern, which protrudes from the region corresponding to the frame in the process of Step S109, is stored in the storage buffer. This stored data (color element level) is to be used at Step S107 for displaying a next character on the display device 10. The storage buffer is provided in, for example, the main memory 22.

Step S113: A marker is set. The meaning of the marker and a method for setting the marker will be described later with reference to FIG. 15.

Step S114: The value of the flag is set to 0.

Step S115: The color element levels of the sub-pixels are converted to brightness levels. This conversion processing is performed for each of the sub-pixels included in the region corresponding to the frame of the character while referring to the brightness table 42*c* included in the data 42.

Step S116: Brightness data which indicates the brightness level of the sub-pixel is transferred to the display device 10. With the brightness data, the brightness level over the display plane 400 of the display device 10 is controlled on a sub-pixel by sub-pixel basis.

Step S117: It is determined whether or not the processes of Steps S103 through S116 have been performed for all of the characters input at Step S102. If a result of the determination at Step S117 is "Yes", the process proceeds to Step S118. If a result of the determination at Step S117 is "No", the processes of Step S103 and the steps subsequent thereto are performed on the next character.

Step S118: It is determined whether or not the value of the flag is "1". If a result of the determination at Step S118 is "Yes", the process proceeds to Step S119. If a result of the determination at Step S118 is "No", the process terminates.

Step S119: The color element level stored in the storage buffer is converted to a brightness level. This conversion operation is performed for each of the sub-pixels included in the region corresponding to the frame of the character while referring to the brightness table 42*c* included in the data 42.

Step S120: Brightness data which indicates the brightness level of a sub-pixel which corresponds to the color element level of the sub-pixel in the storage buffer is transferred to the display device 10. With the brightness data, the brightness level of the display device 10 is controlled on a sub-pixel by sub-pixel basis.

Hereinafter, the character display processing of the present invention is described with reference to FIGS. 6 through 16 while considering an example where a character sequence "HA" is displayed on the display plane 400 of the display device 10.

Figure 6:
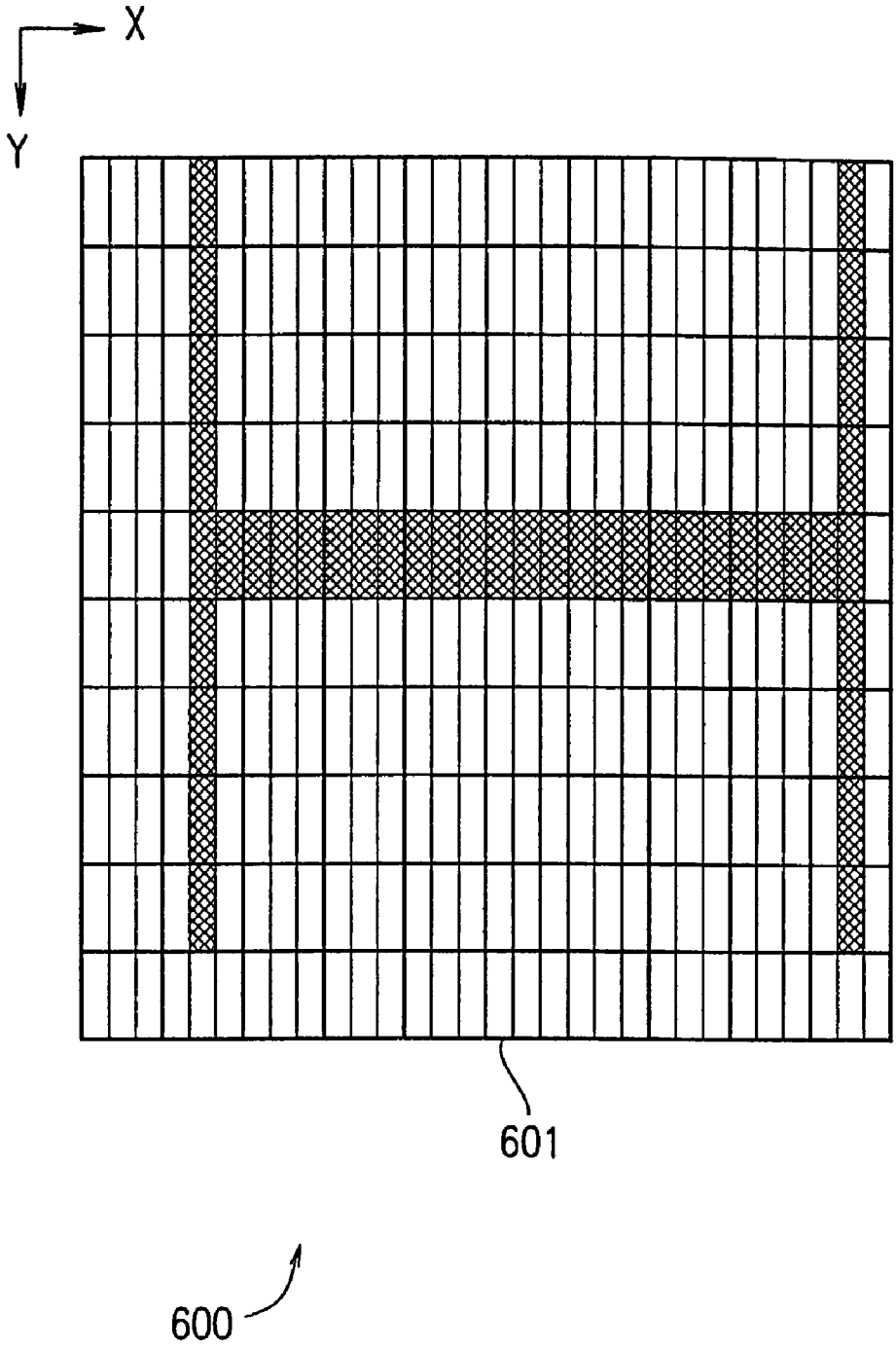
FIG. 6 shows basic portion data 600 which defines a basic portion of a character "H", which is the first character of a character sequence "HA", on a sub-pixel by sub-pixel basis.

FIG. 6 shows basic portion data 600 which defines a basic portion of a character "H", which is the first character of the character sequence "HA", on a sub-pixel by sub-pixel basis. In FIG. 6, each hatched box represents a dot which is included in the basic portion of the character "H", and each open box represents a dot which is not included in the basic portion of the character "H". The basic portion data 600 has a size (predetermined size) of 30 dots (X direction)×10 dots (Y direction). The basic portion of the character "H" is defined within a prescribed frame 601 having the predetermined size. That is, the basic portion of the character "H" is included within a prescribed frame 601.

The basic portion data 600 is read from the auxiliary storage apparatus 40 and stored in the main memory 22 at Step S103 shown in FIG. 5.

Figure 7:
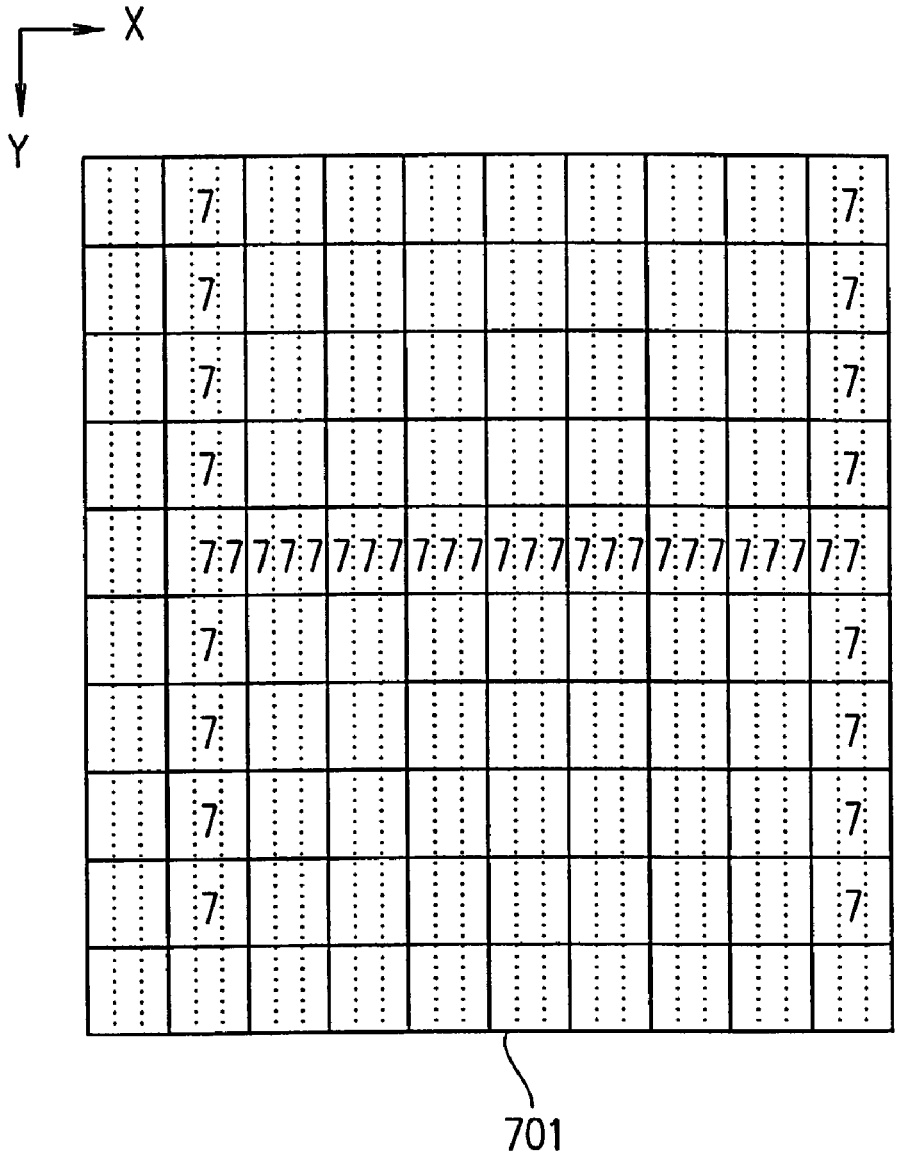
FIG. 7 shows an example where the color element levels of sub-pixels corresponding to the basic portion of the character "H" are set to a predetermined value (color element level "7").

FIG. 7 shows an example where the color element levels of sub-pixels corresponding to the basic portion of the character "H" are set to a predetermined value (color element level "7"). This setting process is performed at Step S105 of FIG. 5. However, in the process of Step S105, the color element levels of the sub-pixels included in the display plane 400 are not actually set. This setting process is performed in the main memory 22 in a virtual manner. Thus, a region 701 shown in FIG. 7 is a space in the main memory 22 which corresponds to the frame 601 of the character "H". Each box shown in FIG. 7 corresponds to one sub-pixel on the display plane 400. The region 701, which is a space in the main memory, corresponds to a specific region on the display plane 400 (a first region which corresponds to a frame of the character "H" (first character)).

Figure 8:
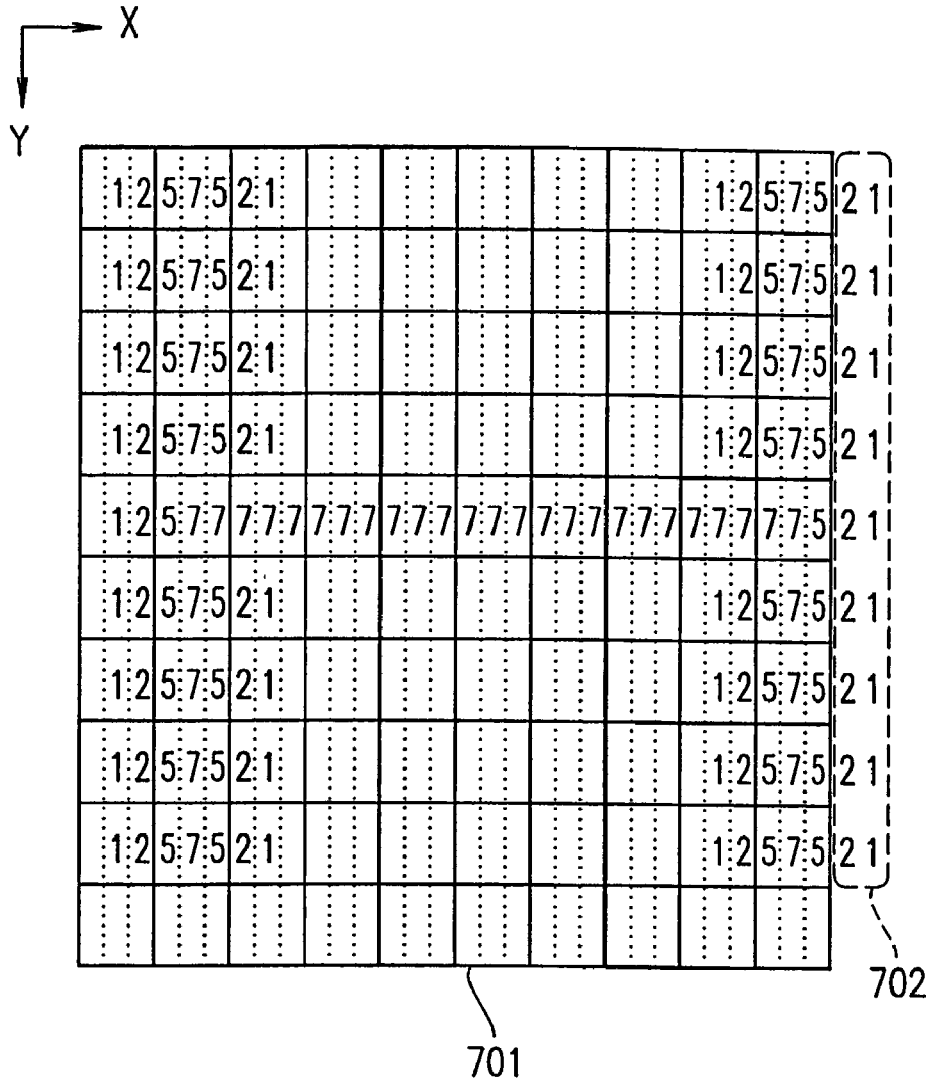
FIG. 8 shows an example where the color element levels of sub-pixels located in the vicinity of the sub-pixels corresponding to the basic portion of the character "H" are set to values different from a predetermined value (any of color element levels "5", "2", and "1").

FIG. 8 shows an example where the color element levels of sub-pixels located in the vicinity of the sub-pixels corresponding to the basic portion of the character "H" are set to values different from the predetermined value (any of color element levels "5", "2", and "1"). This setting process is performed at Step S109 of FIG. 5. However, in the process of Step S109, the color element levels of the sub-pixels included in the display plane 400 are not actually set. This setting process is performed, at Step S109 of FIG. 5, in the main memory 22 in a virtual manner according to a correction pattern. The correction pattern is a pattern for setting the color element levels of sub-pixels located in the vicinity of the sub-pixels corresponding to the basic portion to values different from the predetermined value (to any of color element levels "5", "2", and "1"). A sub-pixel corresponding to an open box which does not contain a numeric number is considered to be a sub-pixel corresponding to the background of the character. The color element level of such a sub-pixel is set to "0".

As seen from FIG. 8, a portion of the correction pattern protrudes from the region 701, which is a space in the main memory 22. That is, in the correction pattern (5, 2, 1), a portion of (2, 1) is present outside of the region 701 (portion 702). The region 701 corresponds to a first region on the display plane 400 which corresponds to the frame of the character "H". Thus, the correction pattern (5, 2, 1) protrudes from the region corresponding to the frame of the character "H" on the display plane 400 (first region). Therefore, for this example illustrated in FIG. 8, a result of the determination at the step S110 of FIG. 5 is "Yes". The color element levels of sub-pixels included in a portion of the correction pattern which protrudes from the region corresponding to the frame are stored in a storage buffer 901 at Step S112 of FIG. 5.

Figure 9:
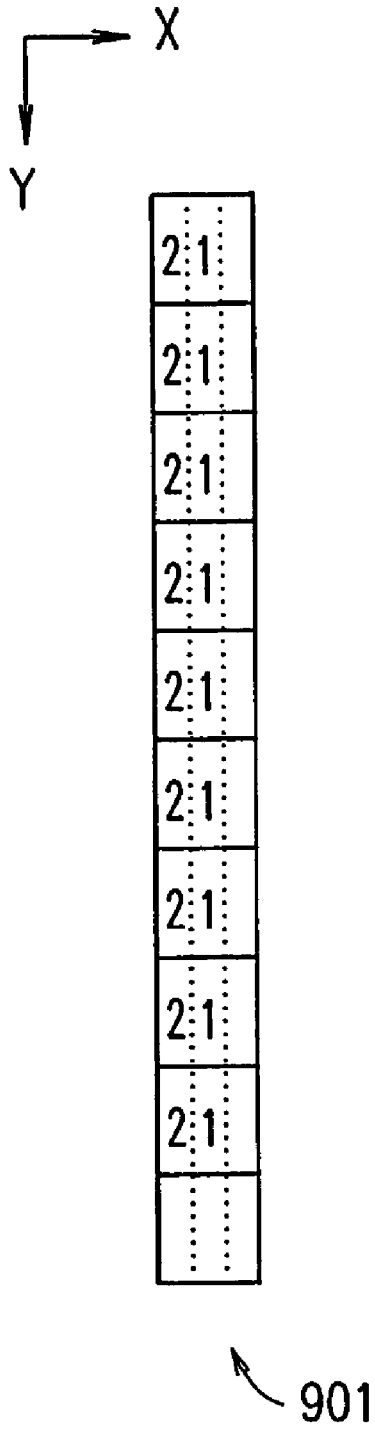
FIG. 9 shows an example where the color element levels of sub-pixels included in a portion of a correction pattern of character "H" which protrudes from a region corresponding to the frame of character "H" are stored in a storage buffer 901.

FIG. 9 shows an example where the color element levels of sub-pixels included in a portion of a correction pattern which protrudes from the region corresponding to the frame are stored in the storage buffer 901.

Each box shown in FIG. 9 corresponds to one sub-pixel of the display device 10. Numeric numbers shown in the box, "2" or "1", represent the color element level set for that sub-pixel. A box having no numeric number corresponds to a sub-pixel whose color element level is set to "0".

In the example illustrated in FIG. 9, the storage buffer 901 corresponds to a region on the display plane 400 which has a size of 3 sub-pixels (X direction)×10 sub-pixels (Y direction). The size of the storage buffer 901 along the X direction is set according to the length of the correction pattern. The size of the storage buffer 901 along the Y direction is set according to the size of the basic portion data.

Figure 10:
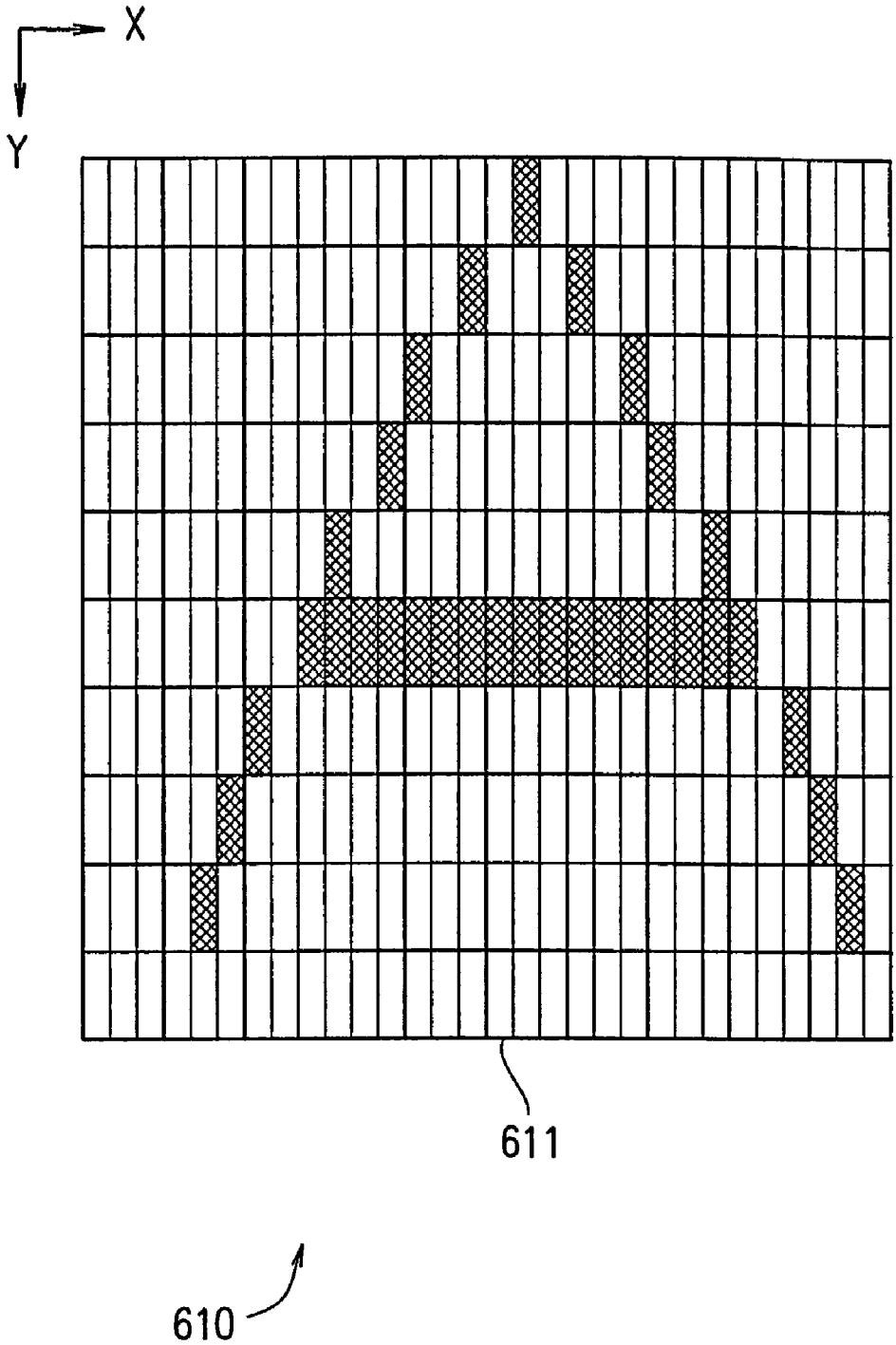
FIG. 10 shows basic portion data 610 which defines a basic portion of a character "A", which is the second character of the character sequence "HA", on a sub-pixel by sub-pixel basis.

FIG. 10 shows basic portion data 610 which defines a basic portion of a character "A", which is the second character of the character sequence "HA", on a sub-pixel by sub-pixel basis. In FIG. 10, each hatched box represents a dot which is included in the basic portion of the character "A", and each open box represents a dot which is not included in the basic portion of the character "A". The basic portion data 610 has a size (predetermined size) of 30 dots (X direction)×10 dots (Y direction). The basic portion of the character "A" is demarcated within a prescribed frame 611 having the predetermined size. That is, the basic portion of the character "A" is included within a prescribed frame 611.

The basic portion data 610 is read from the auxiliary storage apparatus 40 and stored in the main memory 22 at Step S103 shown in FIG. 5.

Figure 11:
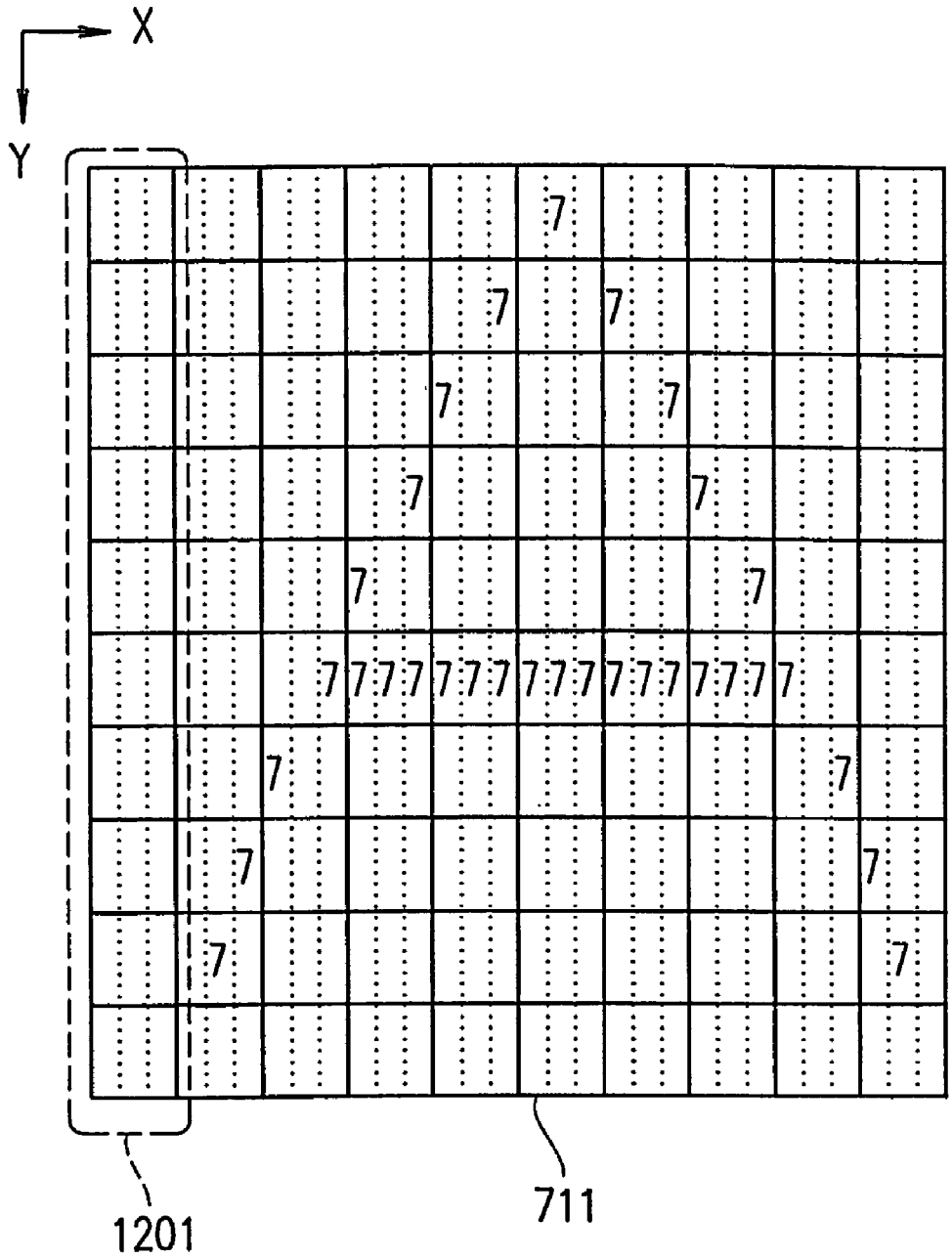
FIG. 11 shows an example where the color element levels of sub-pixels corresponding to the basic portion of the character "A" are set to a predetermined value (color element level "7").

FIG. 11 shows an example where the color element levels of sub-pixels corresponding to the basic portion of the character "A" are set to a predetermined value (color element level "7"). This setting process is performed in the main memory 22 in a virtual manner at Step S105 of FIG. 5. A region 711 shown in FIG. 11, which is a space in the main memory 22, corresponds to a region on the display plane 400 (a second region which corresponds to a frame of the character "A" (second character)).

Figure 12:
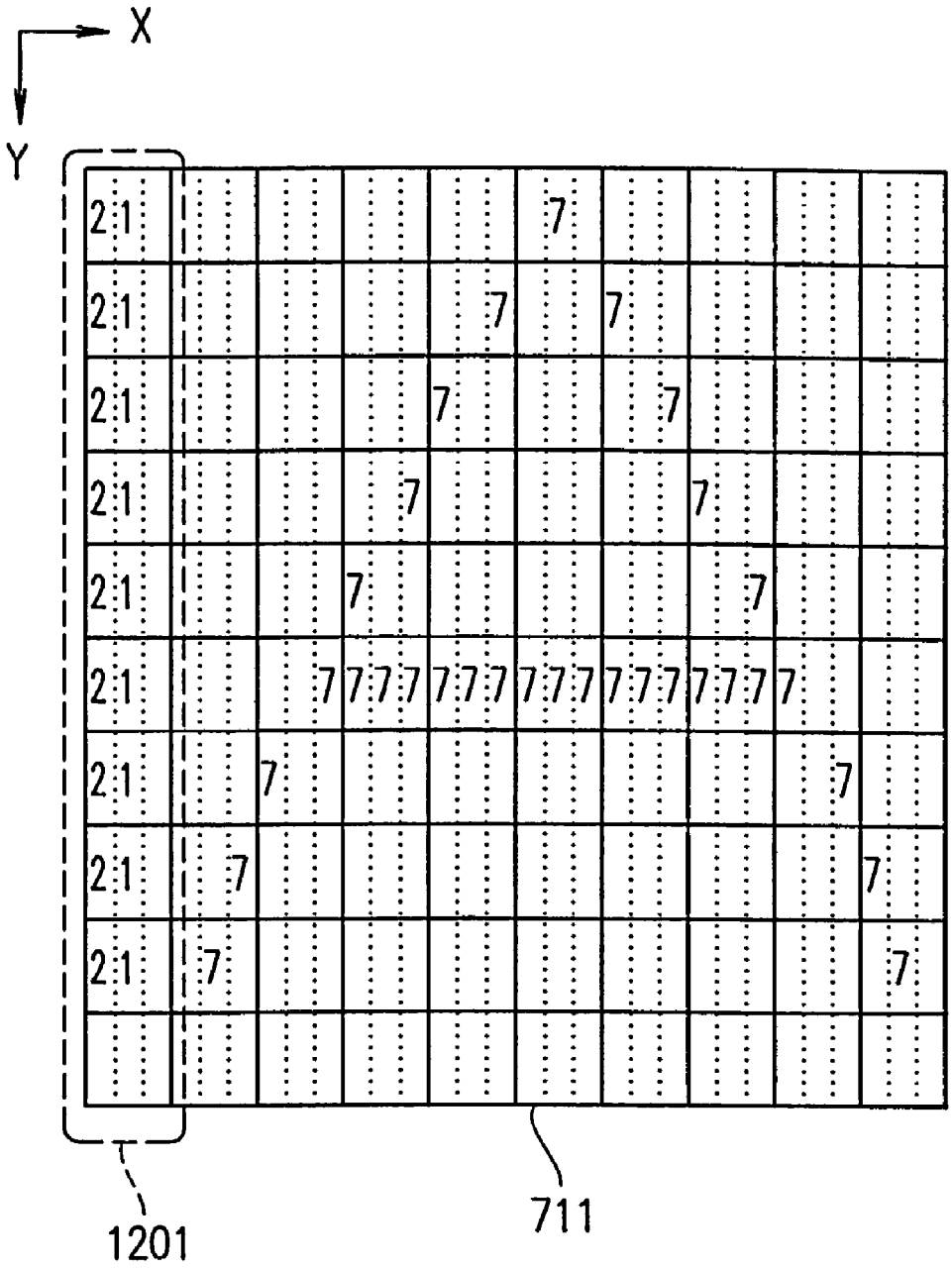
FIG. 12 shows an example where the color element levels of sub-pixels included in a region corresponding to the frame of the character "A" are synthesized with the color element levels stored in the storage buffer 901 (FIG. 9).

FIG. 12 shows an example where the color element levels of the sub-pixels included in the region corresponding to the frame of the character "A" are synthesized with the color element levels stored in the storage buffer 901 (FIG. 9). This synthesizing process is performed in the main memory 22 in a virtual manner at Step S107 of FIG. 5.

The example illustrated herein satisfies the above-described preconditions ② and ③. That is, the correction pattern for the first character "H" protrudes into a region on the display plane 400 which corresponds to the frame of the second character "A" (this region is also a region on the display plane 400 which corresponds to the region 711 in the main memory 22). Thus, the storage buffer 901 shown in FIG. 9 overlaps a left-side portion of the region 711 (portion 1201 in FIG. 11). The color element level shown in each box included in the portion 1201 (FIG. 11) and the color element level shown in a corresponding box included in the storage buffer 901 (FIG. 9) are compared, and the higher color element level value is set as a color element level of a sub-pixel in the synthesized portion 1201 shown in FIG. 12. It should be noted that, in FIGS. 9 and 11, a box corresponding to a sub-pixel whose color element level is "0" is shown as an open box for clarity of illustration.

Figure 13:
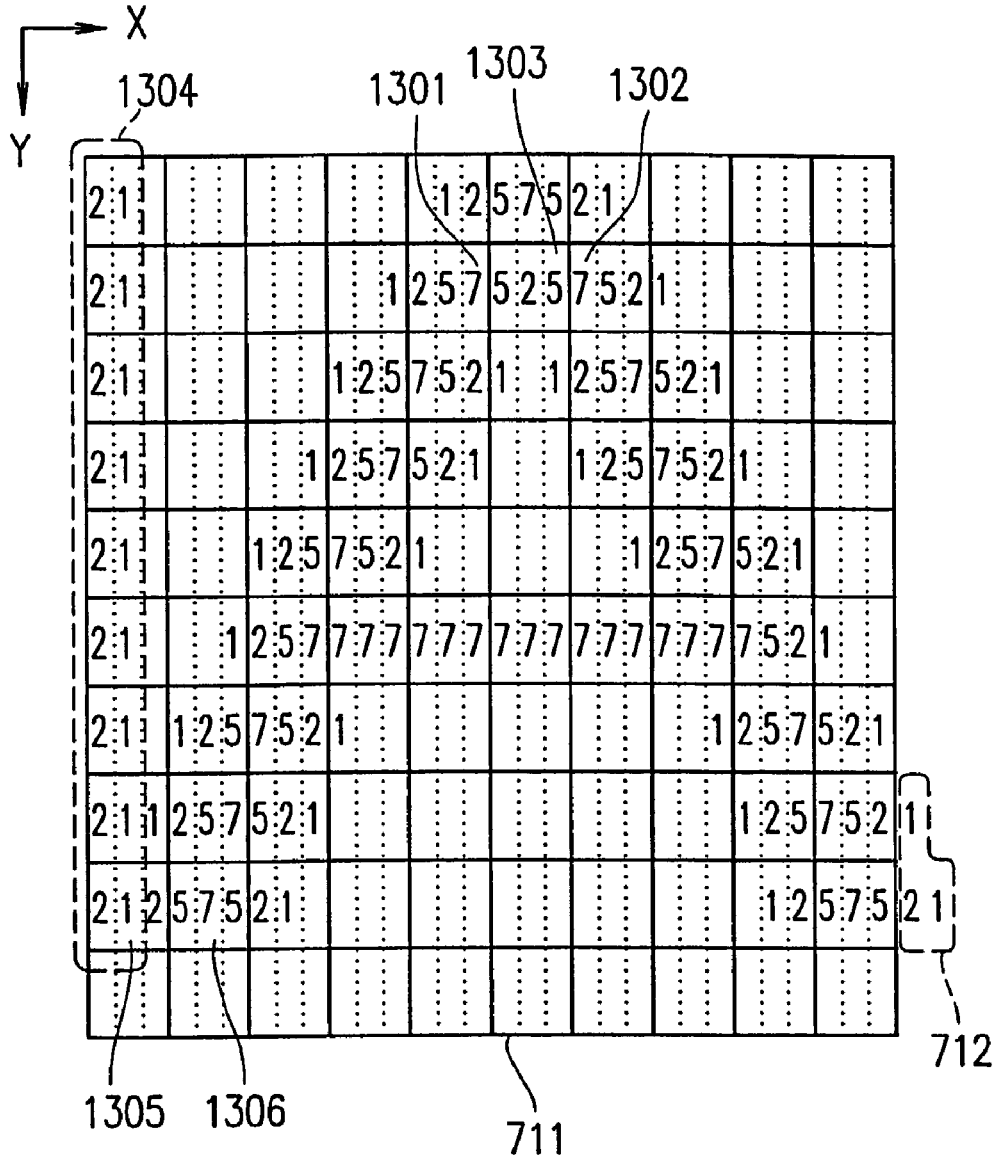
FIG. 13 shows an example where the color element levels of sub-pixels located in the vicinity of sub-pixels corresponding to the basic portion of the character "A" are set to values different from the predetermined value (any of color element levels "5", "2", and "1").

FIG. 13 shows an example where the color element levels of sub-pixels located in the vicinity of the sub-pixels corresponding to the basic portion of the character "A" are set to values different from the predetermined value (any of color element levels "5", "2", and "1"). This setting process is performed, at Step S109 of FIG. 5, in the main memory 22 in a virtual manner. A sub-pixel corresponding to an open box which does not contain a numeric number is considered as a sub-pixel corresponding to the background of the character. The color element level of such a sub-pixel is set to "0".

As already described, the color element level of a sub-pixel located in the vicinity of a sub-pixel corresponding to the basic portion of a character is set according to the correction table 42*b* based on a distance from a sub-pixel corresponding to the basic portion. The color element level of a sub-pixel located in the vicinity of two sub-pixels corresponding to the basic portion is set to the higher one of two color element levels; one is determined based on a distance from one of the two basic portion sub-pixels, and the other is determined based on a distance from the other one of the two basic portion sub-pixels. For example, a sub-pixel 1303 is a sub-pixel located in the vicinity of a sub-pixel 1301 corresponding to the basic portion of the character "A" and is also a sub-pixel located in the vicinity of a sub-pixel 1302 corresponding to the basic portion of the character "A". In this case, the color element level of the sub-pixel 1303 is set to the higher one of a color element level, which is determined based on a distance from the basic portion sub-pixel 1301 (3-sub-pixel distance), i.e., color element level "1", and a color element level, which is determined based on a distance from the basic portion sub-pixel 1302 (1-sub-pixel distance), i.e., color element level "5". That is, the color element level of the sub-pixel 1303 is set to the higher color element level "5".

In FIG. 13, sub-pixels included in the region 1304 are sub-pixels located in the vicinity of sub-pixels corresponding to the basic portion of a character "H". Some of these sub-pixels can be sub-pixels located in the vicinity of sub-pixels corresponding to the basic portion of a character "A". For example, a sub-pixel 1305 is a sub-pixel located in the vicinity of a sub-pixel 1306 corresponding to the basic portion of the character "A". Thus, the color element level of a sub-pixel included in the region 1304 is set to the higher one of a color element level, which is determined based on a distance from a sub-pixel corresponding to the basic portion of the character "H", and a color element level, which is determined based on a distance from a sub-pixel corresponding to the basic portion of the character "A".

In FIG. 13, it can be seen that a portion of the correction pattern (portion 712) is protruded from the region 711, which is a space in the main memory 22. The region 711 corresponds to the second region on the display plane 400 which corresponds to the frame of the character "A". Thus, it is appreciated that the correction pattern (5, 2, 1) protrudes from the region on the display plane 400 which corresponds to the frame of the character "A" (second region). Therefore, in this example, a result of the determination at the step S110 of FIG. 5 is "Yes". The color element levels of sub-pixels included in a portion of the correction pattern which protrudes from the region corresponding to the frame are stored in a storage buffer 901 at Step S112 of FIG. 5.

Figure 14:
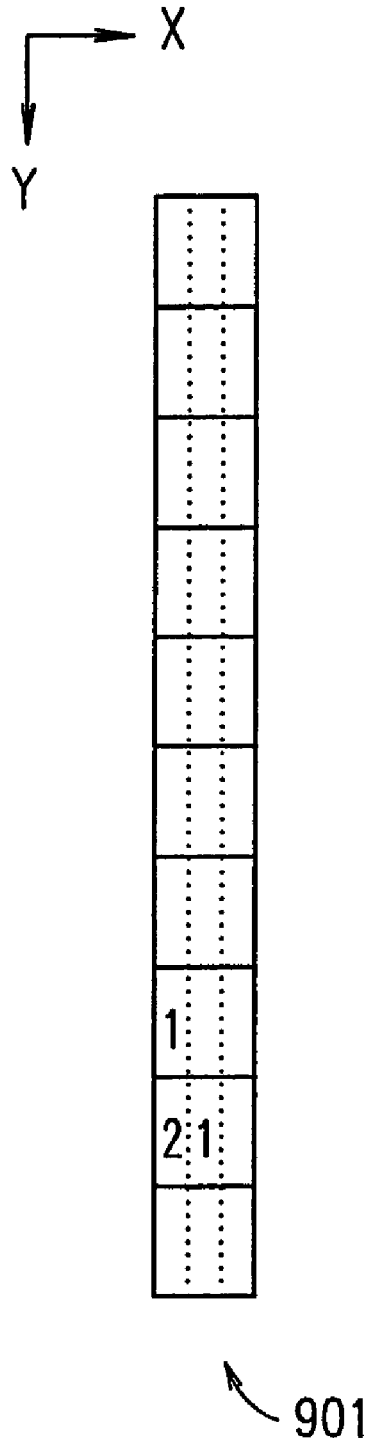
FIG. 14 shows an example where the color element levels of sub-pixels included in a portion of a correction pattern of character "A" which protrudes from the region corresponding to the frame of character "A" are stored in the storage buffer 901.

FIG. 14 shows an example where the color element levels of sub-pixels included in a portion of a correction pattern which protrudes from the region corresponding to the frame are stored in the storage buffer 901. The description for FIG. 14 is substantially the same as that made for FIG. 9 and therefore herein omitted.

Figure 15:
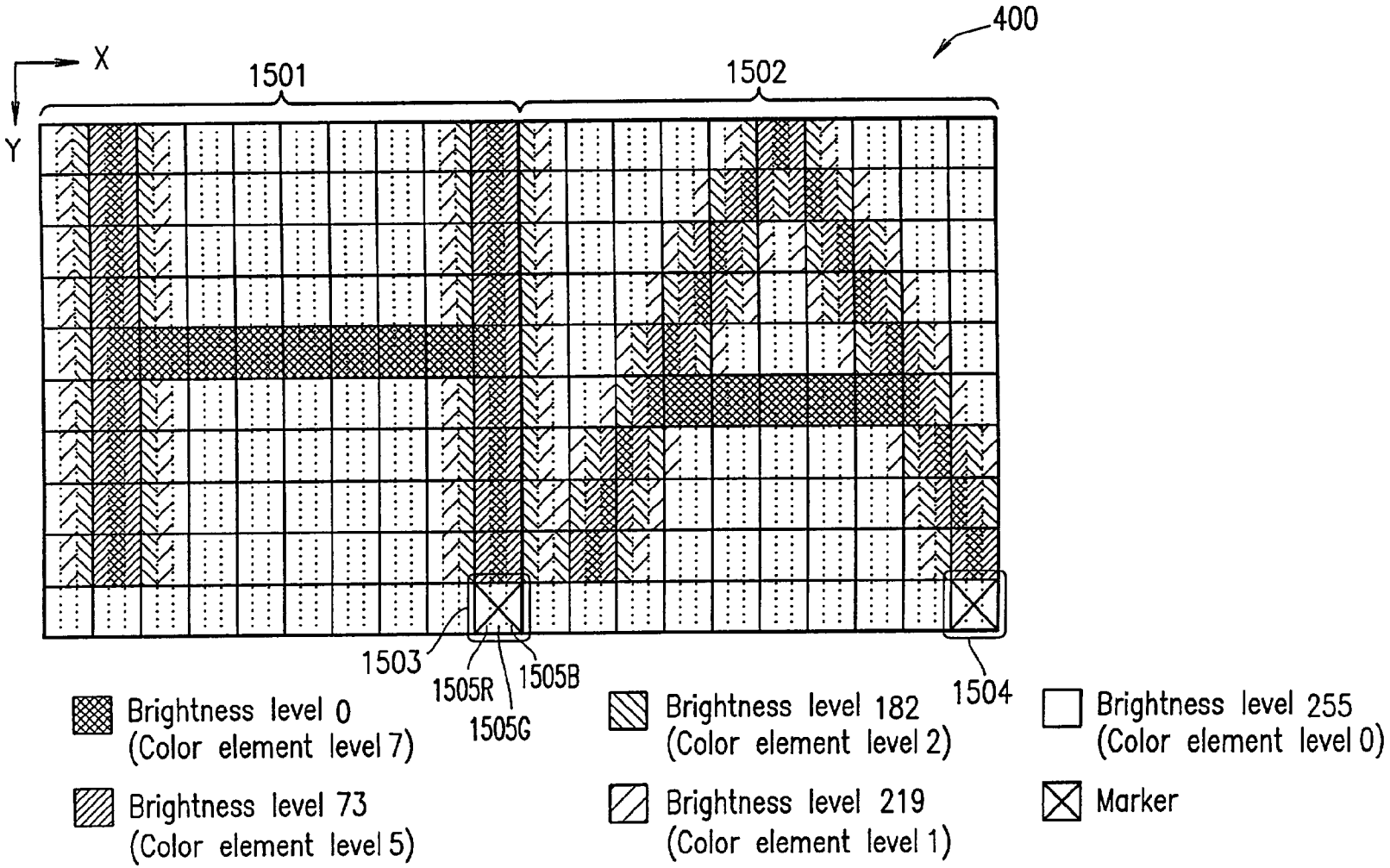
FIG. 15 shows a display plane 400 at a time after the processes of steps S103 through S116 of FIG. 5 have been performed on each of the characters "H" and "A".

FIG. 15 shows the display plane 400 at a time after the processes of steps S103 through S116 of FIG. 5 have been performed on each of the characters "H" and "A". FIG. 15 shows regions on the display plane 400, a region 1501 corresponding to the frame 601 of the character "H" (FIG. 6) and a region 1502 corresponding to the frame 611 of the character "A" (FIG. 10). In FIG. 15, markers are provided at positions of a pixel 1503 included in the region 1501 and a pixel 1504 included in the region 1502. This means that the markers are set in the region 1501 and the region 1502. These markers indicate that the correction patterns are protruded from the region 1501 and the region 1502. The markers are set at Step S113 of FIG. 5. The reason why such markers are set is that, in an overwrite process of overwriting a character over that region, a procedure for overwriting the character differs according to whether or not the correction pattern protrudes from that region. The details of the overwrite process are described later in embodiment 2 with reference to FIG. 27.

The pixel 1503 includes three sub-pixels (sub-pixels 1505R, 1505G, and 1505B). When the color of the background of a character is white, the brightness level of the sub-pixels corresponding to the background of the character is set to 255. In this case, setting a marker at a position of the pixel 1503 is achieved by, for example, setting the brightness levels of the sub-pixels 1505R, 1505G, and 1505B included in the pixel 1503 are set to 255 (0xff), 255 (0xff),and 254 (0xfe), respectively. Setting the brightness levels of the three sub-pixels included in the pixel 1503 to such values is abbreviatedly referred to as "the color of the pixel 1503 is set to 0xffffffe (a value that indicates a marker)". Setting a marker in the pixel 1504 is performed in a similar manner to setting of the marker in the pixel 1503.

The pixel 1503 in which the marker is set looks substantially white to a human eye. Thus, the marker is almost unperceivable to a human eye. Even when a background color is a color different from white (0xffffff), a value of the marker is selected such that a pixel having the background color and a pixel in which the marker is set cannot be distinguished by a human eye.

In the example illustrated in FIG. 15, the marker is set at a position of a pixel. However, the marker may be set at a position of a sub-pixel. In the example of FIG. 15, sub-pixels of the lowermost row in the region 1501 are not defined as a basic portion of the character. Because these sub-pixels are utilized as blank spaces for securing a vertical spacing between lines. Thus, the sub-pixels of the lowermost row in the region 1501 correspond to the background of the character. In the case where a correction pattern protrudes from the region 1501, the brightness level (intensity of color element) of at least one of the sub-pixels included in the lowermost row, which is present at a predetermined position in the lowermost row, is set to a predetermined value regardless of the type of a character whose basic portion is displayed in the region 1501, whereby a marker which indicates that a correction pattern protrudes from the region 1501 is set in the position of the at least one sub-pixel. The position of a pixel or sub-pixel in which a marker is set is not limited to the lower right corner of the region 1501. For example, the marker may be set in the position at the lower left corner of the region 1501. Alternatively, the marker may be set at an intermediate position in the lowermost row of the region 1501.

Figure 16:
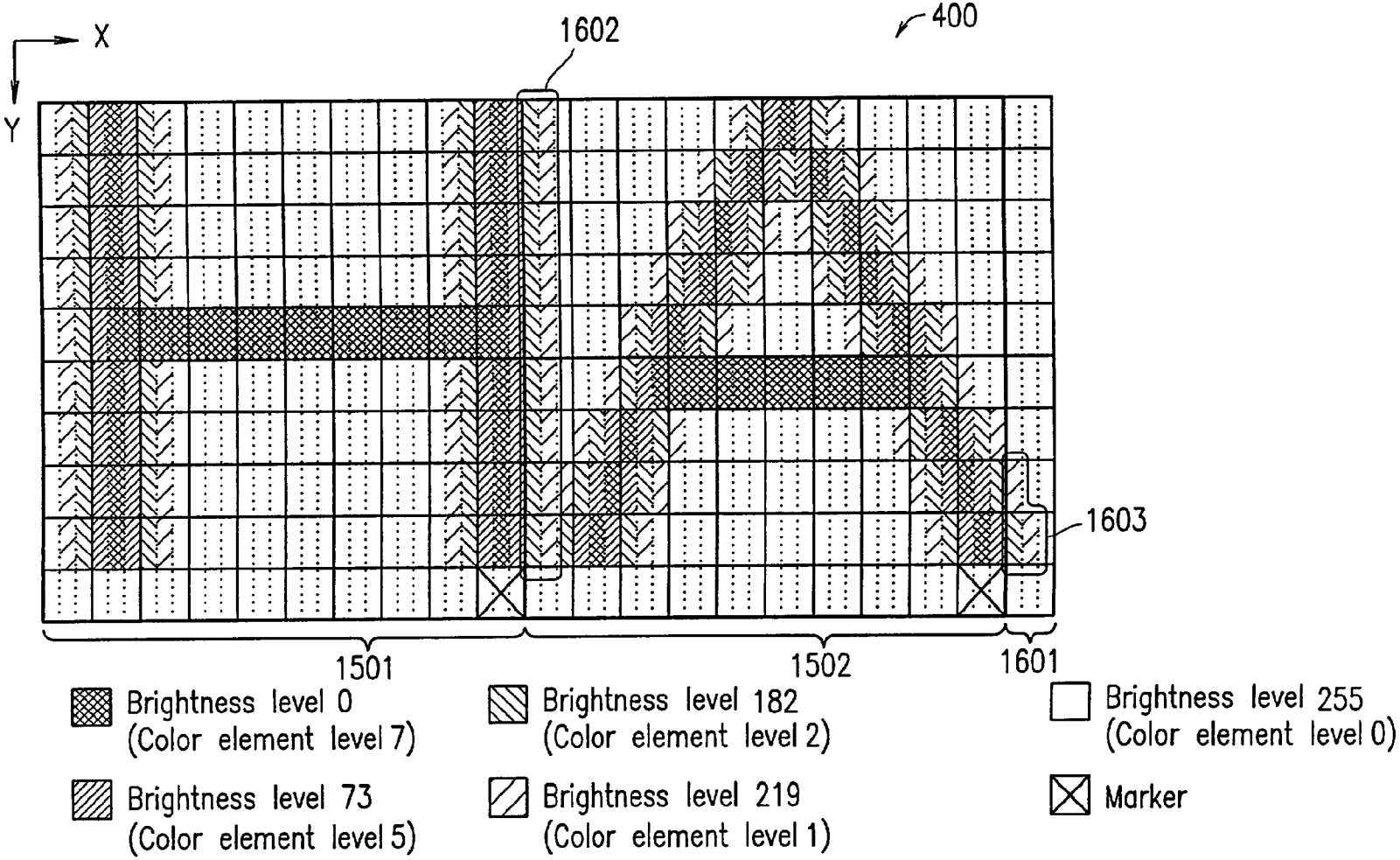
FIG. 16 shows the display plane 400 at a time after the processes of FIG. 5 have been performed on the character sequence "HA".

FIG. 16 shows the display plane 400 at a time after the processes of FIG. 5 have been performed on the character sequence "HA". In FIG. 16, each box represents a sub-pixel included in the display plane 400.

In the example illustrated in FIG. 16, a region 1601 is shown on the display plane 400 in addition to the region 1501 and the region 1502 shown in FIG. 15. The brightness levels of sub-pixels included in the region 1601 (sub-pixels whose color element levels are stored in the storage buffer) are set at Step S120 of FIG. 5.

Thus, the control section 20 of the character display apparatus 1 sets the color element level of at least one first sub-pixel corresponding to the basic portion of the first character "H" (sub-pixel included in the region 1501 and shown by a hatching indicating color element level 7) to a predetermined color element level (color element level 7). The control section 20 further sets the color element level of at least one first vicinal sub-pixel which is located in the vicinity of the first sub-pixel (sub-pixel included in the region 1501 and shown by a hatching indicating a color element level of 5, 2, or 1 and sub-pixels included in the region 1602) to a color element level different from the predetermined color element level (color element level 5, 2, or 1). In such a way, the display device 10 is controlled such that the character "H" is displayed on the display plane 400. Herein, the at least one first vicinal sub-pixel is a sub-pixel which is located in the vicinity of a sub-pixel corresponding to the basic portion of the character "H", and whose color element level is set according to the correction table, i.e., a sub-pixel on which a correction pattern is placed.

The basic portion of the character "H" is included in the first frame 601 (FIG. 6) having a predetermined size. At least one first sub-pixel corresponding to the basic portion of the character "H" (first character) is included in the region 1501 (first region) on the display plane 400 which correspond to the frame 601. At least one first vicinal sub-pixel (sub-pixel included in the region 1602) is outside of the region 1501.

Thus, even when a correction pattern cannot be placed such that the entire correction pattern is within the region 1501 which corresponds to the frame, a portion of the correction pattern which protrudes from the region 1501 is placed in a region (region 1602) which is outside of the region 1501 corresponding to the frame of the character "H". Thus, the character "H" can be displayed with a high quality.

The control section 20 of the character display apparatus 1 controls the display device 10 such that the second character "A" is displayed on the display plane 400 at a position adjacent to the character "H". The basic portion of the character "A" is included in the second frame 611 (FIG. 10) having a predetermined size. At least one second sub-pixel corresponding to the basic portion of the character "A" (second character) (sub-pixel included in the region 1502 and shown by a hatching indicating color element level 7) is included in the region 1502 on the display plane 400 which corresponds to the frame 611 (second region). Further, at least one of the first vicinal sub-pixels (sub-pixels included in the region 1602) is included in the region 1502.

In this way, a portion of the correction pattern which protrudes from the region 1501 is placed within a region of the character "A" which is adjacent to the character "H" (region 1502). It is preferable that placement of such a correction pattern be performed only when the characters "H" and "A" have identical display attributes. In order to determine whether or not the characters "H" and "A" have identical display attributes, an area for storing the display attribute of a character may be additionally provided in the storage buffer.

As apparent from the above descriptions made with reference to FIG. 13, the control section 20 of the character display apparatus 1 sets the color element level of a sub-pixel included in the region 1602 based on a color element level, which is determined according to a distance from a sub-pixel corresponding to the basic portion of the character "H", and a color element level, which is determined according to a distance from a sub-pixel corresponding to the basic portion of the character "A".

Herein, consider a case where only the character "H" and the character "A" are displayed on the display plane 400 of the display device 10, and the character "A" is considered as the first character. In this case, a sub-pixel located in the vicinity of a sub-pixel corresponding to the basic portion of the character "A" which is not included in the region 1502 (i.e., a sub-pixel included in the region 1603) is not included in either of the regions 1501 and 1502 on the display plane 400 which corresponds to the frames of the characters "H" and "A", respectively.

The processes performed at Steps S118 through S120 of FIG. 5 may be omitted. In this case, the character sequence "HA" is displayed on the display plane 400 as shown in FIG. 15. In the example illustrated in FIG. 15, setting of the color element level based on a correction pattern, which is performed in the example illustrated in FIG. 16, is not performed on the sub-pixels included in the region 1603. Thus, color noise occurs at a lower right portion of the character "A", and the thickness of the width of a line of the character does not appear to have a desired width at that portion. Such a phenomenon deteriorates the display quality of the character. However, such a phenomenon occurs only when a protrusion of a correction pattern occurs at the end of a line of characters, and a deterioration of the display quality also occurs in the last character in that line. Thus, such a deterioration of the display quality is not a significant deterioration.

In the above descriptions made with reference to FIG. 5, acquisition of basic portion data at Step S103 is performed by reading basic portion data prepared in the character data 42*a* from the auxiliary storage apparatus 40. However, the method for acquiring the basic portion data is not limited to this method. As a method for acquiring the basic portion data, for example, a method for generating basic portion data from bit map data which defines the shape of a character on a pixel-by-pixel basis (bit map defined by units of a pixel) may be employed, as well as reading from the auxiliary storage apparatus 40. Examples of the bit map defined by units of a pixel includes, for example, a conventionally-employed dot font.

Hereinafter, a method for generating basic portion data from a bit map defined by units of a pixel is described with reference to FIGS. 17 through 23.

Figure 17:
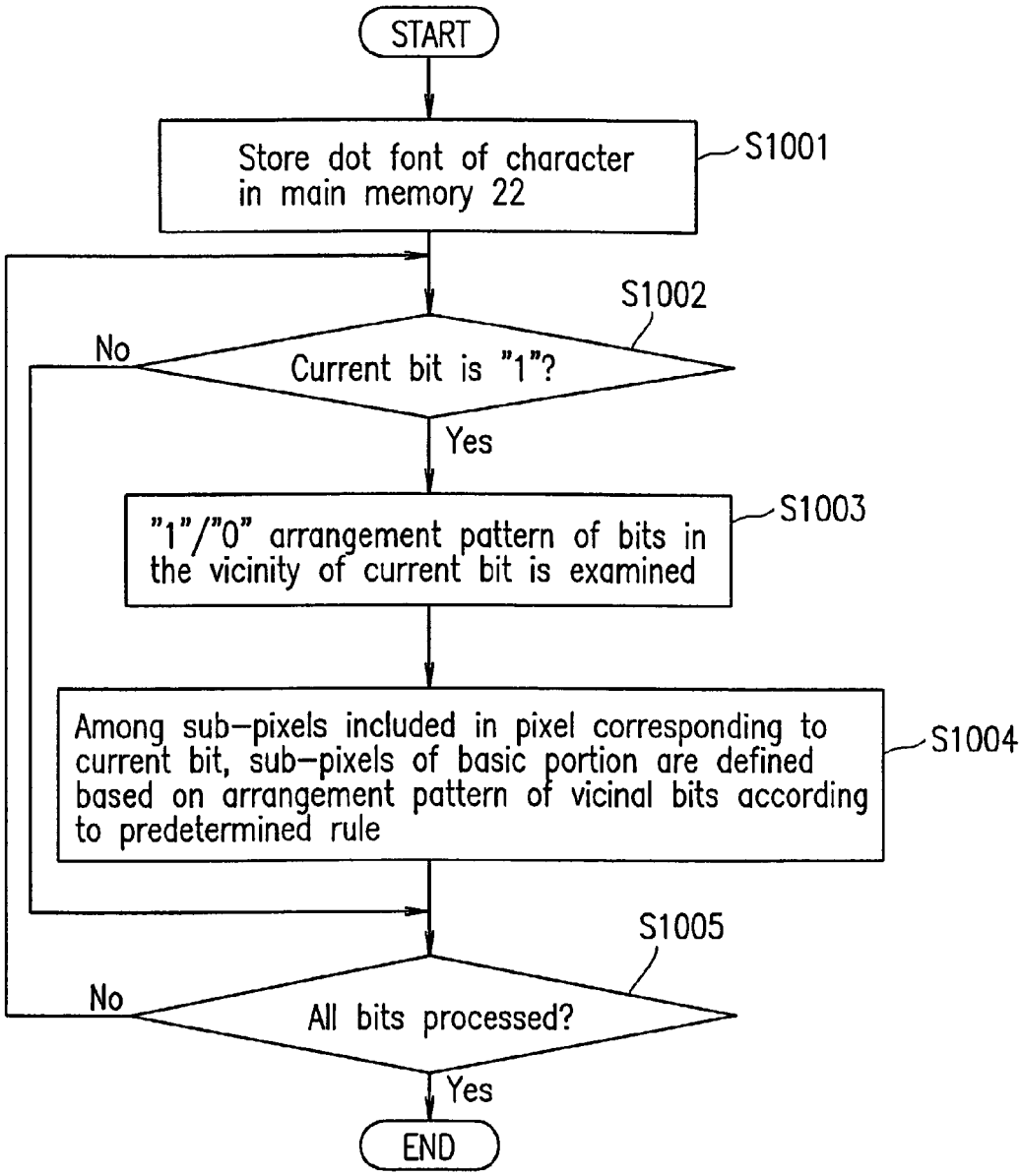
FIG. 17 is a flowchart which illustrates a procedure for generating basic portion data from a bit map defined by units of a pixel.

FIG. 17 illustrates a procedure of processing for generating basic portion data from a bit map defined by units of a pixel. This processing is executed by the CPU 21 during the processing at step S103 (FIG. 5). Each step in the procedure for generating basic portion data from a bit map defined by units of a pixel will now be described.

Step S1001: A bit map for one character defined by units of a pixel which corresponds to the character code and character size of the character input at step S102 (FIG. 5) is stored in the main memory 22. This bit map defined by units of a pixel is included in the character data 42*a* stored in the auxiliary storage apparatus 40.

Step S1002: It is determined whether or not each bit included in the bit map defined by units of a pixel is "1". If a result of the determination at Step S1002 is "Yes", the process proceeds to Step S1003. If a result of the determination at Step S1002 is "No", the process proceeds to Step S1005.

Step S1003: A "1"/"0" arrangement pattern of bits located in the vicinity of a current bit is examined.

Step S1004: Among sub-pixels included in the pixel corresponding to the current bit, a sub-pixel corresponding to a basic portion of the character is defined based on the "1"/"0" arrangement pattern of the bits located in the vicinity of the current bit. This determination of a sub-pixel corresponding to a basic portion is achieved according to a predetermined basic portion definition rule. This basic portion definition rule will be described later with reference to FIG. 20A, 20B, 21A, 21B, 22A, and 22B.

Step S1005: It is determined whether steps S1002–S1004 have been performed for all of the bits which form the bit map defined by units of a pixel. If a result of the determination at step S1005 is "No", the process returns to step S1002. If a result of the determination at step S1005 is "Yes", the process terminates.

Figure 18:
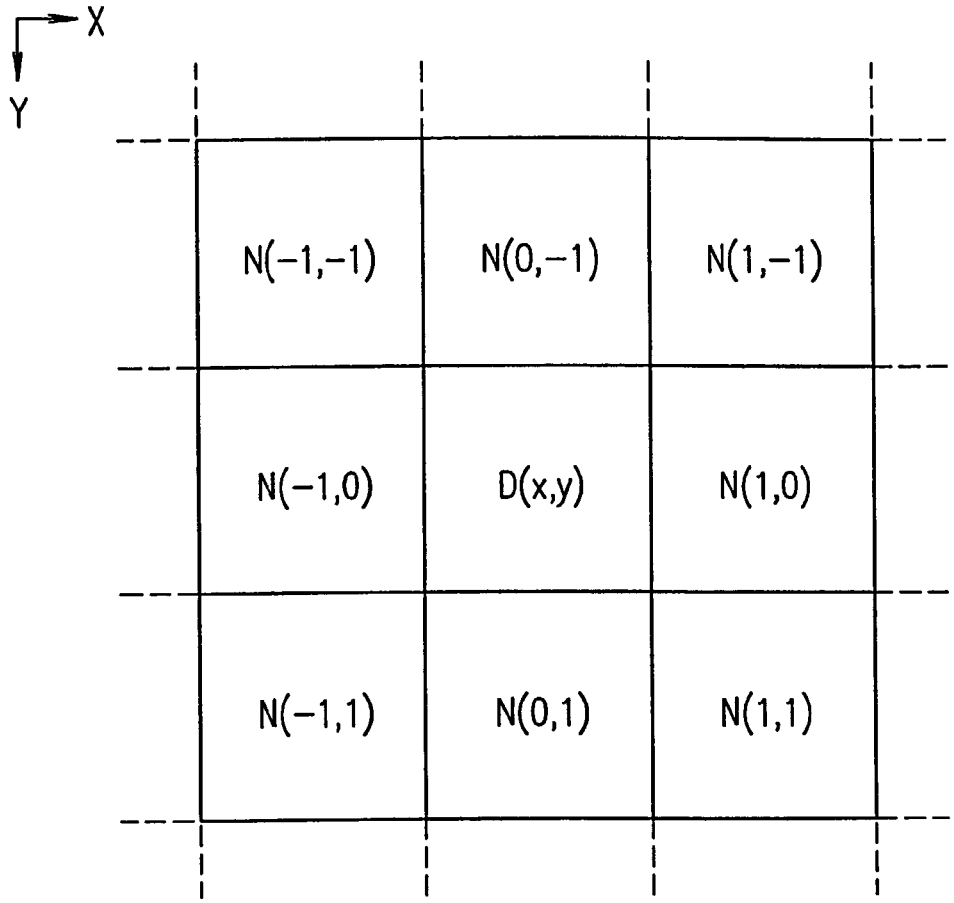
FIG. 18 shows a portion of a bit map defined by units of a pixel which represents a character.

FIG. 18 shows a portion of a bit map which represents a character. D(x,y) is a current bit. In this example, a bit in the vicinity of the current bit, D(x+a, y+b), is represented as N(a,b). FIG. 18 shows eight vicinal bits which are vertically, horizontally, or diagonally adjacent to the current bit D(x,y), i.e., N(−1,−1), N(0,−1), N(1,−1), N(−1,0), N(1,0), N(−1,1), N(0,1), and N(1,1). These eight vicinal bits are referred to as "eight neighborhoods". Each bit included in the bit map defined by units of a pixel has a value of "1" or "0". A bit having a value of "1" corresponds to a black area of the character. A bit having a value of "0" corresponds to a white area of the character. The bits N(a,b) and D(x,y) each have a value of "1" or "0".

Figure 19:
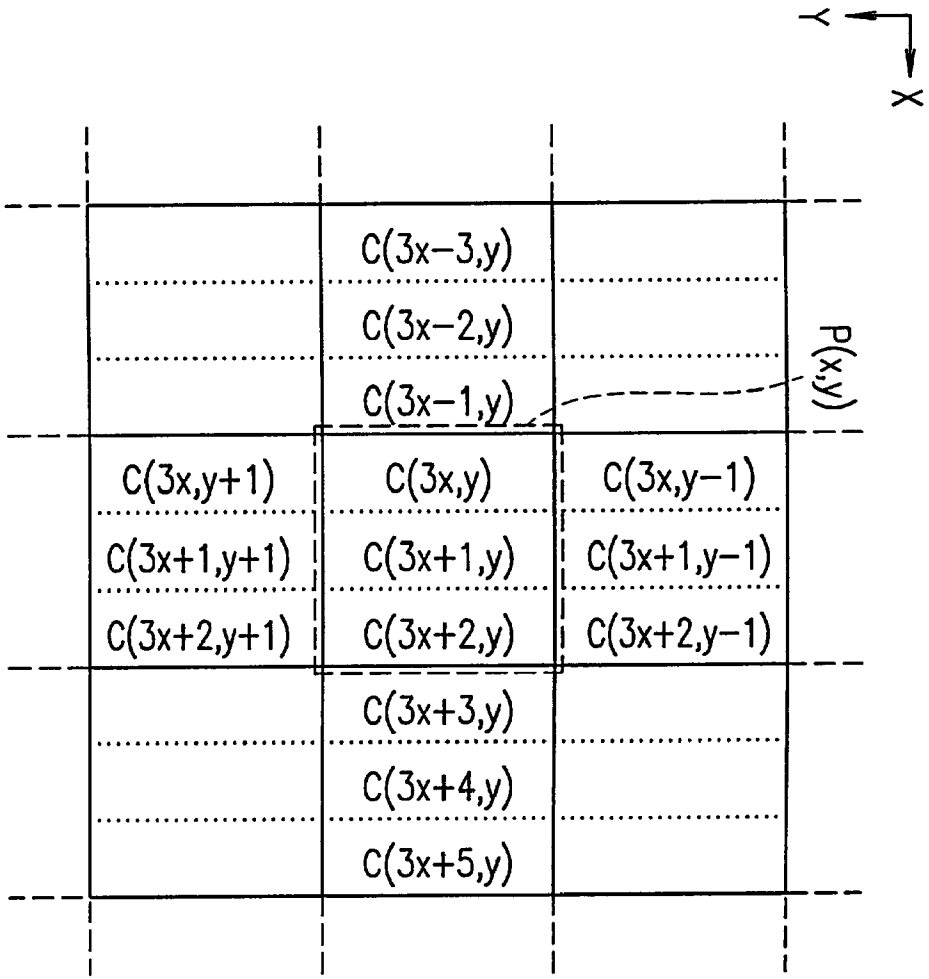
FIG. 19 shows a portion of the display plane 400 of the display device 10.

FIG. 19 shows a portion of the display plane 400 of the display device 10. P(x,y) is a pixel on the display plane. The bit D(x,y) of FIG. 18 is assigned to the pixel P(x,y). The pixel P(x,y) includes three sub-pixels, C(3x,y), C(3x+1,y), and C(3x+2,y). When the bit D(x,y) has a value of "1", among the three sub-pixels, C(3x,y), C(3x+1,y), and C(3x+2,y), a sub-pixel for the basic portion is defined according to the basic portion definition rule. When the bit D(x,y) has a value of "0", none of the three sub-pixels is defined as a sub-pixel for the basic portion.

According to the basic portion definition rule, whether or not each of the three sub-pixels included in the pixel P(x,y) is defined as a sub-pixel for the basic portion depends on the "0"/"1" arrangement of the bits N(a,b) in the vicinity of the bit D(x,y) corresponding to the pixel P(x,y). The basic portion definition rule is now described. In a description below, it is assumed that the bit D(x,y) has a value of "1".

Figure 20A:
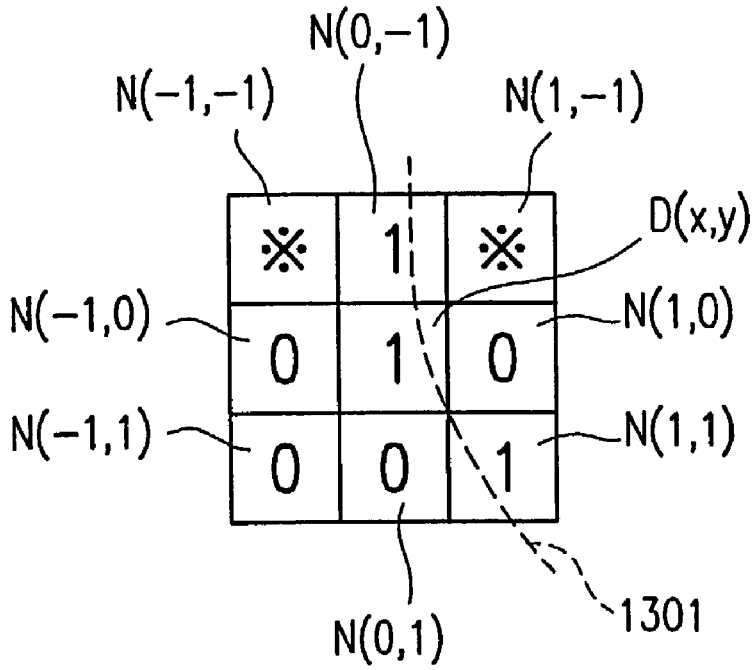
FIG. 20A shows an example of eight neighborhoods around a current bit D(x,y) in the bit map defined by units of a pixel.

FIG. 20A shows an example of eight neighborhoods around the current bit D(x,y) in the bit map defined by units of a pixel. In the following description, a bit N(a,b) which has a value of "1" is represented as "N(a,b)=1". For example, in FIG. 20A, N(0,−1)=N(1,1)=1, and N(1,0)=N(0,1)=N(−1,1)=N(−1,0)=0. In FIG. 20A, bits N(−1,−1) and N(1,−1) indicated by "X" each have any value of "0" and "1". Similarly in FIGS. 21A and 22A, a bit indicated by "X" has any value of "0" and "1". These bits are not considered in the basic portion definition rule.

Figure 20B:
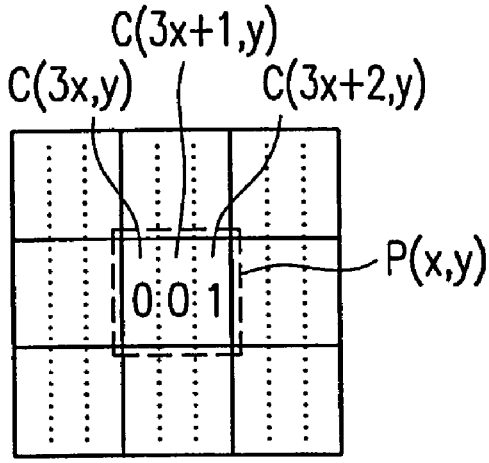
FIG. 20B shows sub-pixels defined as sub-pixels for the basic portion based on the basic portion definition rule when the eight neighborhood bits around the bit D(x,y) have values shown in FIG. 20A.

FIG. 20B shows sub-pixels defined as sub-pixels for the basic portion based on the basic portion definition rule when the eight neighborhood bits around the bit D(x,y) have values shown in FIG. 20A. A pixel P(x,y) on the display plane which corresponds to the bit D(x,y) includes three sub-pixels, C(3x,y), C(3x+1,y), and C(3x+2,y). Among these sub-pixels shown in FIG. 20B, a sub-pixel labeled with "1" is defined as a sub-pixel for the basic portion, and sub-pixels labeled with "0" are not defined as a sub-pixel for the basic portion. That is, the sub-pixel C(3x+2,y) is defined as a sub-pixel for the basic portion, and the sub-pixels C(3x,y) and C(3x+1,y) are not defined as a sub-pixel for the basic portion.

The basic portion definition rule described with reference to FIGS. 20A and 20B can be represented by using logical expressions.

In the following description, when logical values A and B are given, for example, "A*B" denotes a logical AND of the logical values A and B, "!A" denotes a logical NOT of the logical value A. When this rule is applied, in the case where the eight neighborhood bits around the bit D(x,y) have the values shown in FIG. 20A, logical expression (1) is satisfied:

$$N(0,-1)*!N(-1,0)*!N(1,0)*!N(-1,1)*!N(0,1)*N(1,1)=1 \quad (1)$$

Furthermore, the above process in which the sub-pixel C(3x+2,y) is defined as a sub-pixel for the basic portion and the sub-pixels C(3x,y) and C(3x+1,y) are not defined as a sub-pixel for the basic portion can be represented by expressions (2):

$$C(3x,y)=0,\ C(3x+1,y)=0,\ C(3x+2,y)=1 \quad (2)$$

The "basic portion" of a character refers to a portion corresponding to a core of the character. Now, consider a central portion of each stroke included in the character as a core of the character. In such a case, since the bit map defined by units of a pixel does not include information about the strokes, the basic portion must be defined by an estimation. The basic portion cannot be estimated from information about the current bit D(x,y) but can be estimated from information about the bits located in the vicinity of the current bit D(x,y). For example, from the bit map defined by units of a pixel shown in FIG. 20A, it is estimated that the stroke is a curve which passes through a region corresponding to the bits N(0,−1), D(x,y), and N(1,1) (shown by a broken line 1301 in FIG. 20A). As indicated by the broken line, this curve is considered to pass through the right side of the region corresponding to the bit D(x,y). Thus, referring to FIG. 20B, the sub-pixel C(3x+2,y) included in the right side of the pixel P(x,y) corresponding to the bit D(x,y) is defined as a sub-pixel of the basic portion. The basic portion is defined on a sub-pixel by sub-pixel basis.

The basic portion definition rule is generated based on the above estimation. The generated basic portion definition rule is represented by the above logical expressions, and used at Step S1004 in the process shown in FIG. 17.

Figure 21A:
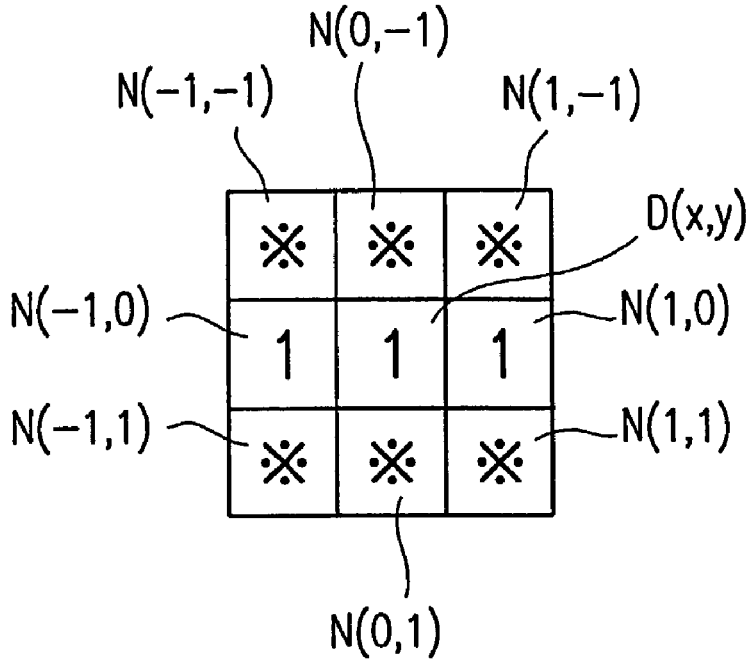
FIG. 21A shows another example of eight neighborhoods around the current bit D(x,y) in the bit map defined by units of a pixel.

FIG. 21A shows another example of eight neighborhoods around the current bit D(x,y) in the bit map defined by units of a pixel.

Figure 21B:
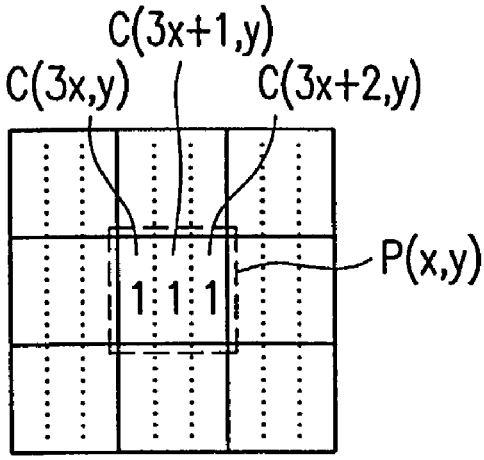
FIG. 21B shows sub-pixels defined as sub-pixels for the basic portion based on the basic portion definition rule when the eight neighborhood bits around the bit D(x,y) have values shown in FIG. 21A.

FIG. 21B shows sub-pixels defined as sub-pixels for the basic portion based on the basic portion definition rule when the eight neighborhood bits around the bit D(x,y) have values shown in FIG. 21A. The basic portion definition rule represented by FIGS. 21A and 21B can be represented by using the following logical expressions:

When $N(-1,0)*N(1,0)=1$, $$C(3x,y)=1,\ C(3x+1,y)=1,\ C(3x+2,y)=1 \tag{3}$$

Figure 22A:
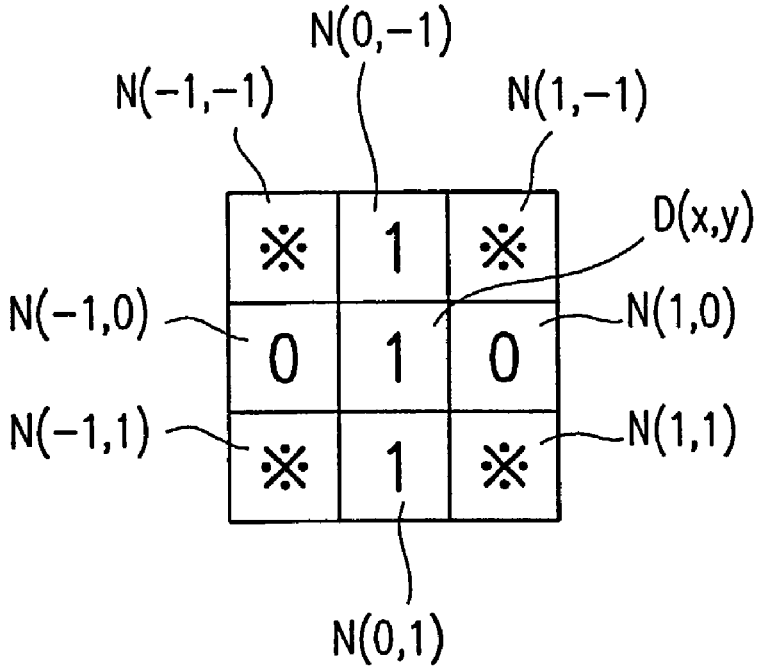
FIG. 22A shows still another example of eight neighborhoods around the current bit D(x,y) in the bit map data.

FIG. 22A shows still another example of eight neighborhoods around the current bit D(x,y) in the bit map data.

Figure 22B:
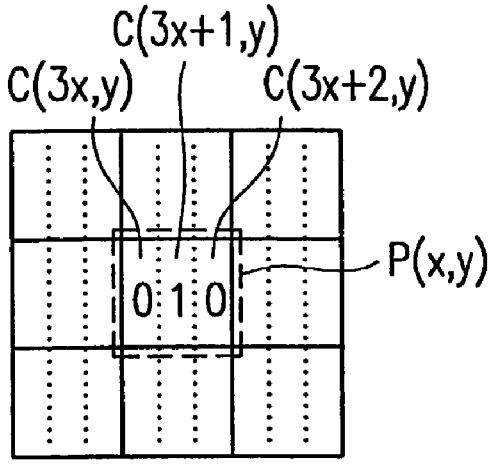
FIG. 22B shows sub-pixels defined as sub-pixels for the basic portion based on the basic portion definition rule when the eight neighborhood bits around the bit D(x,y) have values shown in FIG. 22A.

FIG. 22B shows sub-pixels defined as sub-pixels for the basic portion based on the basic portion definition rule when the eight neighborhood bits around the bit D(x,y) have values shown in FIG. 22A. The basic portion definition rule represented by FIGS. 22A and 22B can be represented by using the following logical expressions:

When $N(0,-1)*!N(-1,0)*!N(1,0)*N(0,1)=1$, $$C(3x,y)=0,\ C(3x+1,y)=1,\ C(3x+2,y)=0 \tag{4}$$

Thus, such a basic portion definition rule as described above is provided for the "1"/"0" arrangement pattern of the eight dots in the vicinity of the current bit D(x,y), whereby the basic portion of a character is defined on a sub-pixel by sub-pixel basis.

In this way, basic portion data which defines the basic portion of a character on a sub-pixel by sub-pixel basis is generated.

Figure 23:
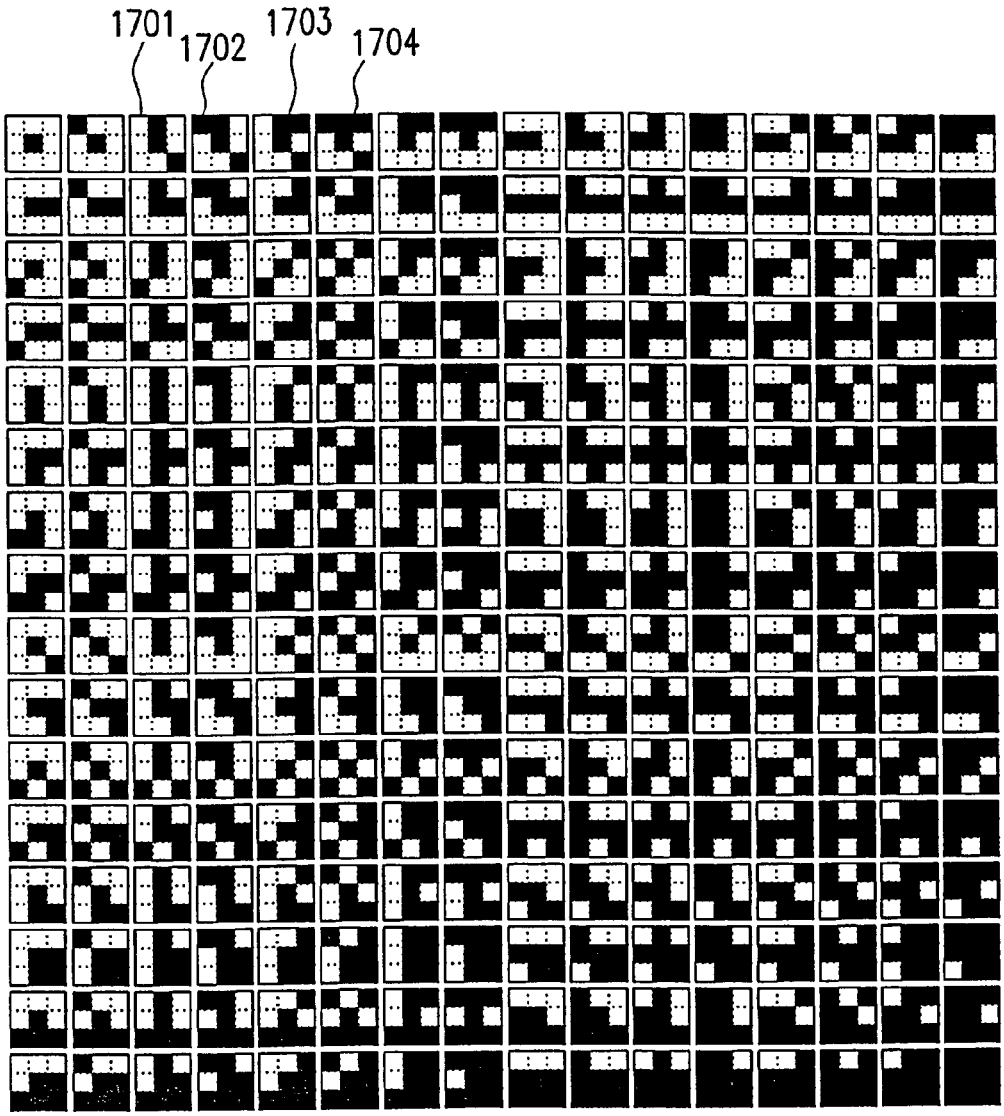
FIG. 23 shows all possible "1"/"0" arrangement patterns of the eight neighborhood dots around the current bit D(x,y).

FIG. 23 shows all "1"/"0" arrangement patterns of the eight neighborhood dots around the current bit D(x,y). Each box shown in FIG. 23 includes the current bit D(x,y) and the eight neighborhood dots there around. Each box is divided into nine regions. Each black region corresponds to a bit having a value of "1", and each white region corresponds to a bit having a value of "0". FIG. 23 shows 256 boxes. This is because each of the eight neighborhood dots has a value of "1" or "0", and accordingly, the number of the "1"/"0" arrangement patterns results in $2^8=256$ patterns. However, the number of basic portion definition rules is not necessarily required to be the same as the number of the "1"/"0" arrangement patterns, i.e., 256. As previously described, in FIGS. 20A, 21A, and 22A, bits indicated by "X" each have any value of "0" and "1" and are not considered in the basic portion definition rule. Since the basic portion definition rule includes bits which are not considered therein, one basic portion definition rule can cover a plurality of "1"/"0" arrangement patterns among those shown in FIG. 23. For example, the basic portion definition rule represented by FIG. 20A and 20B covers the "1"/"0" arrangement patterns shown in the boxes 1701, 1702, 1703, and 1704 of FIG. 23. Thus, when the basic portion definition rule encompasses cases where a bit takes any value of "1" or "0", the number of the basic portion definition rules required for the present invention can be reduced.

The basic portion definition rule may be described in the form of a group of logical expressions as described above or in the form of table data.

Figure 24:
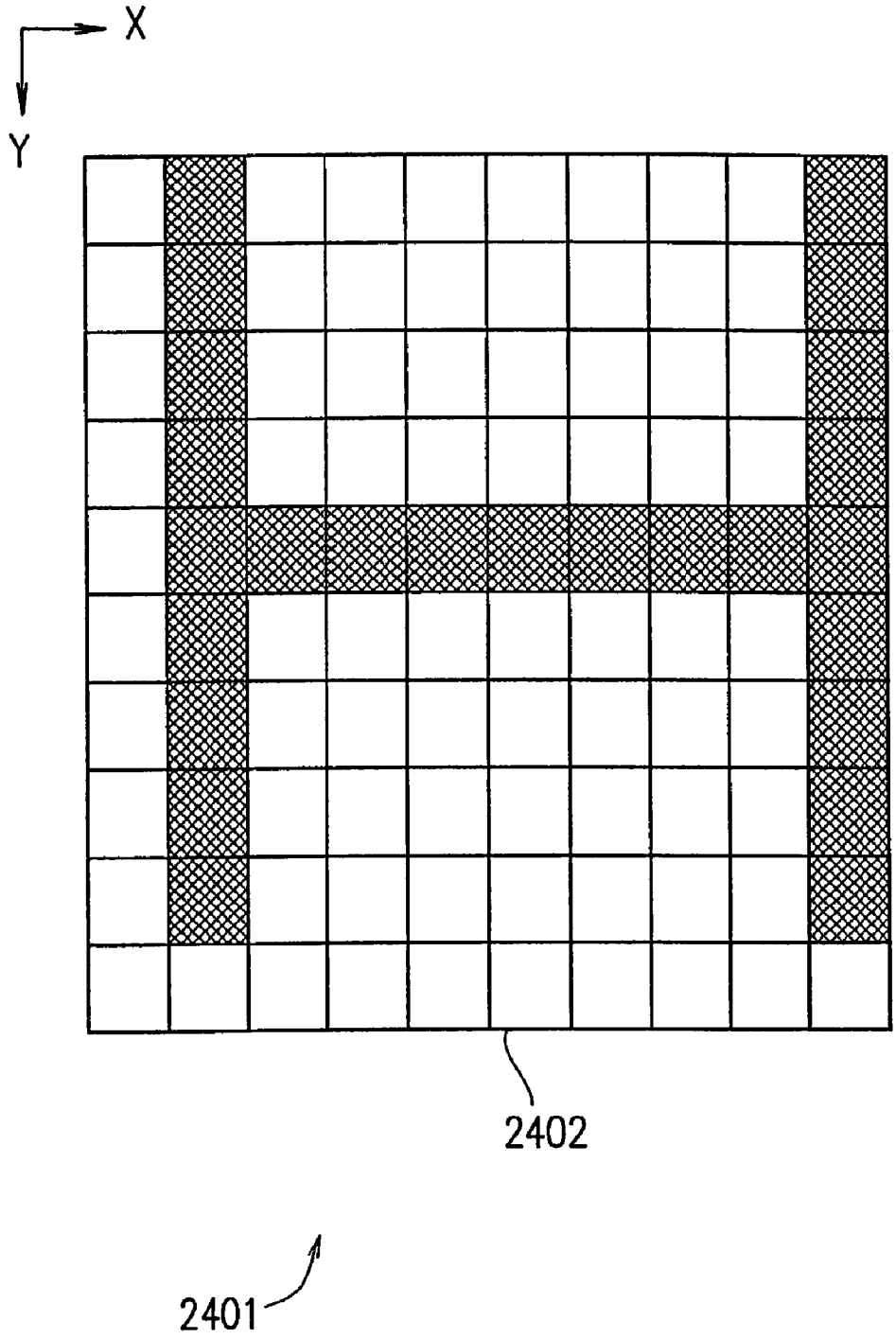
FIG. 24 shows an example of a bit map 2401 defined by units of a pixel which represents a character "H".

FIG. 24 shows an example of a bit map 2401 defined by units of a pixel which represents a character "H". The bit map 2401 defined by units of a pixel has a size of 10 dots×10 dots. In FIG. 24, each hatched box represents a bit of "1", and each open box represents a bit of "0". Each bit corresponds to one pixel on the display plane 400. The bit map 2401 is demarcated by a region 2402 having a size of 10 dots×10 dots.

The process shown in FIG. 17 is performed on the bit map 2401 defined by units of a pixel, whereby the basic portion data 600 (FIG. 6) is generated. The region 2402 shown in FIG. 24 corresponds to the frame 601 shown in FIG. 6.

Figure 25:
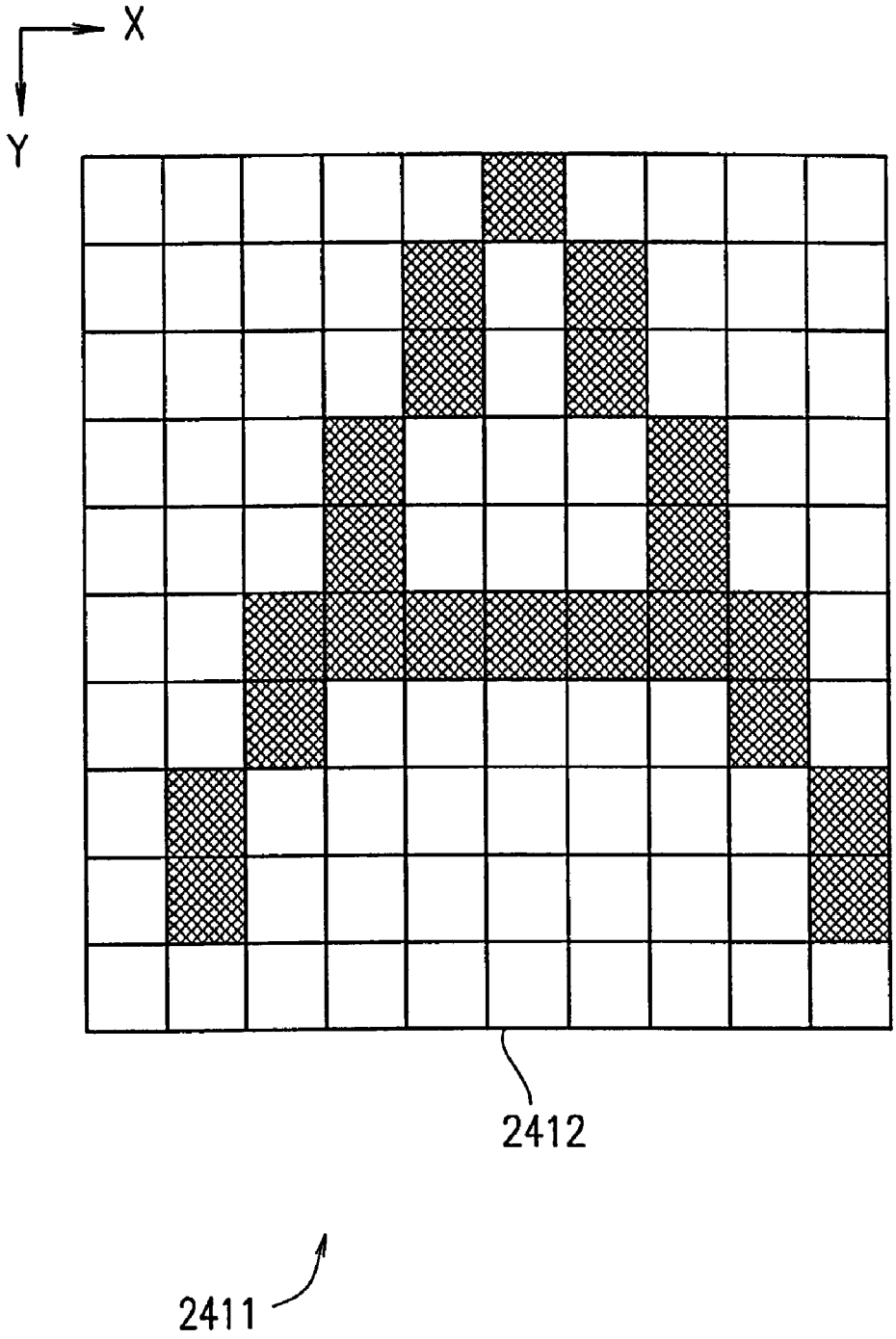
FIG. 25 shows an example of a bit map 2501 defined by units of a pixel which represents a character "A".

FIG. 25 shows an example of a bit map 2411 defined by units of a pixel which represents a character "A". The bit map 2411 is defined by a region 2412 having a size of 10 dots×10 dots. The process shown in FIG. 25 is performed on the bit map 2411 defined by units of a pixel, whereby the basic portion data 610 (FIG. 10) is generated. The region 2412 shown in FIG. 25 corresponds to the frame 611 shown in FIG. 10.

Other known methods for generating basic portion data include a method for generating basic portion data from character outline information which represents the outline of a character, and a method for generating basic portion data from stroke data which represents stroke information of a character. These methods may be employed at Step S103 of FIG. 5. When any of such methods is employed for generating basic portion data, the frame of basic portion data is defined according to the employed generation method.

(Embodiment 2)

Figure 26:
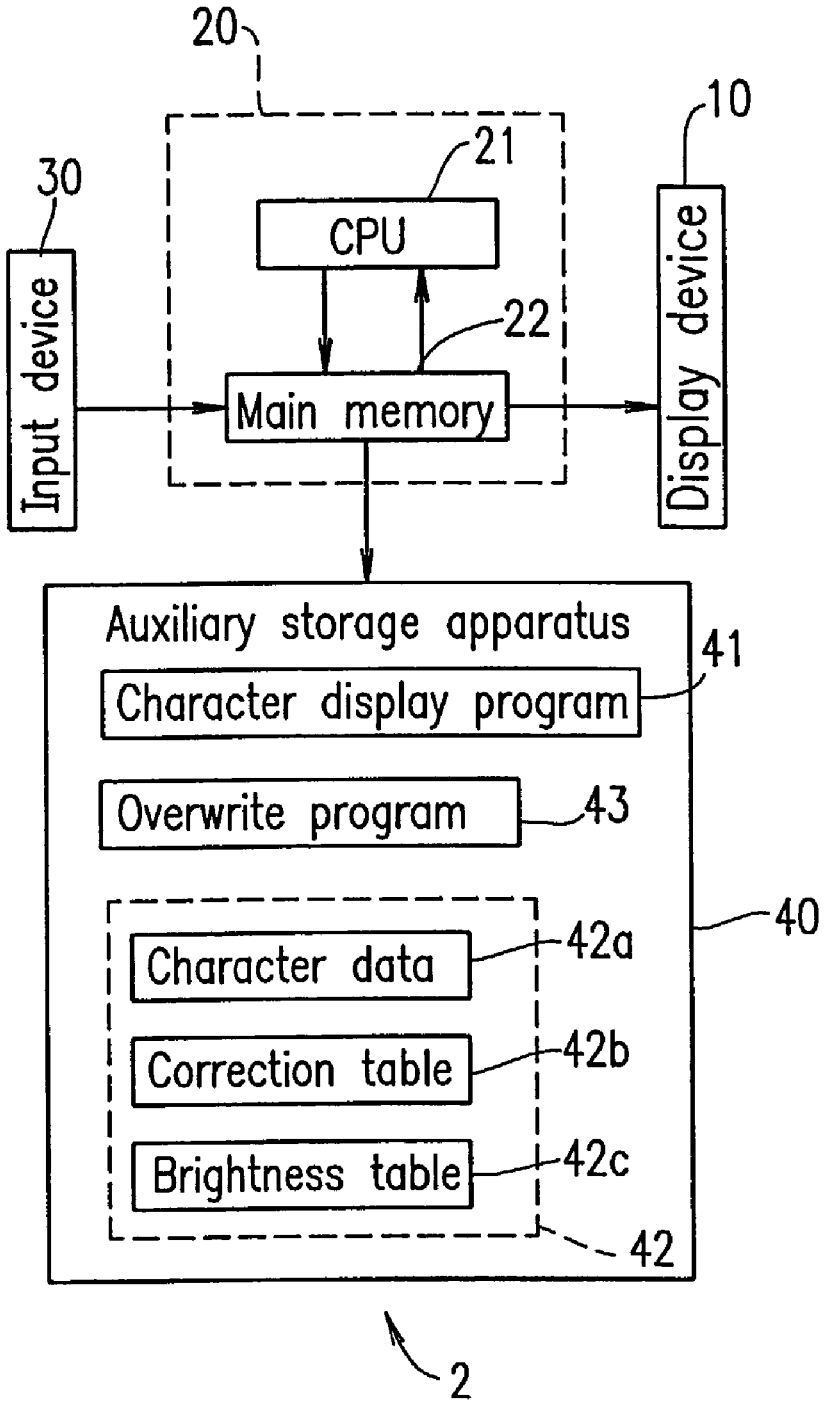
FIG. 26 is a block diagram showing a structure of a character display apparatus 2 according to embodiment 2 of the present invention.

FIG. 26 illustrates a structure of a character display apparatus 2 according to embodiment 2 of the present invention. The character display apparatus 2 includes an overwrite program 43 in addition to the components of the character display apparatus 1 shown in FIG. 1. In FIG. 26, like elements are indicated by like reference numerals used in FIG. 1, and detailed descriptions thereof are omitted. The CPU 21 executes the overwrite program 43 so that character overwrite process is achieved. The character overwrite process is one where a character display process for displaying a new character is achieved by overwrite.

Figure 27:
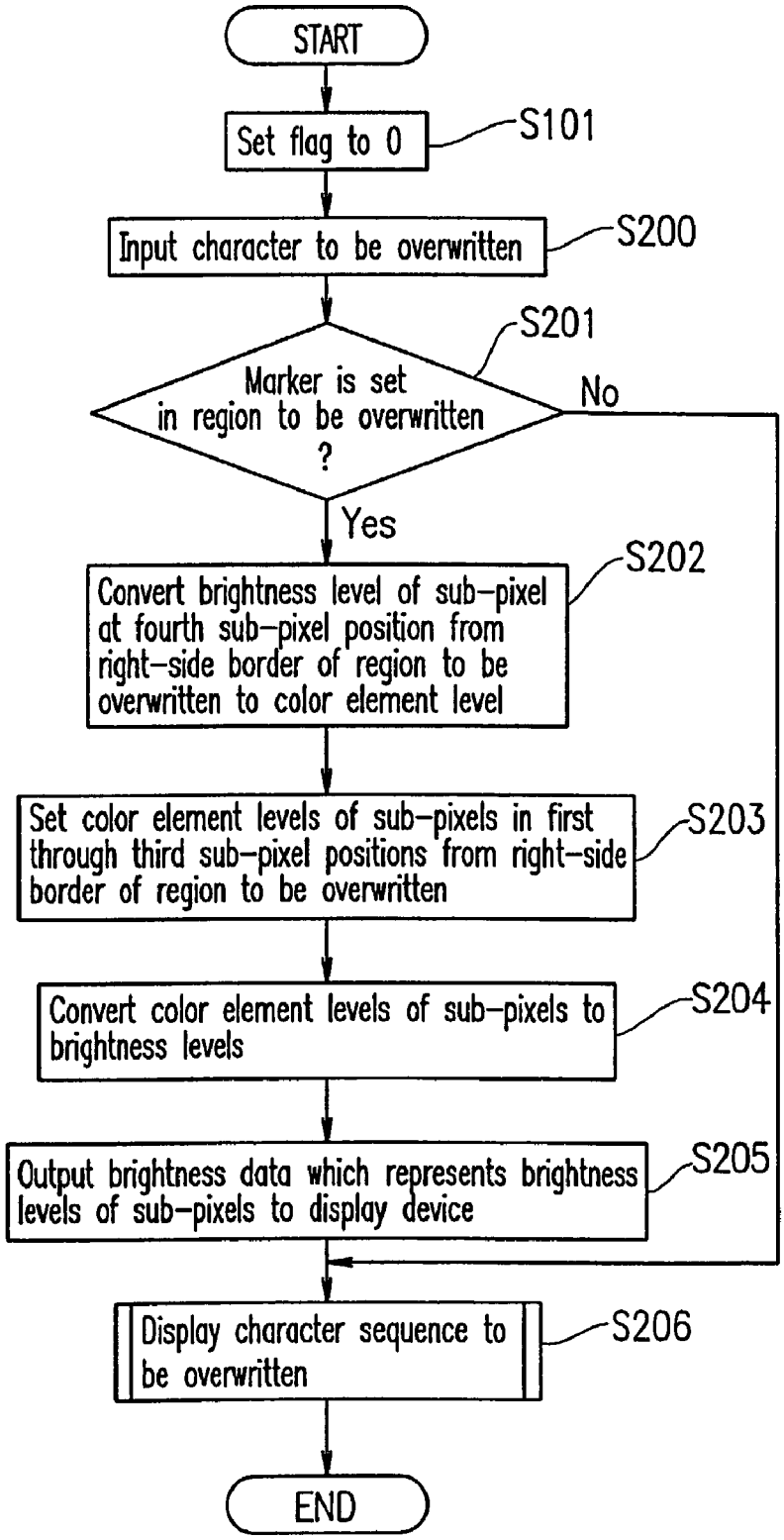
FIG. 27 is a flowchart which illustrates an execution of an overwrite process by an overwrite program 43.

FIG. 27 is a flowchart which illustrates an execution of an overwrite process by an overwrite program 43. In the description below, a character currently displayed on the display plane 400 and a character to be written over the currently-displayed character have the same size. In FIG. 27, like steps are indicated by like reference numerals used in FIG. 5, and detailed descriptions thereof are omitted.

Step S200: At least one character to be displayed on the display plane 400 of the display device 10 is input.

Step S201: It is determined whether or not a marker is set in a region for one character on the display plane 400 on which a character is to be overwritten. This determination is achieved by examining whether or not the value of a pixel at a predetermined position in the region for one character on which a character is to be overwritten, is a value which represents the marker (e.g., 0xffffe). The value of the pixel can be obtained by referring to a value of a VRAM (not shown), for example.

In the case where the number of characters to be overwritten is 2 or more, the processes of Steps S201 through S205 needs to be performed only on the rightmost character area in a region on the display plane 400 on which the characters are to be overwritten.

If a result of the determination at Step S201 is "Yes", the process proceeds to Step S202. If a result of the determination at Step S201 is "No", the process proceeds to Step S206.

Step S202: The brightness level of a sub-pixel at a fourth sub-pixel position from the right-side border of the region on the display plane 400 to be overwritten is converted to a color element level. The position of the sub-pixel, whose brightness level is converted to a color element level, from the right-side border of the region to be overwritten is determined based on the length of a correction pattern. That position is determined at a position where a correction pattern protruding from the region to be overwritten does not reach. Preferably, that position is determined at the ("length of correction pattern" plus 1)-th position from the right-side border of the region to be overwritten. Herein, the length of the correction pattern is "3".

Step S203: The color element levels of sub-pixels are set in the first through third sub-pixel positions from the right-side border of -the region on the display plane 400 to be overwritten.

Step S204: The color element levels of the sub-pixels at the first through third sub-pixel positions from the right-side border of the region on the display plane 400 to be overwritten are converted to brightness levels.

Step S205: Brightness data, which represents brightness levels of the sub-pixels at the first through third sub-pixel positions from the right-side border of the region on the display plane 400 to be overwritten, is output to the display device 10.

Step S206: A character to be overwritten is displayed. The process of Step S206 is achieved by performing the processes of Steps S103 through S120 illustrated with reference to FIG. 5. It should be noted that, in the process of outputting brightness data for sub-pixels whose color element levels are stored in the storage buffer to the display device 10 at Step S120, the brightness levels represented by this brightness data and the brightness levels currently set for those sub-pixels which correspond to the color element levels stored in the storage buffer are compared for each sub-pixel. In this example (where the background color is white, and the character color is black), the lower brightness level is set as a new brightness level.

Hereinafter, the character overwrite process is described with reference to FIGS. 28 through 35, considering an example where a character sequence "HA" is currently displayed on the display plane 400 of the display device 10, and a character "V" is written over the character "H".

Figure 28:
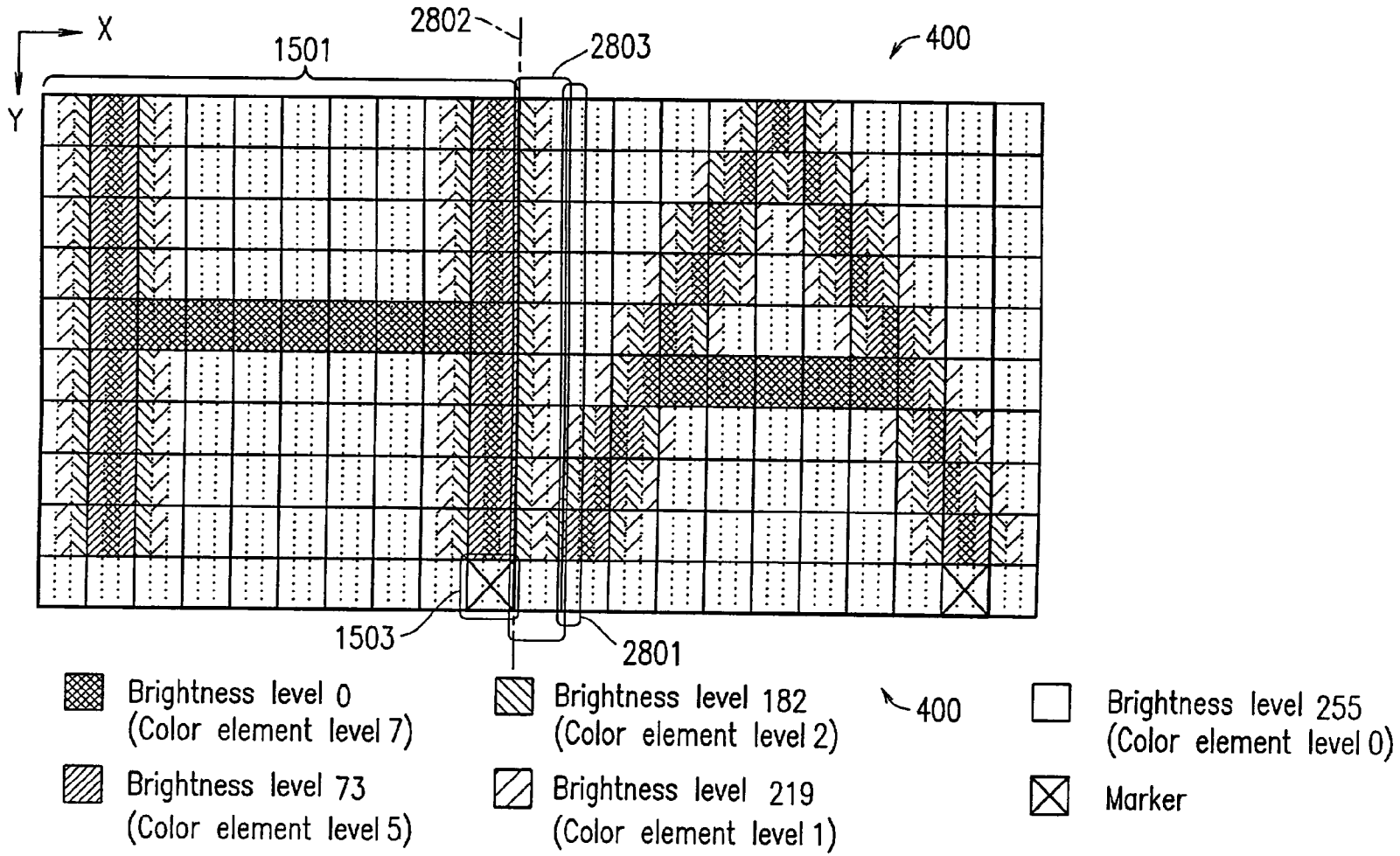
FIG. 28 shows the character sequence "HA" displayed on the display plane 400 of the display device 10.

FIG. 28 shows the character sequence "HA" displayed on the display plane 400 of the display device 10. At Step S202 of FIG. 27, the brightness level of a sub-pixel at a fourth sub-pixel position from the right-side border 2802 of the region 2802 on the display plane 400 to be overwritten (sub-pixel included in a region 2801) is converted to a color element level. The value of the sub-pixel can be obtained by referring to a value of a VRAM (not shown), for example.

Figure 29:
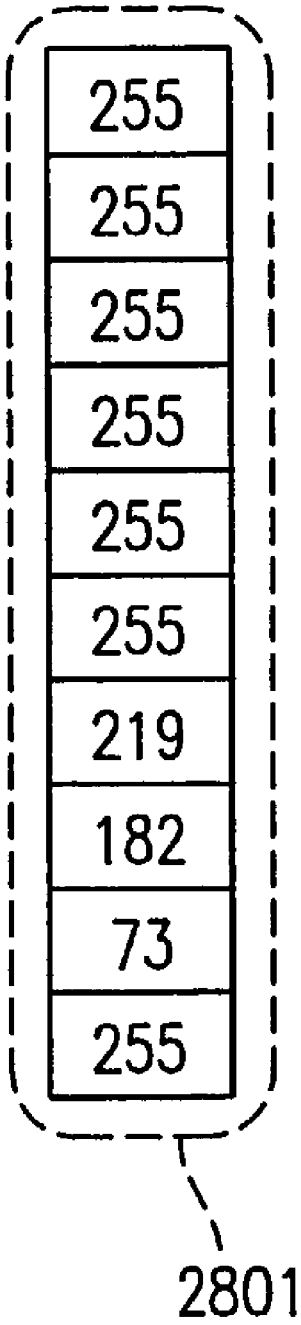
FIG. 29 shows the brightness levels of sub-pixels included in a region 2801 shown in FIG. 28.

FIG. 29 shows the brightness levels of sub-pixels included in the region 2801 shown in FIG. 28. In FIG. 29, each box corresponds to one of the sub-pixels included in the region 2801. The numeric value shown in each box represents the brightness level of a sub-pixel corresponding to that box.

FIG. 30 shows an example of a table 3001 which defines correspondence between brightness levels and color element levels. The table 3001 is used for converting the brightness level of a sub-pixel to a color element level at Step S202 of FIG. 27. Conversion performed using the table 3001 is inversive to the conversion performed using the brightness table 392 shown in FIG. 3. In the case where, in the brightness table 392 shown in FIG. 3, the correspondence between brightness levels and color element levels is different among the color elements R, G, and B, the table 3001 is modified so as to define the correspondence between brightness levels and color element levels for each of the color elements R, G, and B.

Figure 31:
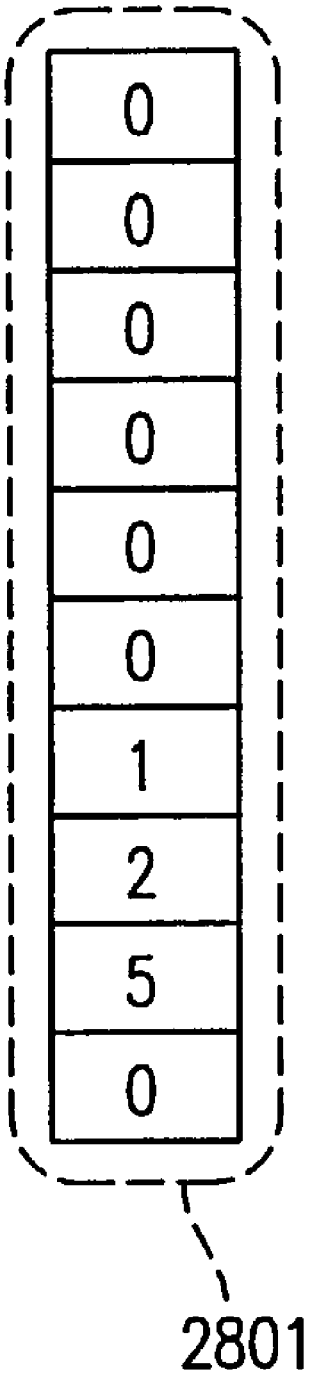
FIG. 31 shows the color element levels of sub-pixels included in the region 2801, which are obtained after the brightness levels of the sub-pixels shown in FIG. 29 are converted to color element levels using the table 3001 shown in FIG. 30.

FIG. 31 shows the color element levels of sub-pixels included in the region 2801, which are obtained after the brightness levels of the sub-pixels shown in FIG. 29 are converted to color element levels using the table 3001 shown in FIG. 30. In FIG. 31, a numeric value shown in each box represents the color element level of a sub-pixel corresponding to that box.

FIG. 32 shows a table 3201 which defines the correspondence between the color element level of a target sub-pixel and the color element levels of sub-pixels adjacent to the target sub-pixel. The table 3201 is used at Step S203 of FIG. 27 for setting the color element levels of sub-pixels in the first through third sub-pixel positions from the right-side border of the region on the display plane 400 to be overwritten.

According to the table 3201, for example, when the color element level of a target sub-pixel (in this case, a sub-pixel at a fourth sub-pixel position from the right-side border of the region on the display plane 400 to be overwritten) is "5", the color element levels of three sub-pixels located adjacent to the left side of the target sub-pixel (sub-pixels at the first to third sub-pixel positions from the right-side border of the region on the display plane 400 to be overwritten) are set to "0", "1", and "2", respectively, from left to right.

FIG. 33 shows the color element levels of sub-pixels at the first to third sub-pixel positions from the right-side border of the region on the display plane 400 to be overwritten (sub-pixels included in the region 2803 shown in FIG. 28), which are set using the table 3201 shown in FIG. 32. In FIG. 33, a numeric value shown in each box represents the color element level of a sub-pixel corresponding to that box.

FIG. 34 shows the brightness levels of sub-pixels included in the region 2803, which are obtained after the color element levels of the sub-pixels shown in FIG. 33 are converted to brightness levels. Such conversion is performed using the brightness table 392 (FIG. 3) at Step S204 of FIG. 27.

In the process of overwriting a character "V" onto the character "H", the processes at Steps S202 through S205 are performed, whereby the color element levels of all the sub-pixels included in the region 2803 are set again. As a result, among sub-pixels located in the vicinity of the sub-pixels corresponding to the basic portion of the character "H", the color element level of a sub-pixel(s) located outside of a region corresponding to the frame of the character "H" (the region 1501 to be over written) is set again. This is because such sub-pixels (sub-pixels included in the region 1602 shown in FIG. 16) are included in the region 2803.

Figure 35:
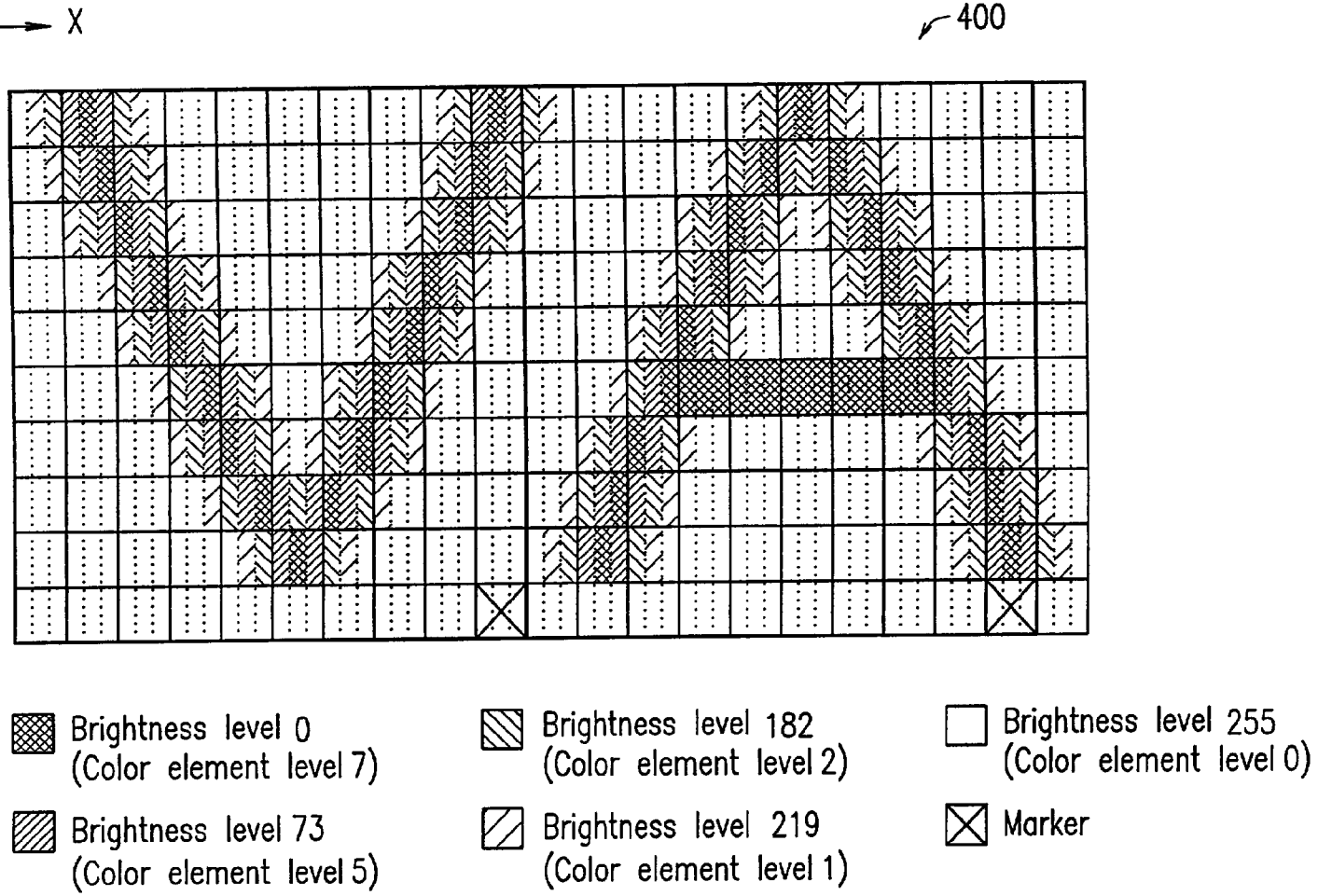
FIG. 35 shows the display plane 400 after a character "V" has been written over a character "H" of the character sequence "HA" through the character overwrite process illustrated in FIG. 27.

FIG. 35 shows the display plane 400 after the character "V" has been written over the character "H" of the character sequence "HA" through the character overwrite process illustrated in FIG. 27.

Figure 36:
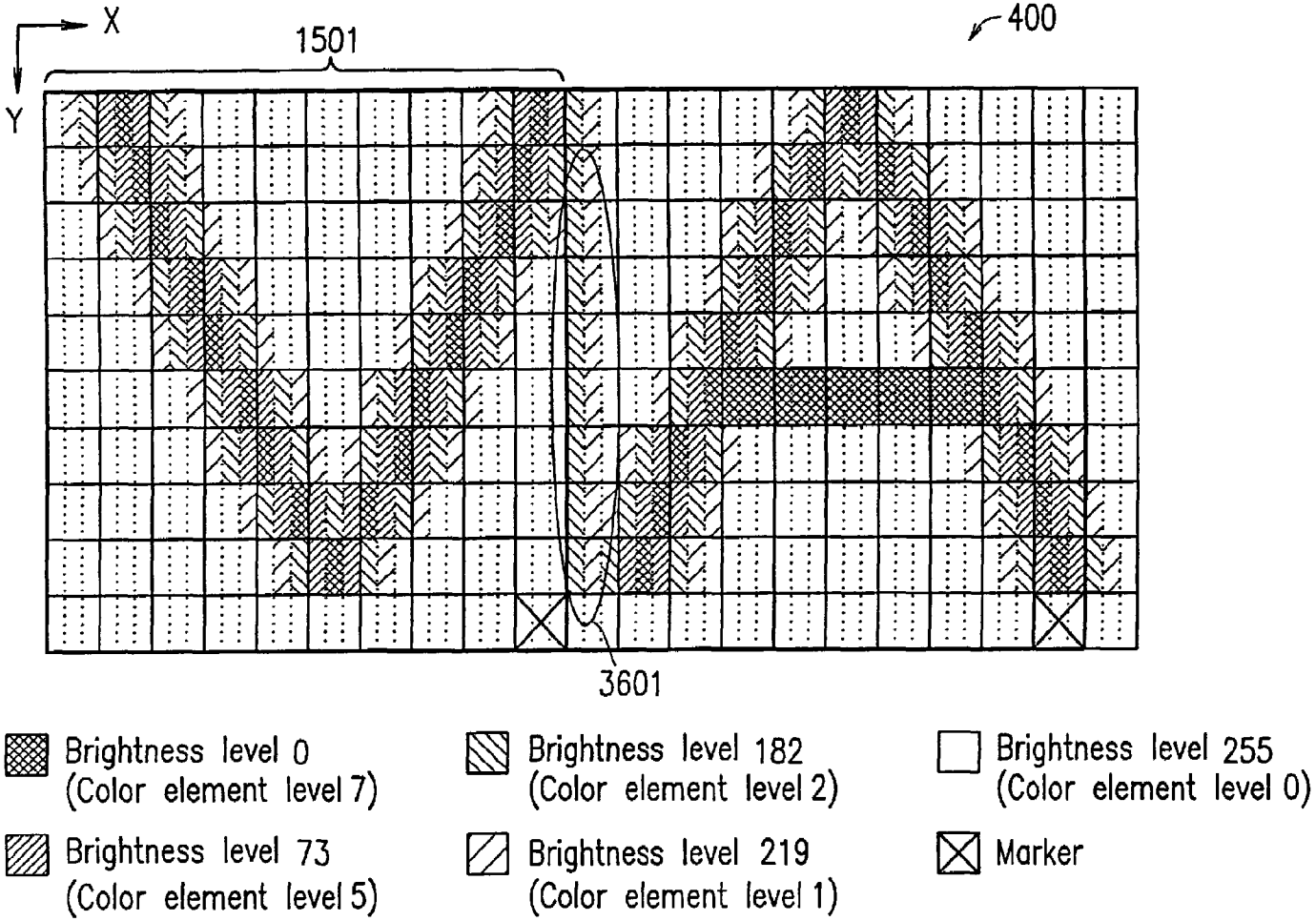
FIG. 36 shows the display plane 400 after the character overwrite process illustrated in FIG. 27 has completed, but the processes of Steps S202 through S205 have not been performed.

FIG. 36 shows the display plane 400 after the character overwrite process illustrated in FIG. 27 has completed, but the processes of Steps S202 through S205 have not been performed. In this case, among sub-pixels located in the vicinity of the sub-pixels corresponding to the basic portion of the character "H", the color element level of a sub-pixel(s) located outside of the region 1501 which corresponds to the frame of the character "H" is not set again. As a result, noise 3601 which is uncomfortable to a human eye is left on the display plane 400, resulting in an unpreferable display condition.

(Embodiment 3)

Figure 37:
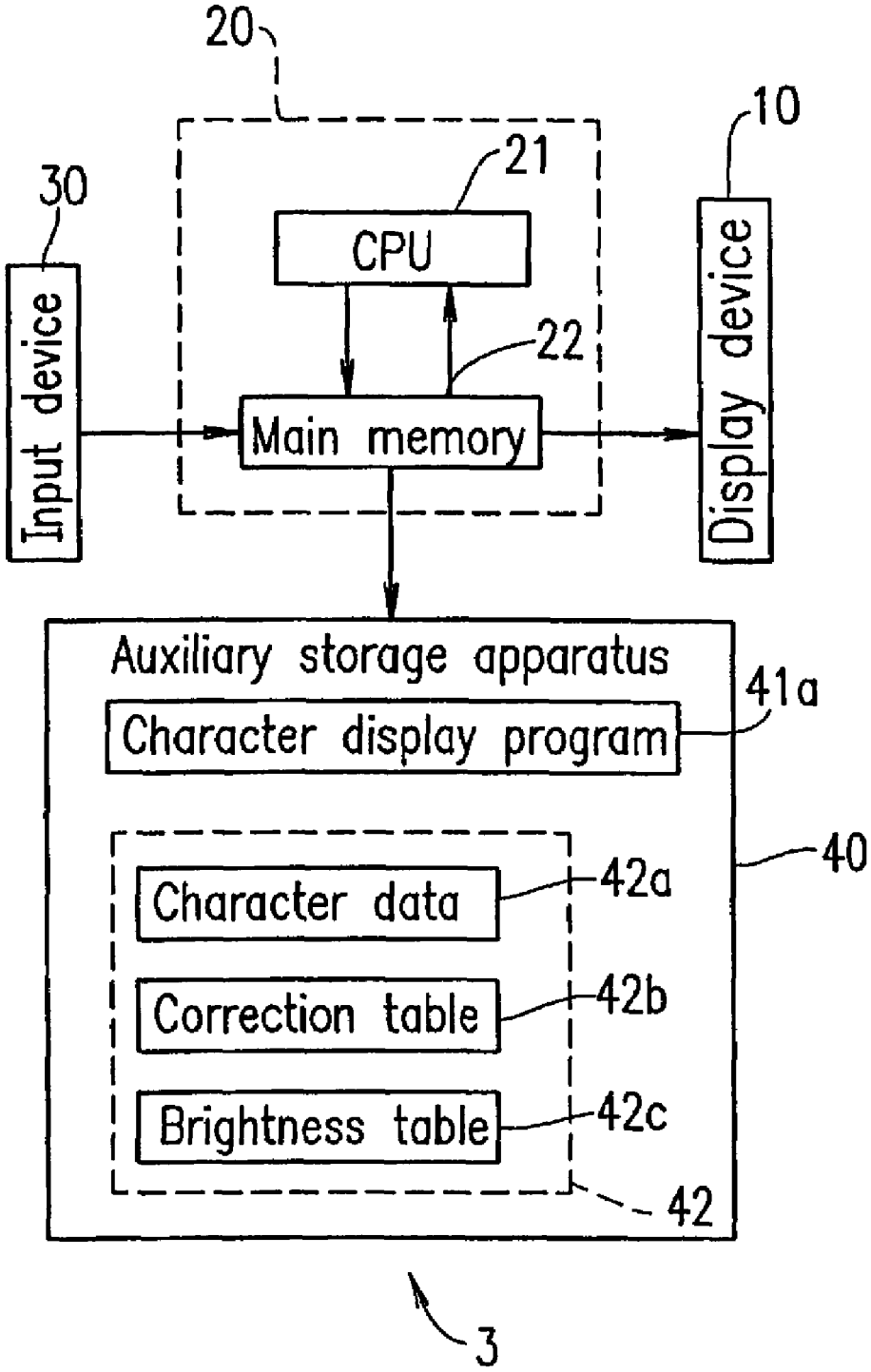
FIG. 37 is a block diagram showing a structure of a character display apparatus 3 according to embodiment 3 of the present invention.

FIG. 37 illustrates a structure of a character display apparatus 3 according to embodiment 3 of the present invention. The character display apparatus 3 includes a character display program 41*a* in place of the character display program 41 of the character display apparatus 1 shown in FIG. 1. In FIG. 37, like elements are indicated by like reference numerals used in FIG. 1, and detailed descriptions thereof are omitted. The CPU 21 executes the character display program 41*a* so that character display processing is achieved.

Figure 38:
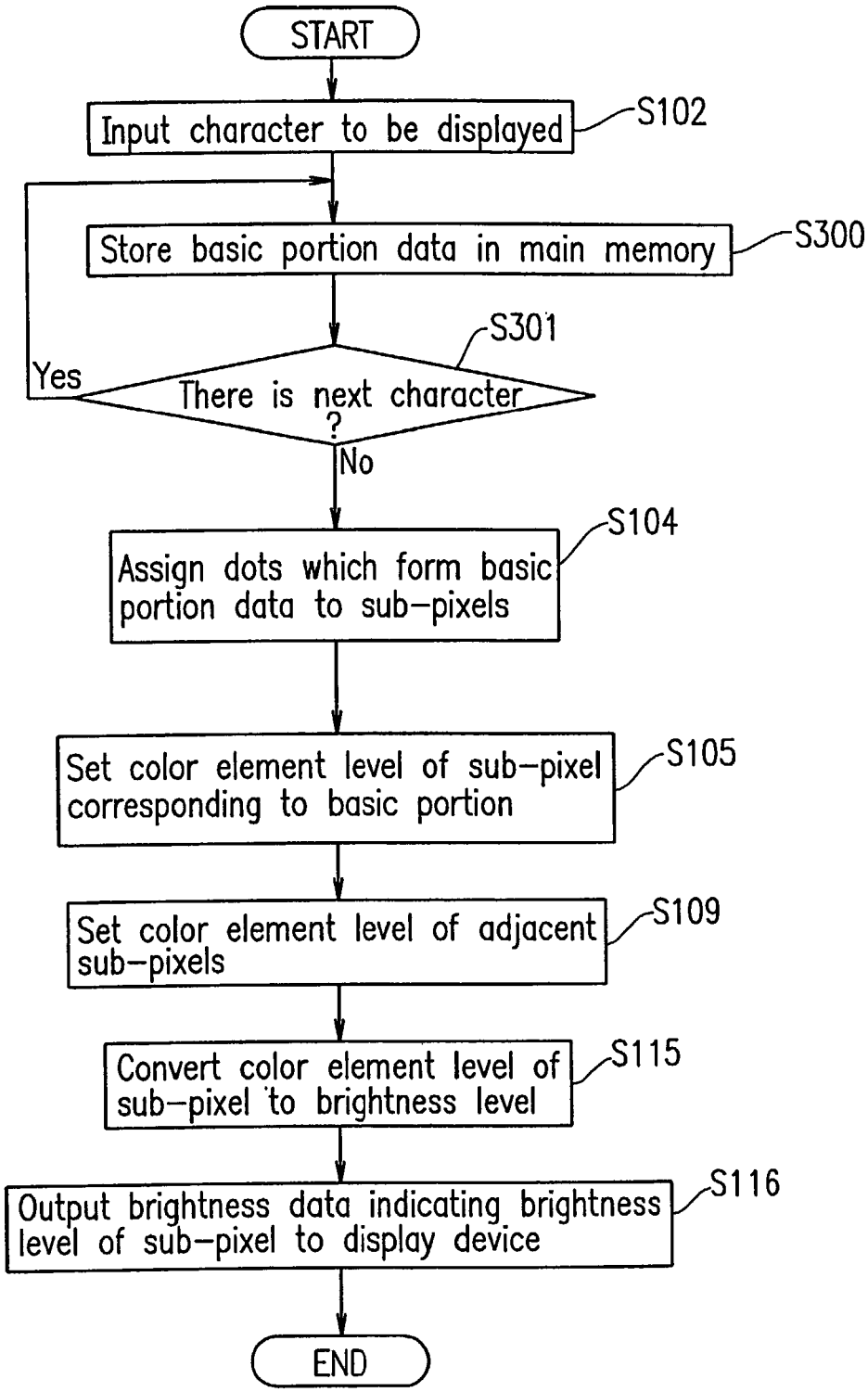
FIG. 38 is a flowchart which illustrates a procedure of the character display processing which is executed based on a character display program 41*a*.

FIG. 38 illustrates a procedure of the character display processing which is executed based on the character display program 41*a*. In FIG. 38, like steps are indicated by like reference numerals used in FIG. 5, and detailed descriptions thereof are omitted.

Step S300: Basic portion data for one character corresponding to an input character code and character size is acquired, and stored in the main memory 22. When the number of characters input at Step S102 is two or more, Steps S300 and S301 are repeated a number of times same as the number of characters. In such a case, basic portion data for each of the characters is stored in the main memory 22 together with information regarding the positional relationship of the characters. For example, in the case where the character sequence "HA" is displayed on the display plane 400, the basic portion data is stored in the main memory 22 together with information which indicates that the character "A" is displayed at the right side of the character "H".

Acquisition of the basic portion data may be achieved by reading from the auxiliary storage apparatus 40. Alternatively, the basic portion data may be generated from bit map data which defines the shape of a character on a pixel-by-pixel basis. Still alternatively, the basic portion data may be generated from character outline information which represents the outline of a character, or from stroke data which represents stroke information of a character.

Step S301: It is determined whether or not there is a next character to be displayed. If a result of the determination at Step S301 is "Yes", the process returns to Step S300. If a result of the determination at Step S301 is "No", the process proceeds to Step S104.

Hereinafter, the character display process is described with reference to FIGS. 39 through 42, considering an example where a character sequence "HA" is displayed on the display plane 400 of the display device 10.

Figure 39:
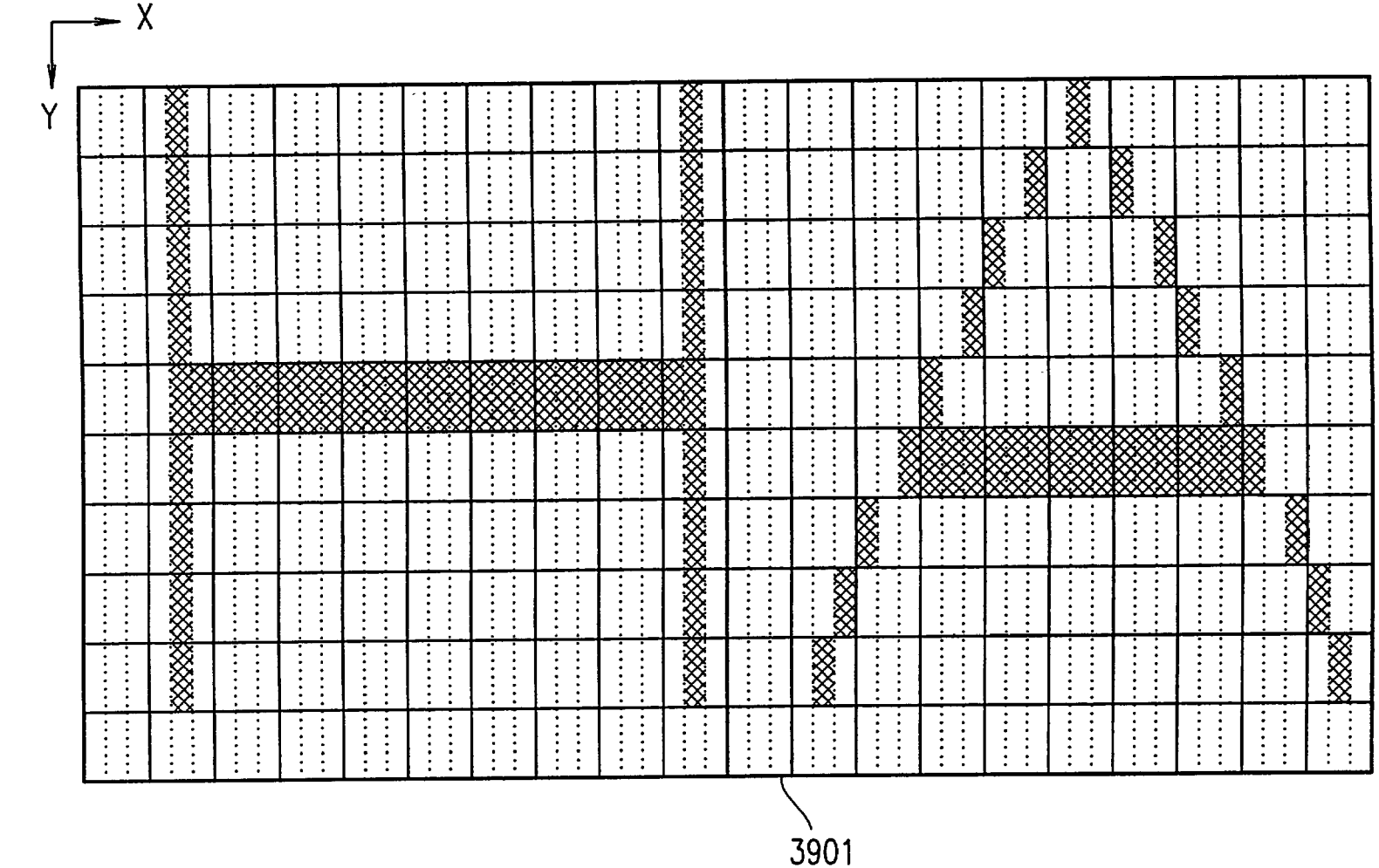
FIG. 39 shows the basic portion data of the character "H" and the basic portion data of the character "A" which are stored in a region 3901 on a main memory 22.

FIG. 39 shows the basic portion data of the character "H" and the basic portion data of the character "A" which are stored in the region 3901 on the main memory 22. In FIG. 39, each box corresponds to one sub-pixel of the display plane 400. A sub-pixel corresponding to a hatched box corresponds to the basic portion of the character "H" or the character "A".

Figure 40:
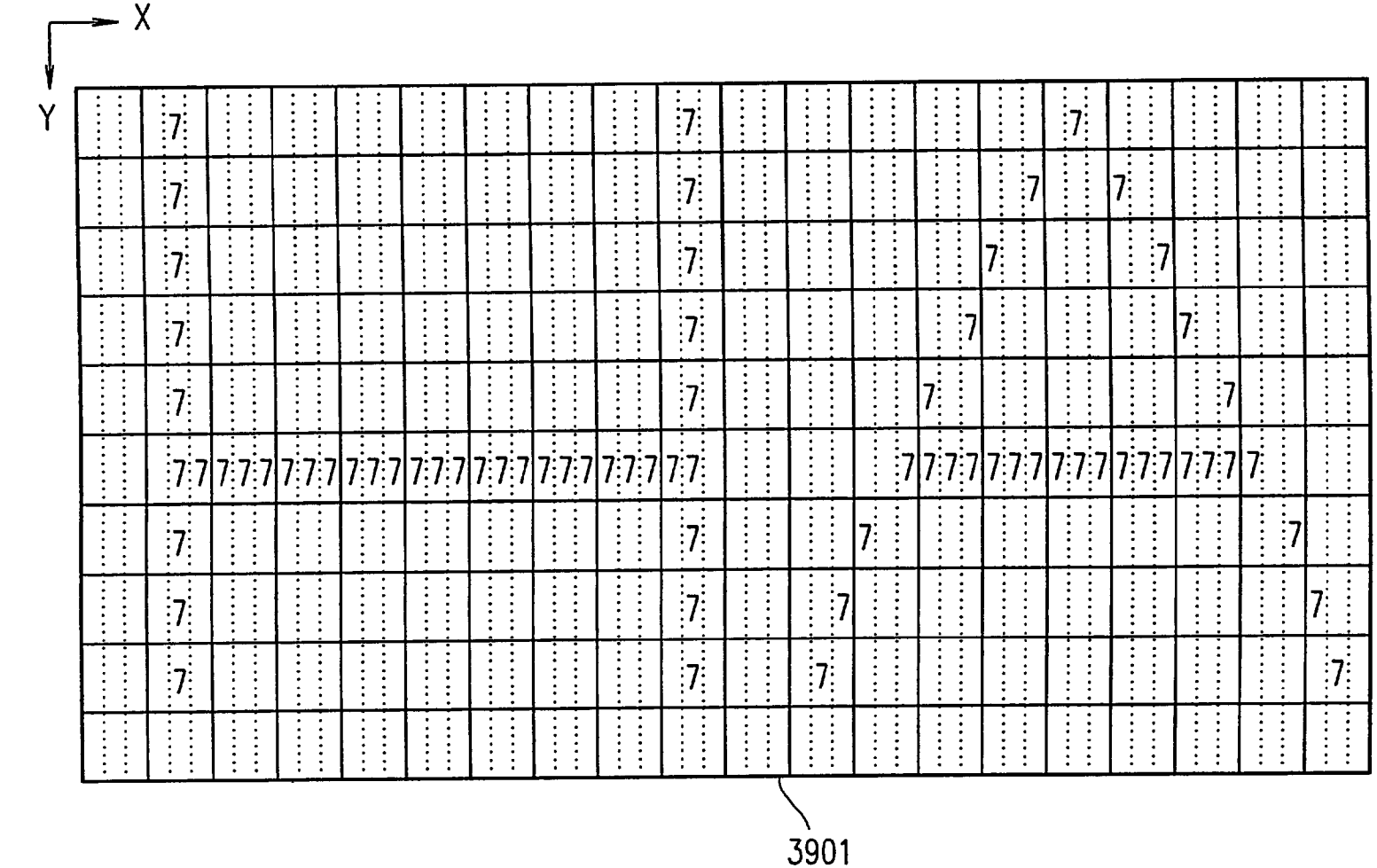
FIG. 40 shows an example where the color element levels of sub-pixels corresponding to the basic portion of the character "H" and the color element levels of sub-pixels corresponding to the basic portion of the character "A" are set to a predetermined value (color element level "7").

FIG. 40 shows an example where the color element levels of sub-pixels corresponding to the basic portion of the character "H" and the color element levels of sub-pixels corresponding to the basic portion of the character "A" are set to a predetermined value (color element level "7"). This setting process is performed at Step S105 of FIG. 38 on the main memory 22 in a virtual manner.

Figure 41:
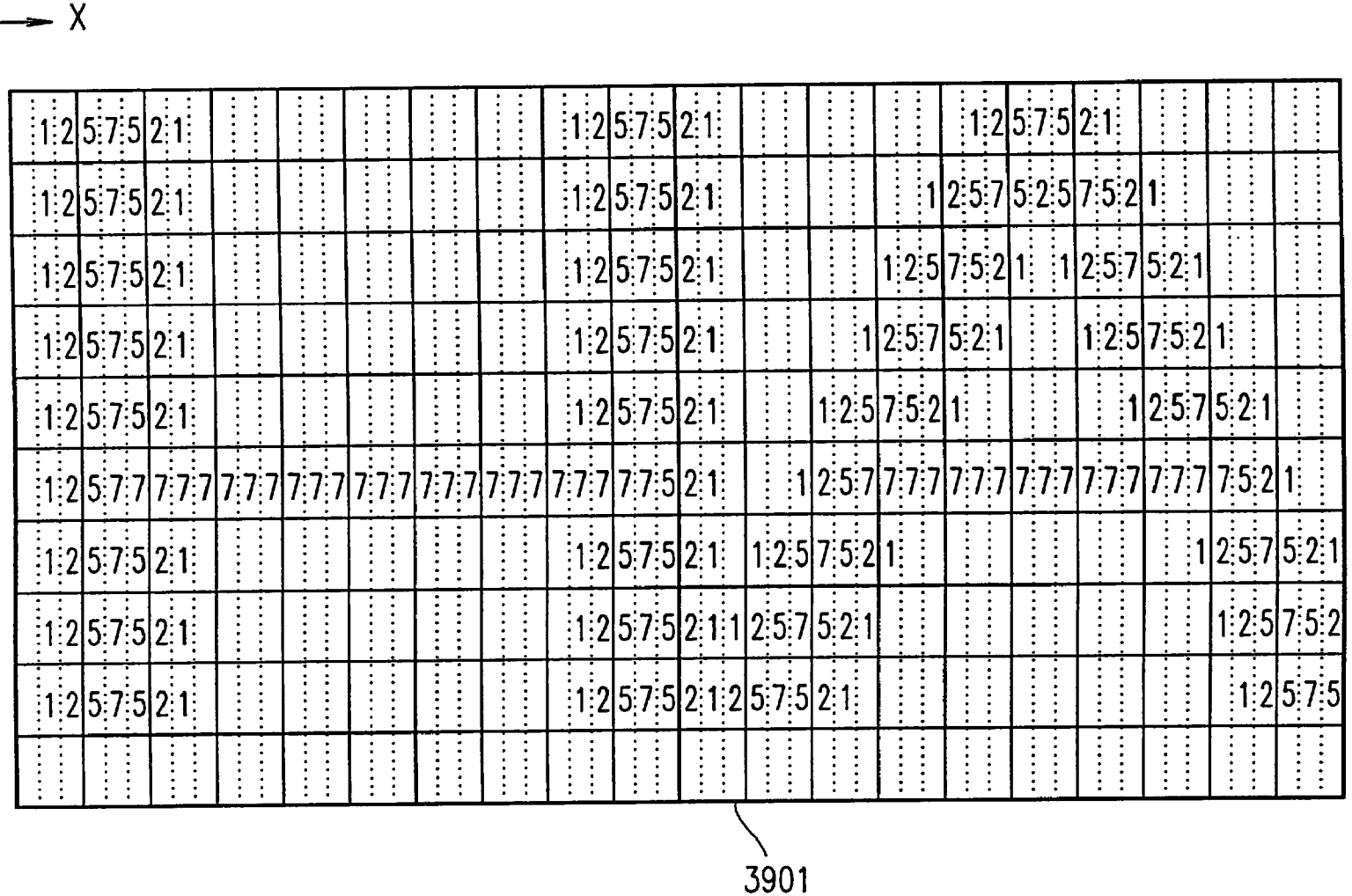
FIG. 41 shows an example where the color element levels of sub-pixels located in the vicinity of the sub-pixels corresponding to the basic portions of the character "H" and the character "A" are set to values different from the predetermined value (any of color element levels "5", "2", and "1").

FIG. 41 shows an example where the color element levels of sub-pixels located in the vicinity of the sub-pixels corresponding to the basic portions of the character "H" and the character "A" are set to values different from the predetermined value (any of color element levels "5", "2", and "1"). This setting process is performed, at Step S109 of FIG. 5, on the main memory 22 in a virtual manner. A sub-pixel corresponding to an open box which does not contain a numeric number is considered as a sub-pixel corresponding to the background of the character. The color element level of such a sub-pixel is set to "0".

In the setting process of FIG. 41 for setting the color element level of sub-pixels, the color element level of a sub-pixel located in the vicinity of a sub-pixel corresponding to the basic portion of the character "H" (first character) and the color element level of a sub-pixel located in the vicinity of a sub-pixel corresponding to the basic portion of the character "A" (second character) are each set to the higher one of a color element level, which is determined according to a distance from the sub-pixel corresponding to the basic portion of the character "H" and a color element level, which is determined according to a distance from the sub-pixel corresponding to the basic portion of the character "A". Thus, according to the character display apparatus 3 of embodiment 3 of the present invention, in either of a case where the correction pattern for the character "H" protrudes rightward (toward the character "A") or a case where the correction pattern for the character "A" protrudes leftward (toward the character "H"), the color element level of a sub-pixel which is to be determined based on that correction pattern is suitably determined in consideration of both a distance from the sub-pixel corresponding to the basic portion of the character "H" and a distance from the sub-pixel corresponding to the basic portion of the character "A". That is, a protruded portion of a correction pattern for one character is placed in a region of the other character. With such an arrangement, the characters are displayed with a high quality.

Figure 42:
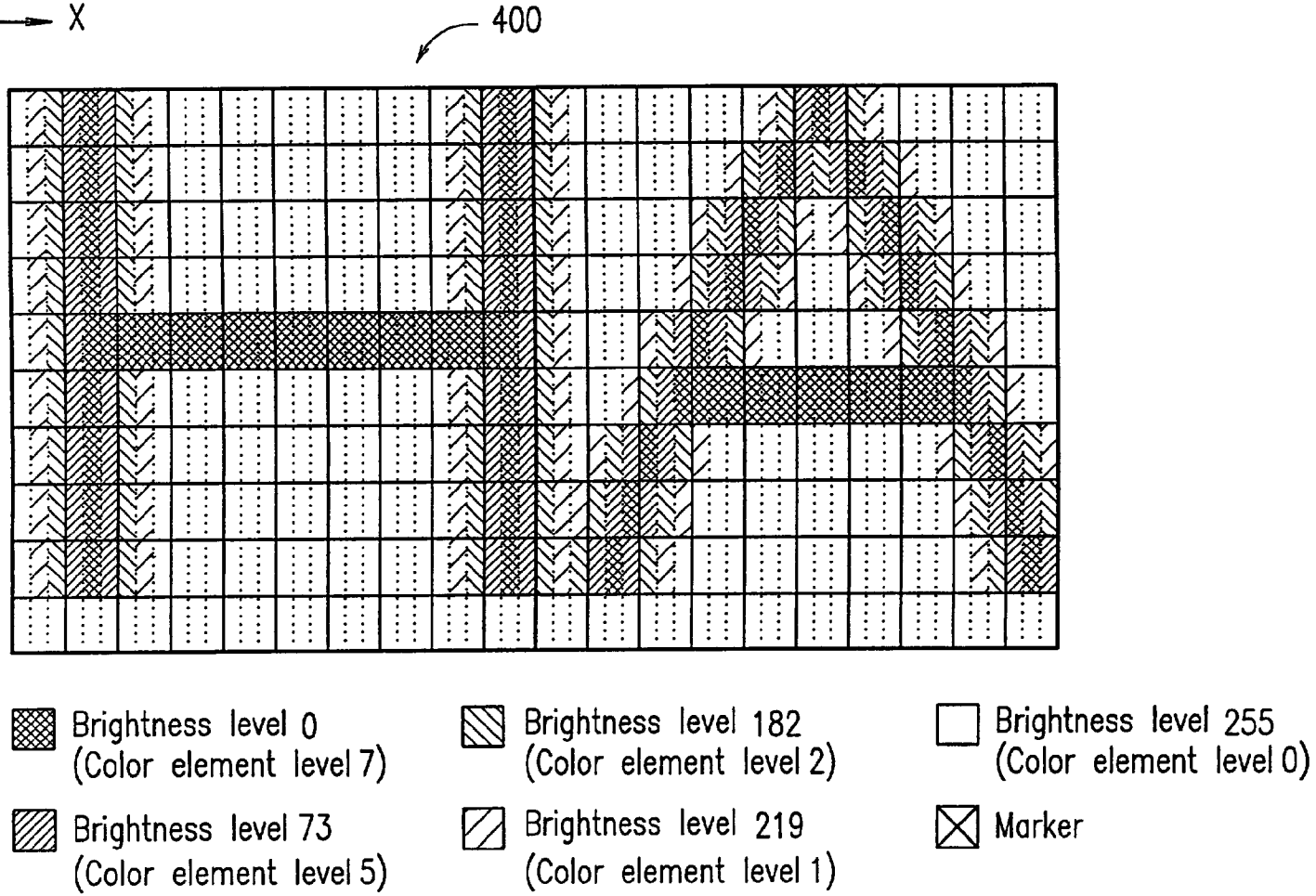
FIG. 42 shows the character sequence "HA" displayed on the display plane 400 after the process illustrated in FIG. 38 has been completed.
Figure 43:
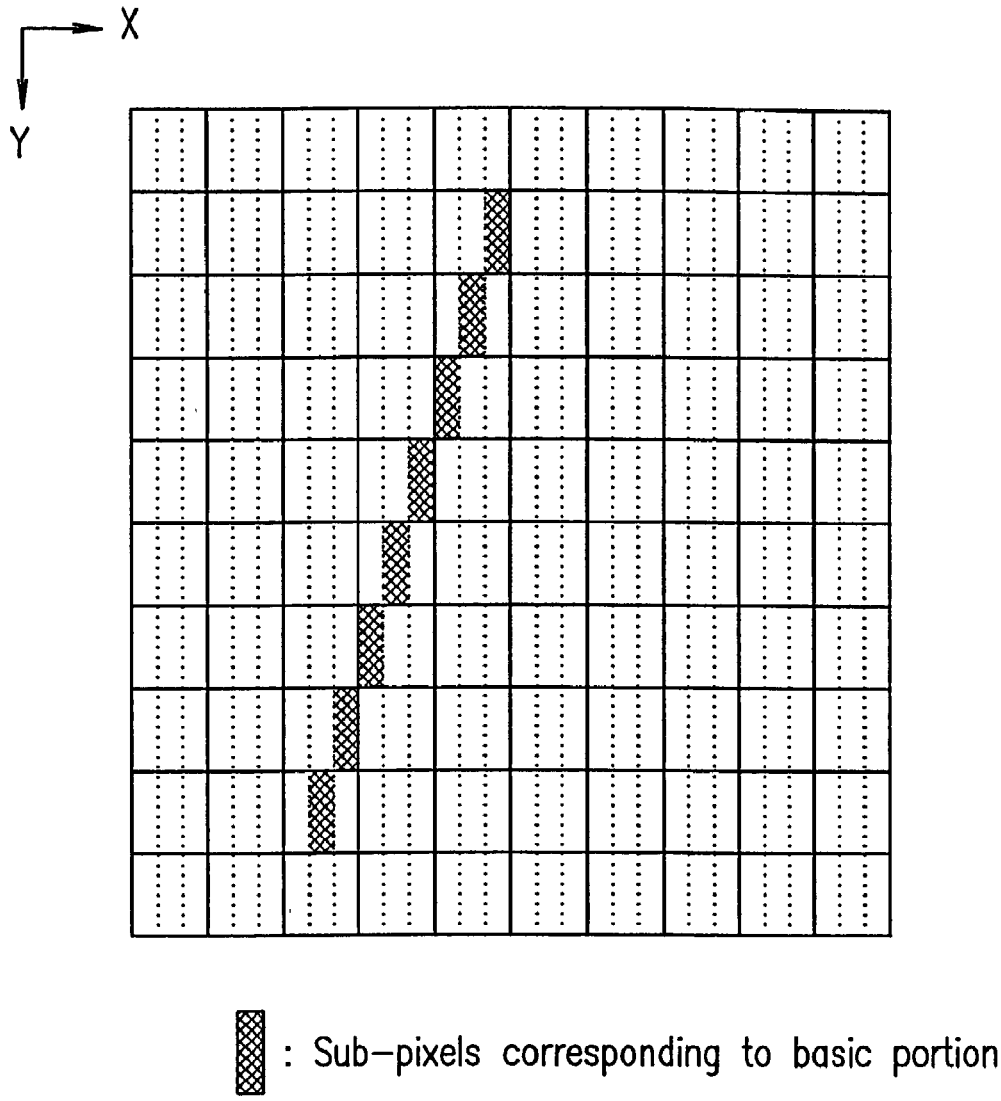
FIG. 43 shows an example where the intensities of sub-pixels corresponding to a basic portion of a character "/(slash)" is set to a predetermined value according to the conventional technique described in Japanese Laid-Open Publication No. 2001-100725.
Figure 44:
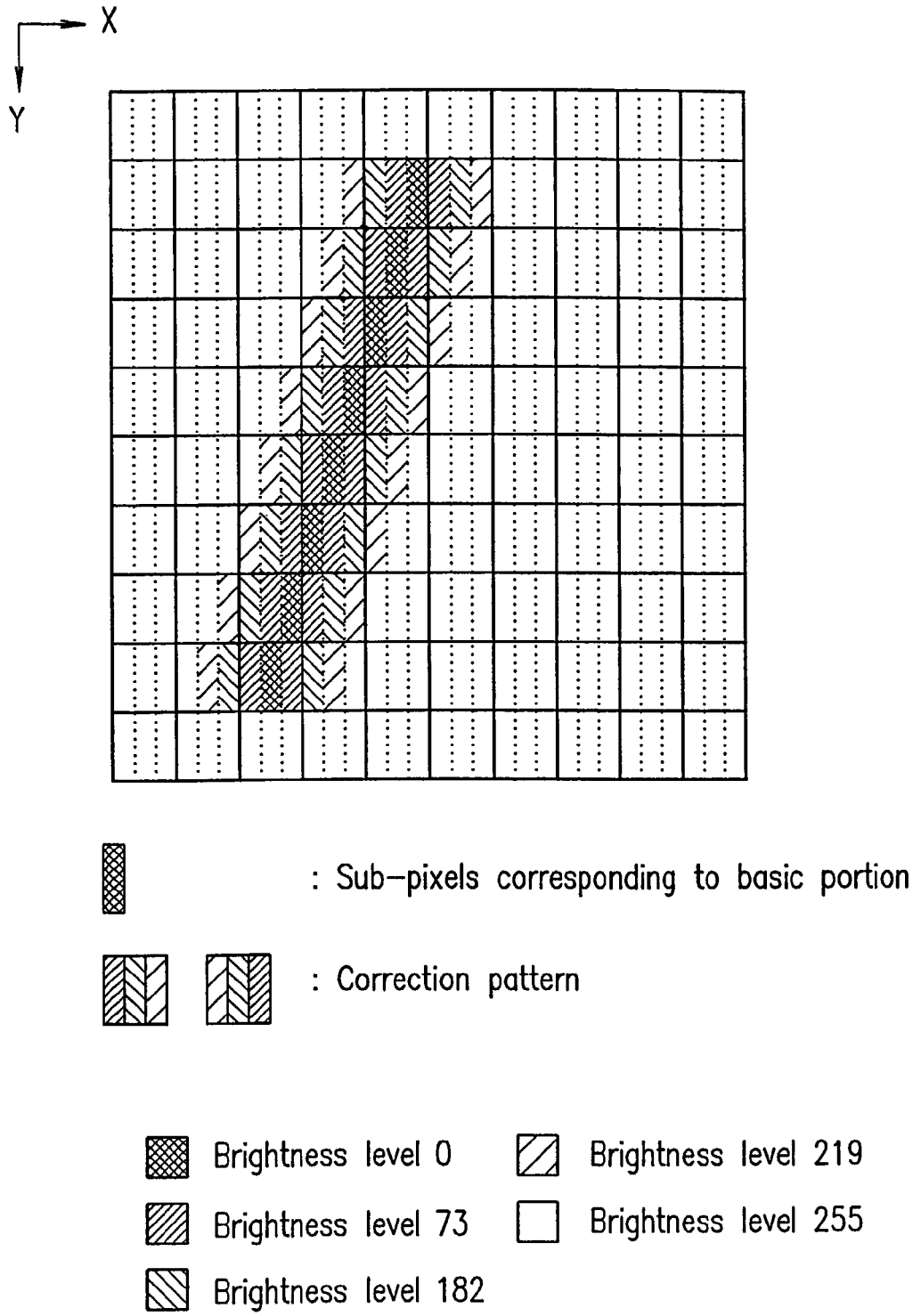
FIG. 44 shows an example where the color element intensities of sub-pixels located adjacent to sub-pixels corresponding to the basic portion of the character "/" are set to values different from the predetermined value according to the above conventional technique.
Figure 45:
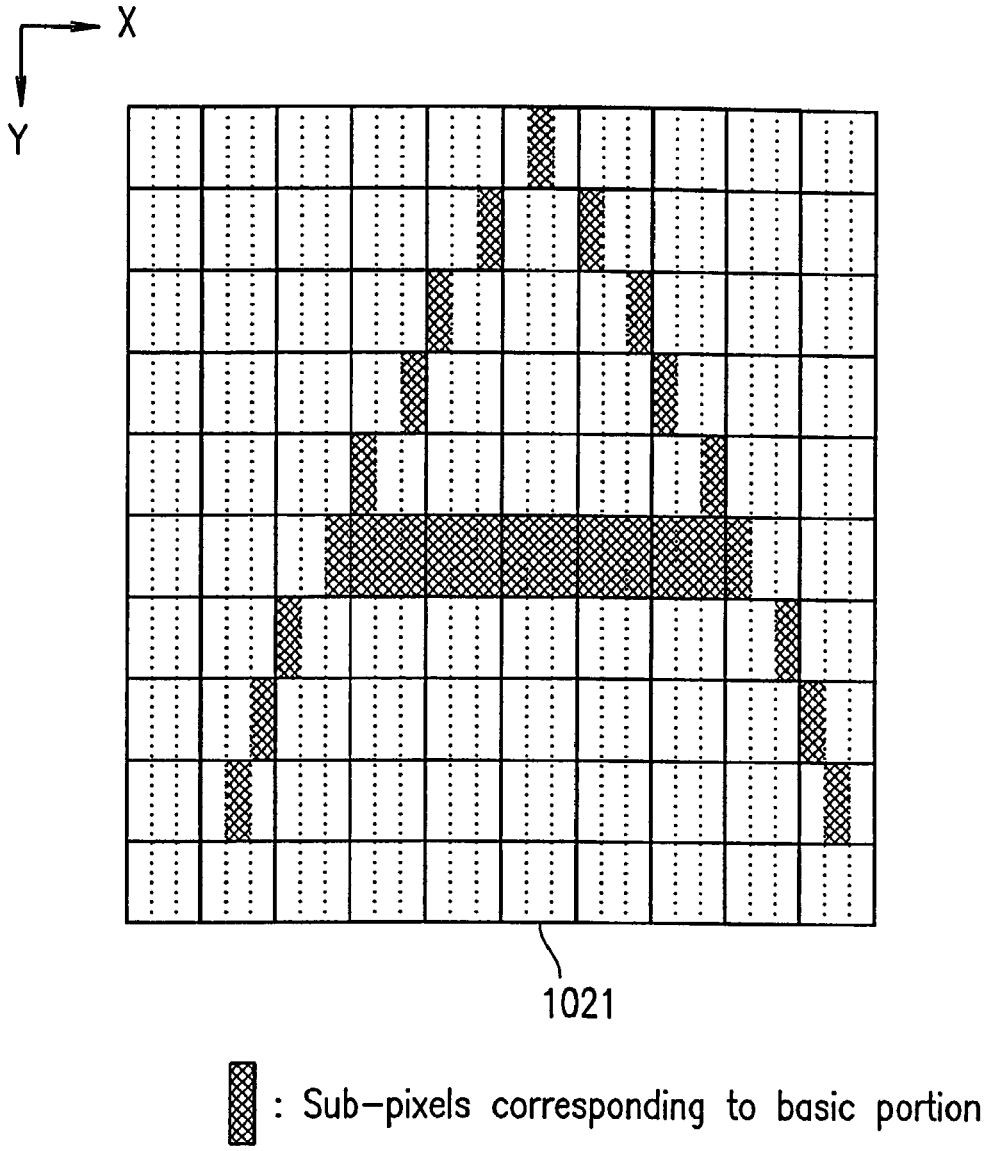
FIG. 45 shows a relationship between sub-pixels corresponding to a basic portion of a character "A" and a region corresponding to a frame.
Figure 46:
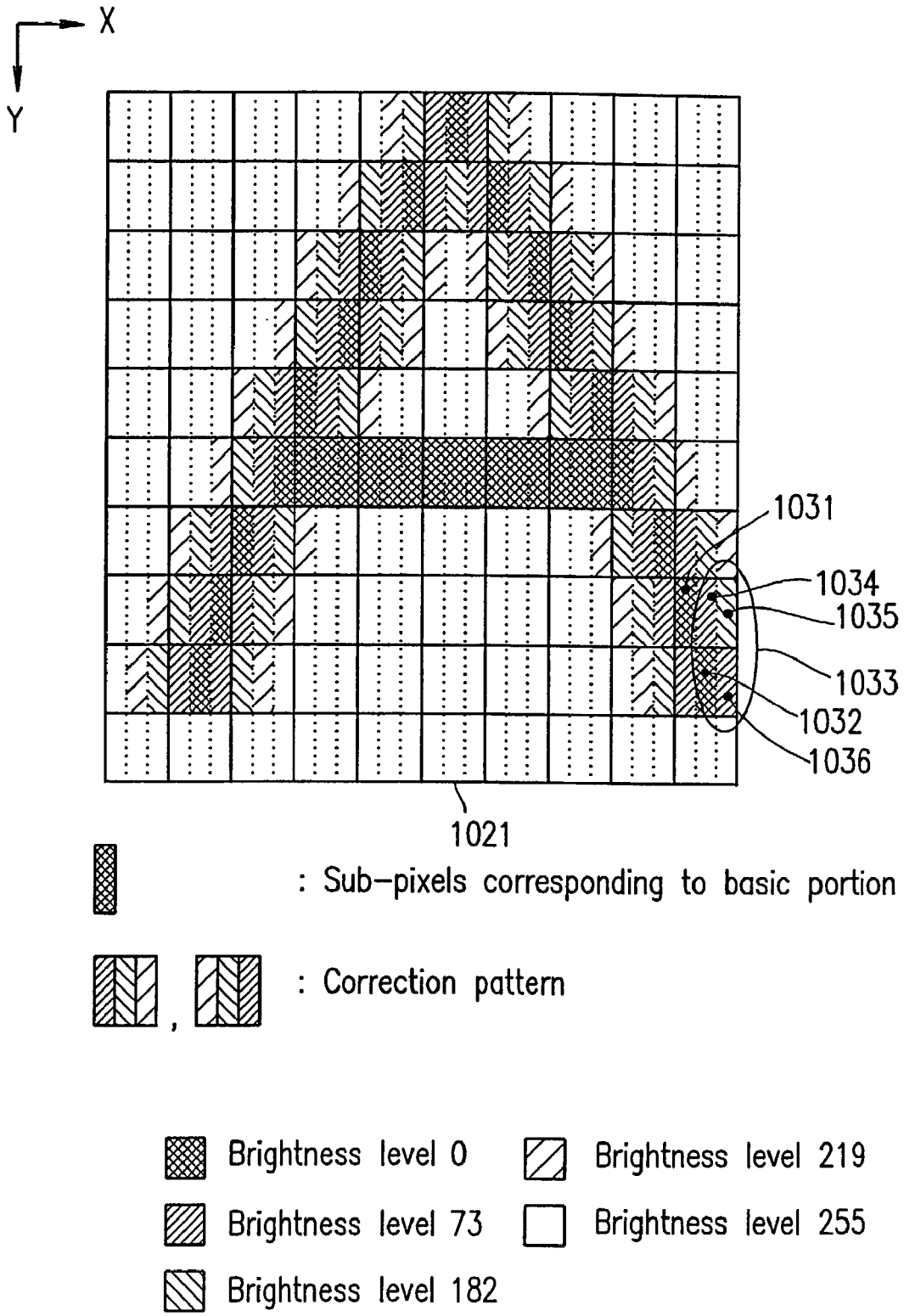
FIG. 46 shows an example where the color element intensities of sub-pixels located adjacent to sub-pixels corresponding to the basic portion of the character "A" are set to values different from the predetermined value according to the above conventional technique.
Figure 47:
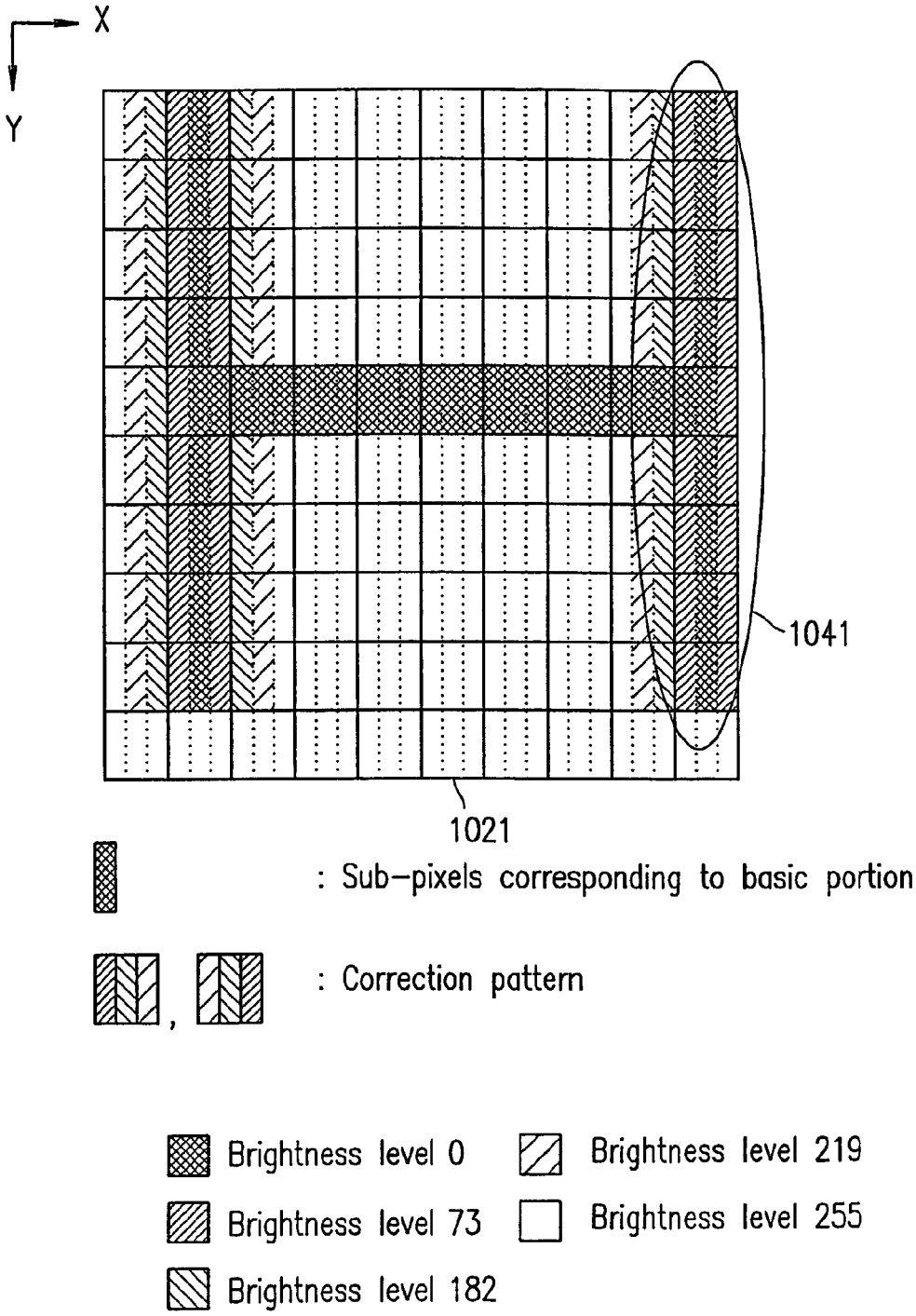
FIG. 47 shows an example where the color element intensities of sub-pixels located adjacent to sub-pixels corresponding to a basic portion of a character "H" are set to values different from the predetermined value according to the above conventional technique.

FIG. 42 shows the character sequence "HA" displayed on the display plane 400 after the process illustrated in FIG. 38 has been completed. In FIG. 42, each box represents one sub-pixel included in the display plane 400.

The character display process according to embodiment 3 of the present invention has been described while considering an example where the character sequence "HA" is displayed on the display plane 400 of the display device 10. However, it should be appreciated that the number of characters included in such a character sequence to be displayed is not limited to 2.

In the above-described embodiments 1–3, the examples where English language alphabets are displayed on the display plane 400 of the display device 10 have been considered. However, application of the present invention is not limited to English language alphabets. The present invention is applicable to characters of any other language (for example, Chinese characters, the Hangul (Korean) alphabet, etc.).

According to the present invention, the control section 20 of the character display apparatus 1 controls the display device 10 such that the color element level of at least one first sub-pixel, which corresponds to the basic portion of a first character, is set to a predetermined color element level, and the color element level of at least one first vicinal sub-pixel, which is located in the vicinity of the first sub-pixel, is set to a color element level different from the predetermined color element level, whereby the first character is displayed on the display plane 400. The basic portion of the first character is included in the first frame having a predetermined size. The at least one first sub-pixel which corresponds to the basic portion of the first character is included in a region on the display plane 400 which corresponds to the frame (first region). The at least one first vicinal sub-pixel is located out of the first region.

Due to such an arrangement, even when a correction pattern (a pattern for setting the color element level of a sub-pixel to a color element level different from the predetermined color element level) for a character cannot be placed within the first region which corresponds to the frame of the character, a portion of the correction pattern which protrudes from the first region is placed out of the first region. Thus, the first character can be displayed with a high quality.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A character display apparatus, comprising:

a display device including a display plane having a plurality of pixels; and a control section for controlling the display device, wherein each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, the control section controls the display device such that:

a color element level of at least one first sub-pixel, which corresponds to a basic portion of a first character, is set to a predetermined color element level; and a color element level of a first vicinal sub-pixel located in the vicinity of the at least one first sub-pixel is set to a color element level which is different from the predetermined color element level, whereby the first character is displayed on the display plane, the at least one first sub-pixel is included in a first region on the display plane which corresponds to a first frame, the first frame is a region having a first size such that the basic portion of the first character is included therein, the first size being predetermined with respect to the first character, at least one of the at least one first vicinal sub-pixel is out of the first region, the control section controls the display device such that a second character is further displayed on the display plane at a position adjacent to the first character, at least one second sub-pixel corresponding to a basic portion of the second character is included in a second region on the display plane which corresponds to a second frame, the second frame is a region having a second size such that the basic portion of the second character is included therein, the second size being predetermined with respect to the second character, the at least one of the at least one first vicinal sub-pixel is included in the second region, and the control section sets a color element level of the at least one of the at least one first vicinal sub-pixel based on a color element level which is determined according to a distance from the at least one first sub-pixel and a color element level which is determined according to a distance from the at least one second sub-pixel.

2. A character display apparatus according to claim 1, wherein the first character and the second character have identical display attributes.

3. A character display apparatus according to claim 1, wherein:

each of the basic portions of all the characters displayed on the display device is included in a frame having a predetermined size; and the at least one of the at least one first vicinal sub-pixel is not included in either of the regions on the display plane which respectively correspond to the frames.

4. A character display apparatus comprising:

a display device including a display plane having a plurality of pixels; and a control section for controlling the display device, wherein each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, the control section controls the display device such that:

a color element level of at least one first sub-pixel, which corresponds to a basic portion of a first character, is set to a predetermined color element level; and a color element level of a first vicinal sub-pixel located in the vicinity of the at least one first sub-pixel is set to a color element level which is different from the predetermined color element level, whereby the first character is displayed on the display plane, the at least one first sub-pixel is included in a first region on the display plane which corresponds to a first frame, the first frame is a region having a first size such that the basic portion of the first character is included therein, the first size being predetermined with respect to the first character, at least one of the at least one first vicinal sub-pixel is out of the first region, the control section sets the intensity of a color element of at least one predetermined sub-pixel included in the first region to a predetermined value regardless of a type of the first character, and the at least one predetermined sub-pixel is different from the first sub-pixel and the first vicinal sub-pixel.

5. A character display apparatus according to claim 1 or 4, wherein the control section sets again the color element level of the at least one of the at least one first vicinal sub-pixel when the control section controls the display device so as to write a third character over the first character displayed on the display plane.

6. A character display apparatus, comprising:

a display device including a display plane having a plurality of pixels; and a control section for controlling the display device, wherein each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, the control section controls the display device such that:

a color element level of at least one first sub-pixel, which corresponds to a basic portion of a first character, and a color element level of at least one second sub-pixel, which corresponds to a basic portion of a second character, are set to a predetermined color element level; and a color element level of a sub-pixel located in the vicinity of the at least one first sub-pixel and a color element level of a sub-pixel located in the vicinity of the at least one second sub-pixel are set to a color element level which is different from the predetermined color element level, based on a color element level which is determined according to a distance from the at least one first sub-pixel and a color element level which is determined according to a distance from the at least one second sub-pixel, whereby the first and second characters are displayed on the display plane.

7. A character display method for displaying a character on a display plane having a plurality of pixels, wherein each of the plurality of pixels includes a plurality of sub-pixels arranged along a predetermined direction, and a corresponding one of a plurality of color elements are pre-assigned to each of the plurality of sub-pixels, the intensity of each of the plurality of color elements is represented by a plurality of color element levels in a stepwise fashion, the character display method comprises:

(a) setting a color element level of at least one first sub-pixel, which corresponds to a basic portion of a first character, to a predetermined color element level; and setting a color element level of at least one first vicinal sub-pixel located in the vicinity of the at least one first sub-pixel to a color element level which is different from the predetermined color element level, wherein the at least one first sub-pixel is included in a first region on the display plane which corresponds to a first frame, the first frame is a region having a first size such that the basic portion of the first character is included therein, the first size being predetermined with respect to the first character, and at least one of the at least one first vicinal sub-pixel is out of the first region, the character display method further comprises:

setting a color element level of the at least one of the at least one first vicinal sub-pixel, based on a color element level which is determined according to a distance from the at least one first sub-pixel and a color element level which is determined according to a distance from the at least one second sub-pixel, wherein the at least one second sub-pixel corresponds to a basic portion of a second character, the at least one second sub-pixel is included in a second region on the display plane which corresponds to a second frame, the second frame is a region having a second size such that the basic portion of the second character is included therein, the second size being predetermined with respect to the second character, and the at least one of the at least one first vicinal sub-pixel is included in the second region.

8. A character display method for displaying a character on a display plane having a plurality of pixels, wherein each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, the character display method comprises:

setting a color element level of at least one first sub-pixel, which corresponds to a basic portion of a first character, color element level of at least one second sub-pixel, which corresponds to a basic portion of a second character, to a predetermined color element level; and setting a color element level of a sub-pixel located in the vicinity of the at least one first sub-pixel and a color element level of a sub-pixel located in the vicinity of the at least one second sub-pixel to a color element level which is different from the predetermined color element level, based on a color element level which is determined according to a distance from the at least one first sub-pixel and a color element level which is determined according to a distance from the at least one second sub-pixel.

9. A program stored on a recording medium which can be read by an information display apparatus for allowing the information display apparatus to execute character display processing, the information display apparatus including a display device which is provided with a display plane having a plurality of pixels, wherein each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, the character display processing comprises:

setting a color element level of at least one first sub-pixel, which corresponds to a basic portion of a first character, to a predetermined color element level; and setting a color element level of at least one first vicinal sub-pixel located in the vicinity of the at least one first sub-pixel to a color element level which is different from the predetermined color element level, wherein the at least one first sub-pixel is included in a first region on the display plane which corresponds to a first frame the first frame is a region having a first size such that the basic portion of the first character is included therein, the first size being predetermined with respect to the first character, and at least one of the at least one first vicinal sub-pixel is out of the first region, the character display processing further comprises:

setting a color element level of the at least one first vicinal sub-pixel, based on a color element level which is determined according to a distance from the at least one first sub-pixel and a color element level which is determined according to a distance from the at least one second sub-pixel, wherein the at least one second sub-pixel corresponds to a basic portion of a second character, the at least one second sub-pixel is included in a second region on the display plane which corresponds to a second frame, the second frame is a region having a second size such that the basic portion of the second character is included therein, the second size being predetermined with respect to the second character, and the at least one of the at least one first vicinal sub-pixel is included in the second region.

10. A program stored on a recording medium which can be read by an information display apparatus for allowing the information display apparatus to execute character display processing, the information display apparatus including a display device which is provided with a display plane having a plurality of pixels, wherein each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, the character display processing comprises:

setting a color element level of at least one first sub-pixel, which corresponds to a basic portion of a first character, a color element level of at least one second sub-pixel, which corresponds to a basic portion of a second character, to a predetermined color element level; and setting a color element level of a sub-pixel located in the vicinity of the at least one first sub-pixel and a color element level of a sub-pixel located in the vicinity of the at least one second sub-pixel to a color element level which is different from the predetermined color element level, based on a color element level which is determined according to a distance from the at least one first sub-pixel and a color element level which is determined according to a distance from the at least one-second sub-pixel.

11. A recording medium which can be read by an information display apparatus, the information display apparatus including a display device which is provided with a display plane having a plurality of pixels, wherein the recording medium stores a program which allows the information display apparatus to execute character display processing, each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, the character display processing comprising:

setting a color element level of at least one first sub-pixel, which corresponds to a basic portion of a first character, to a predetermined color element level; and setting a color element level of at least one first vicinal sub-pixel located in the vicinity of the at least one first sub-pixel to a color element level which is different from the predetermined color element level, wherein the at least one first sub-pixel is included in a first region on the display plane which corresponds to a first frame, the first frame is a region having a first size such that the basic potion of the first character is included therein, the first size being predetermined with respect to the first character, and at least one of the at least one first vicinal sub-pixel is out of the first regions, the character display processing further comprises:

setting a color element level of the at least one of the at least one first vicinal sub-pixel, based on a color element level which is determined according to a distance from the at least one first sub-pixel and a color element level which is determined according to a distance from the at least one second sub-pixel, wherein the at least one second sub-pixel corresponds to a basic portion of a second character, the at least one second sub-pixel is included in a second region on the display plane which corresponds to a second frame, the second frame is a region having a second size such that the basic portion of the second character is included therein, the second size being predetermined with respect to the second character, and the at least one of the at least one first vicinal sub-pixel is included in the second region.

12. A recording medium which can be read by an information display apparatus, the information display apparatus including a display device which is provided with a display plane having a plurality of pixels, wherein the recording medium stores a program which allows the information display apparatus to execute character display processing, each of the plurality of pixels includes a plurality of sub-pixels arranged along a predetermined direction, a corresponding one of a plurality of color elements being pre-assigned to each of the plurality of sub-pixels, the intensity of each of the plurality of color elements is represented by a plurality of color element levels in a stepwise fashion, the character display processing comprises:

setting a color element level of at least one first sub-pixel, which corresponds to a basic portion of a first character, a color element level of at least one second sub-pixel, which corresponds to a basic portion of a second character, to a predetermined color element level; and setting a color element level of a sub-pixel located in the vicinity of the at least one first sub-pixel and a color element level of a sub-pixel located in the vicinity of the at least one second sub-pixel to a color element level which is different from the predetermined color element level, based on a color element level which is determined according to a distance from the at least one first sub-pixel and a color element level which is determined according to a distance from the at least one second sub-pixel.

13. A character display method for displaying a character on a display plane having a plurality of pixels, wherein each of the plurality of pixels includes a plurality of sub-pixels arranged along a predetermined direction, a corresponding one of a plurality of color elements being pre-assigned to each of the plurality of sub-pixels, and the intensity of each of the plurality of color elements is represented by a plurality of color element levels in a stepwise fashion, the character display method comprises:

setting a color element level of at least one first sub-pixel, which corresponds to a basic portion of a first character, to a predetermined color element level; and setting a color element level of at least one first vicinal sub-pixel located in the vicinity of the at least one first sub-pixel to a color element level which is different from the predetermined color element level, the at least one first sub-pixel is included in a first region on the display plane which corresponds to a first frame, the first frame is a region having a first size such that the basic portion of the first character is included therein, the first size being predetermined with respect to the first character, at least one of the at least one first vicinal sub-pixel is out of the first region, the character display method further comprises:

setting the intensity of a color element of at least one predetermined sub-pixel included in the first region to a predetermined value regardless of a type of the first character, and the at least one predetermined sub-pixel is different from the first sub-pixel and the first vicinal sub-pixel.

14. A program stored on a recording medium which can be read by an information display apparatus for allowing the information display apparatus to execute character display processing, the information display apparatus including a display device which is provided with a display plane having a plurality of pixels, wherein each of the plurality of pixels includes a plurality of sub-pixels arranged along a predetermined direction, a corresponding one of a plurality of color elements being pre-assigned to each of the plurality of sub-pixels, and the intensity of each of the plurality of color elements is represented by a plurality of color element levels in a stepwise fashion, the character display processing comprises:

setting a color element level of at least one first sub-pixel, which corresponds to a basic portion of a first character, to a predetermined color element level; and setting a color element level of at least one first vicinal sub-pixel located in the vicinity of the at least one first sub-pixel to a color element level which is different from the predetermined color element level, the at least one first sub-pixel is included in a first region on the display plane which corresponds to a first frame, the first frame is a region having a first size such that the basic portion of the first character is included therein, the first size being predetermined with respect to the first character, at least one of the at least one first vicinal sub-pixel is out of the first region, the character display processing further comprises:

setting the intensity of a color element of at least one predetermined sub-pixel included in the first region to a predetermined value regardless of a type of the first character, and the at least one predetermined sub-pixel is different from the first sub-pixel and the first vicinal sub-pixel.

15. A recording medium which can be read by an information display apparatus, the information display apparatus including a display device which is provided with a display plane having a plurality of pixels, wherein the recording medium stores a program which allows the information display apparatus to execute character display processing, wherein each of the plurality of pixels includes a plurality of sub-pixels arranged along a predetermined direction, a corresponding one of a plurality of color elements being pre-assigned to each of the plurality of sub-pixels, and the intensity of each of the plurality of color elements is re-represented by a plurality of color element levels in a stepwise fashion, the character display processing comprises:

setting a color element level of at least one first sub-pixel, which corresponds to a basic portion of a first character, to a predetermined color element level; and setting a color element level of at least one first vicinal sub-pixel located in the vicinity of the at least one first sub-pixel to a color element level which is different from the predetermined color element level, the at least one first sub-pixel is included in a first region on the display plane which corresponds to a first frame, the first frame is a region having a first size such that the basic portion of the first character is included therein, the first size being predetermined with respect to the first character, at least one of the at least one first vicinal sub-pixel is out of the first region, the character display processing further comprises:

setting the intensity of a color element of at least one predetermined sub-pixel included in the first region to a predetermined value regardless of a type of the first character, and the at least one predetermined sub-pixel is different from the first sub-pixel and the first vicinal sub-pixel.

* * * * *